US005818409A

United States Patent [19]

Furuhashi et al.

[11] Patent Number: 5,818,409

[45] Date of Patent: Oct. 6, 1998

[54] DRIVING CIRCUITS FOR A PASSIVE MATRIX LCD WHICH USES ORTHOGONAL FUNCTIONS TO SELECT DIFFERENT GROUPS OF SCANNING ELECTRODES

[75] Inventors: Tsutomu Furuhashi, Yokohama; Tatsuhiro Inuzuka, Odawara; Hiroyuki Mano, Chigasaki; Shigeyuki Nishitani; Yasuyuki Kudo, both of Yokohama; Satoru Tsunekawa, Higashimurayama; Toshio Futami, Mobara, all of Japan

[73] Assignee: Hitachi, Ltd., Tokyo, Japan

[21] Appl. No.: 575,940

[22] Filed: Dec. 21, 1995

[30] Foreign Application Priority Data

Dec. 26, 1994 [JP] Japan ..... 6-323029

[51] Int. Cl.[6] ..... G09G 3/36

[52] U.S. Cl. ..... 345/94; 345/98

[58] Field of Search ..... 345/94, 97, 98, 345/99, 100, 95, 208, 210, 103, 89, 87

[56] References Cited

U.S. PATENT DOCUMENTS

| | | | |
|---|---|---|---|
| 5,475,397 | 12/1995 | Saidi | 345/95 |
| 5,610,628 | 3/1997 | Yamamamoto et al. | 345/100 |
| 5,619,224 | 4/1997 | Hoshino et al. | 345/98 |
| 5,638,088 | 6/1997 | Mano et al. | 345/95 |
| 5,642,133 | 6/1997 | Scheffer et al. | 345/147 |
| 5,677,705 | 10/1997 | Shimura et al. | 345/95 |
| 5,682,177 | 10/1997 | Kuwata et al. | 345/100 |
| 5,689,280 | 11/1997 | Asari et al. | 345/89 |

FOREIGN PATENT DOCUMENTS

| | | | |
|---|---|---|---|
| 0 617 399 A1 | 9/1994 | European Pat. Off. . | |
| 0617397 A | 9/1994 | European Pat. Off. | 345/103 |
| PCT/JP93/00421 | 4/1993 | Japan . | |
| 6-067628 | 3/1994 | Japan . | |

OTHER PUBLICATIONS

"Active Addressing of STN Displays for High–Performance Video Applications", T. J. Scheffer et al, 2449 Displays, 14 (1993) No. 2, Jordan Hill, Oxford, GB, pp. 74–85.

"9.1: Optimum Row Functions and Algorithms for Active Addressing", B. Clifton et al, Motif, Inc., Wilsonville, OR, pp. 89–92.

"A Generalized Addressing Technique for RMS Responding Matrix LCDS", T. Ruckmongathan, Raman Reseach Institute, Bangalore 560080, India, pp. 80–85.

*Primary Examiner*—Jeffery Brier
*Assistant Examiner*—Paul A. Bell
*Attorney, Agent, or Firm*—Antonelli, Terry, Stout & Kraus, LLP

[57] ABSTRACT

A data electrode driving circuit, a scanning electrode driving circuit, a liquid crystal display unit and a driving method thereof for attaining simultaneous scanning and driving of a plurality of rows in a passive matrix type liquid crystal display unit. A scanning electrode driving circuit includes a scanning function generating circuit for generating scanning functions for m rows. A scanning voltage is selected by the scanning function and a driving voltage is supplied to the scanning electrode. On the other hand, a data electrode driving circuit includes shift registers for m rows. The shift registers produce display data for m rows taken therein at the same time. The display data for m rows and the scanning function produced by the scanning electrode driving circuits are subjected to comparison operation. One level of m+1 level voltages is selected in accordance with the operation result and is supplied to the data electrode. The liquid crystal panel performs display in accordance with the voltage for the scanning electrode and the voltage for the data electrode.

23 Claims, 49 Drawing Sheets

FIG. 9

| FRAME COUNT 174 | LINE COUNT 175 | SCANNING FUNCTION DATA 178 | | | |
|---|---|---|---|---|---|
| | | W0 | W1 | W2 | W3 |
| EVEN | 0 | 1 | 1 | 1 | 1 |
| | 1 | 1 | 1 | 0 | 0 |
| | 2 | 1 | 0 | 0 | 1 |
| | 3 | 1 | 0 | 1 | 0 |
| | 4 | 1 | 1 | 1 | 1 |
| | 5 | 1 | 1 | 0 | 0 |
| | 6 | 1 | 0 | 0 | 1 |
| | 7 | 1 | 0 | 1 | 0 |
| | ⋮ | ⋮ | ⋮ | ⋮ | ⋮ |
| | 236 | 1 | 1 | 1 | 1 |
| | 237 | 1 | 1 | 0 | 0 |
| | 238 | 1 | 0 | 0 | 1 |
| | 239 | 1 | 0 | 1 | 0 |

| FRAME COUNT 174 | LINE COUNT 175 | SCANNING FUNCTION DATA 178 | | | |
|---|---|---|---|---|---|
| | | W0 | W1 | W2 | W3 |
| ODD | 0 | 0 | 0 | 0 | 0 |
| | 1 | 0 | 0 | 1 | 1 |
| | 2 | 0 | 1 | 1 | 0 |
| | 3 | 0 | 1 | 0 | 1 |
| | 4 | 0 | 0 | 0 | 0 |
| | 5 | 0 | 0 | 1 | 1 |
| | 6 | 0 | 1 | 1 | 0 |
| | 7 | 0 | 1 | 0 | 1 |
| | ⋮ | ⋮ | ⋮ | ⋮ | ⋮ |
| | 236 | 0 | 0 | 0 | 0 |
| | 237 | 0 | 0 | 1 | 1 |
| | 238 | 0 | 1 | 1 | 0 |
| | 239 | 0 | 1 | 0 | 1 |

FIG. 17

| E0 | E1 | E2 | E3 | S0 | S1 | S2 | S3 | S4 |
|---|---|---|---|---|---|---|---|---|
| 0 | 0 | 0 | 0 | 1 | 0 | 0 | 0 | 0 |
| 0 | 0 | 0 | 1 | 0 | 1 | 0 | 0 | 0 |
| 0 | 0 | 1 | 0 | 0 | 1 | 0 | 0 | 0 |
| 0 | 0 | 1 | 1 | 0 | 0 | 1 | 0 | 0 |
| 0 | 1 | 0 | 0 | 0 | 1 | 0 | 0 | 0 |
| 0 | 1 | 0 | 1 | 0 | 0 | 1 | 0 | 0 |
| 0 | 1 | 1 | 0 | 0 | 0 | 1 | 0 | 0 |
| 0 | 1 | 1 | 1 | 0 | 0 | 0 | 1 | 0 |
| 1 | 0 | 0 | 0 | 0 | 1 | 0 | 0 | 0 |
| 1 | 0 | 0 | 1 | 0 | 0 | 1 | 0 | 0 |
| 1 | 0 | 1 | 0 | 0 | 0 | 1 | 0 | 0 |
| 1 | 0 | 1 | 1 | 0 | 0 | 0 | 1 | 0 |
| 1 | 1 | 0 | 0 | 0 | 0 | 1 | 0 | 0 |
| 1 | 1 | 0 | 1 | 0 | 0 | 0 | 1 | 0 |
| 1 | 1 | 1 | 0 | 0 | 0 | 0 | 1 | 0 |
| 1 | 1 | 1 | 1 | 0 | 0 | 0 | 0 | 1 |

FIG. 20

| FRAME COUNT 174 | LINE COUNT 175 | SCANNING FUNCTION DATA 178 | | | |
|---|---|---|---|---|---|
| | | W0 | W1 | W2 | W3 |
| EVEN | 0 | 1 | 1 | 1 | 1 |
| | 1 | 1 | 1 | 0 | 0 |
| | 2 | 1 | 0 | 0 | 1 |
| | 3 | 1 | 0 | 1 | 0 |
| | 4 | 1 | 1 | 1 | 1 |
| | 5 | 1 | 0 | 0 | 1 |
| | 6 | 0 | 0 | 1 | 1 |
| | 7 | 0 | 1 | 0 | 1 |
| | ⋮ | ⋮ | ⋮ | ⋮ | ⋮ |
| | 236 | 1 | 1 | 1 | 1 |
| | 237 | 0 | 1 | 1 | 0 |
| | 238 | 1 | 1 | 0 | 0 |
| | 239 | 0 | 1 | 0 | 1 |

| FRAME COUNT 174 | LINE COUNT 175 | SCANNING FUNCTION DATA 178 | | | |
|---|---|---|---|---|---|
| | | W0 | W1 | W2 | W3 |
| ODD | 0 | 0 | 0 | 0 | 0 |
| | 1 | 0 | 0 | 1 | 1 |
| | 2 | 0 | 1 | 1 | 0 |
| | 3 | 0 | 1 | 0 | 1 |
| | 4 | 0 | 0 | 0 | 0 |
| | 5 | 0 | 1 | 1 | 0 |
| | 6 | 1 | 1 | 0 | 0 |
| | 7 | 1 | 0 | 1 | 0 |
| | ⋮ | ⋮ | ⋮ | ⋮ | ⋮ |
| | 236 | 0 | 0 | 0 | 0 |
| | 237 | 1 | 0 | 0 | 1 |
| | 238 | 0 | 0 | 1 | 1 |
| | 239 | 1 | 0 | 1 | 0 |

FIG. 21

| FRAME COUNT 174 | LINE COUNT 175 | SCANNING FUNCTION DATA 178 | | | |
|---|---|---|---|---|---|
| | | W0 | W1 | W2 | W3 |
| EVEN | 0 | 1 | 1 | 1 | 1 |
| | 1 | 1 | 1 | 0 | 0 |
| | 2 | 1 | 0 | 0 | 1 |
| | 3 | 1 | 0 | 1 | 0 |
| | 4 | 0 | 0 | 0 | 0 |
| | 5 | 0 | 0 | 1 | 1 |
| | 6 | 0 | 1 | 1 | 0 |
| | 7 | 0 | 1 | 0 | 1 |
| | ⋮ | ⋮ | ⋮ | ⋮ | ⋮ |
| | 236 | 0 | 0 | 0 | 0 |
| | 237 | 0 | 0 | 1 | 1 |
| | 238 | 0 | 1 | 1 | 0 |
| | 239 | 0 | 1 | 0 | 1 |

| FRAME COUNT 174 | LINE COUNT 175 | SCANNING FUNCTION DATA 178 | | | |
|---|---|---|---|---|---|
| | | W0 | W1 | W2 | W3 |
| ODD | 0 | 0 | 0 | 0 | 0 |
| | 1 | 0 | 0 | 1 | 1 |
| | 2 | 0 | 1 | 1 | 0 |
| | 3 | 0 | 1 | 0 | 1 |
| | 4 | 1 | 1 | 1 | 1 |
| | 5 | 1 | 1 | 0 | 0 |
| | 6 | 1 | 0 | 0 | 1 |
| | 7 | 1 | 0 | 1 | 0 |
| | ⋮ | ⋮ | ⋮ | ⋮ | ⋮ |
| | 236 | 1 | 1 | 1 | 1 |
| | 237 | 1 | 1 | 0 | 0 |
| | 238 | 1 | 0 | 0 | 1 |
| | 239 | 1 | 0 | 1 | 0 |

FIG. 22

| FRAME COUNT 174 | LINE COUNT 175 | SCANNING FUNCTION DATA 178 | | | |
|---|---|---|---|---|---|
| | | W0 | W1 | W2 | W3 |
| 0 | 0 | 1 | 1 | 1 | 1 |
| | 1 | 1 | 1 | 0 | 0 |
| | 2 | 1 | 0 | 0 | 1 |
| | 3 | 1 | 0 | 1 | 0 |
| | 4 | 1 | 1 | 1 | 1 |
| | 5 | 1 | 1 | 0 | 0 |
| | 6 | 1 | 0 | 0 | 1 |
| | 7 | 1 | 0 | 1 | 0 |
| | ⋮ | ⋮ | ⋮ | ⋮ | ⋮ |
| | 236 | 1 | 1 | 1 | 1 |
| | 237 | 1 | 1 | 0 | 0 |
| | 238 | 1 | 0 | 0 | 1 |
| | 239 | 1 | 0 | 1 | 0 |

| FRAME COUNT 174 | LINE COUNT 175 | SCANNING FUNCTION DATA 178 | | | |
|---|---|---|---|---|---|
| | | W0 | W1 | W2 | W3 |
| 1 | 0 | 0 | 0 | 0 | 0 |
| | 1 | 0 | 1 | 1 | 0 |
| | 2 | 1 | 1 | 0 | 0 |
| | 3 | 1 | 0 | 1 | 0 |
| | 4 | 0 | 0 | 0 | 0 |
| | 5 | 0 | 1 | 1 | 0 |
| | 6 | 1 | 1 | 0 | 0 |
| | 7 | 1 | 0 | 1 | 0 |
| | ⋮ | ⋮ | ⋮ | ⋮ | ⋮ |
| | 236 | 0 | 0 | 0 | 0 |
| | 237 | 0 | 1 | 1 | 0 |
| | 238 | 1 | 1 | 0 | 0 |
| | 239 | 1 | 0 | 1 | 0 |

| FRAME COUNT 174 | LINE COUNT 175 | SCANNING FUNCTION DATA 178 | | | |
|---|---|---|---|---|---|
| | | W0 | W1 | W2 | W3 |
| 2 | 0 | 1 | 1 | 1 | 1 |
| | 1 | 0 | 0 | 1 | 1 |
| | 2 | 0 | 1 | 1 | 0 |
| | 3 | 1 | 0 | 1 | 0 |
| | 4 | 1 | 1 | 1 | 1 |
| | 5 | 0 | 0 | 1 | 1 |
| | 6 | 0 | 1 | 1 | 0 |
| | 7 | 1 | 0 | 1 | 0 |
| | ⋮ | ⋮ | ⋮ | ⋮ | ⋮ |
| | 236 | 1 | 1 | 1 | 1 |
| | 237 | 0 | 0 | 1 | 1 |
| | 238 | 0 | 1 | 1 | 0 |
| | 239 | 1 | 0 | 1 | 0 |

| FRAME COUNT 174 | LINE COUNT 175 | SCANNING FUNCTION DATA 178 | | | |
|---|---|---|---|---|---|
| | | W0 | W1 | W2 | W3 |
| 3 | 0 | 0 | 0 | 0 | 0 |
| | 1 | 1 | 0 | 0 | 1 |
| | 2 | 0 | 0 | 1 | 1 |
| | 3 | 1 | 0 | 1 | 0 |
| | 4 | 0 | 0 | 0 | 0 |
| | 5 | 1 | 0 | 0 | 1 |
| | 6 | 0 | 0 | 1 | 1 |
| | 7 | 1 | 0 | 1 | 0 |
| | ⋮ | ⋮ | ⋮ | ⋮ | ⋮ |
| | 236 | 0 | 0 | 0 | 0 |
| | 237 | 1 | 0 | 0 | 1 |
| | 238 | 0 | 0 | 1 | 1 |
| | 239 | 1 | 0 | 1 | 0 |

FIG. 26

| FRAME COUNT 174 | LINE COUNT 175 | SCANNING FUNCTION DATA 178 | | | |
|---|---|---|---|---|---|
| | | W0 | W1 | W2 | W3 |
| 0 | 0 | 1 | 0 | 0 | 0 |
| | 1 | 0 | 0 | 1 | 0 |
| | 2 | 1 | 0 | 1 | 1 |
| | 3 | 1 | 1 | 1 | 0 |
| | 4 | 1 | 0 | 0 | 0 |
| | 5 | 0 | 0 | 1 | 0 |
| | 6 | 1 | 0 | 1 | 1 |
| | 7 | 1 | 1 | 1 | 0 |
| | ⋮ | ⋮ | ⋮ | ⋮ | ⋮ |
| | 236 | 1 | 0 | 0 | 0 |
| | 237 | 0 | 0 | 1 | 0 |
| | 238 | 1 | 0 | 1 | 1 |
| | 239 | 1 | 1 | 1 | 0 |

| FRAME COUNT 174 | LINE COUNT 175 | SCANNING FUNCTION DATA 178 | | | |
|---|---|---|---|---|---|
| | | W0 | W1 | W2 | W3 |
| 1 | 0 | 0 | 1 | 1 | 1 |
| | 1 | 1 | 1 | 0 | 1 |
| | 2 | 0 | 1 | 0 | 0 |
| | 3 | 0 | 0 | 0 | 1 |
| | 4 | 0 | 1 | 1 | 1 |
| | 5 | 1 | 1 | 0 | 1 |
| | 6 | 0 | 1 | 0 | 0 |
| | 7 | 0 | 0 | 0 | 1 |
| | ⋮ | ⋮ | ⋮ | ⋮ | ⋮ |
| | 236 | 0 | 1 | 1 | 1 |
| | 237 | 1 | 1 | 0 | 1 |
| | 238 | 0 | 1 | 0 | 0 |
| | 239 | 0 | 0 | 0 | 1 |

| FRAME COUNT 174 | LINE COUNT 175 | SCANNING FUNCTION DATA 178 | | | |
|---|---|---|---|---|---|
| | | W0 | W1 | W2 | W3 |
| 2 | 0 | 0 | 0 | 1 | 0 |
| | 1 | 1 | 0 | 0 | 0 |
| | 2 | 1 | 1 | 1 | 0 |
| | 3 | 1 | 0 | 1 | 1 |
| | 4 | 0 | 0 | 1 | 0 |
| | 5 | 1 | 0 | 0 | 0 |
| | 6 | 1 | 1 | 1 | 0 |
| | 7 | 1 | 0 | 1 | 1 |
| | ⋮ | ⋮ | ⋮ | ⋮ | ⋮ |
| | 236 | 0 | 0 | 1 | 0 |
| | 237 | 1 | 0 | 0 | 0 |
| | 238 | 1 | 1 | 1 | 0 |
| | 239 | 1 | 0 | 1 | 1 |

| FRAME COUNT 174 | LINE COUNT 175 | SCANNING FUNCTION DATA 178 | | | |
|---|---|---|---|---|---|
| | | W0 | W1 | W2 | W3 |
| 3 | 0 | 1 | 1 | 0 | 1 |
| | 1 | 0 | 1 | 1 | 1 |
| | 2 | 0 | 0 | 0 | 1 |
| | 3 | 0 | 1 | 0 | 0 |
| | 4 | 1 | 1 | 0 | 1 |
| | 5 | 0 | 1 | 1 | 1 |
| | 6 | 0 | 0 | 0 | 1 |
| | 7 | 0 | 1 | 0 | 0 |
| | ⋮ | ⋮ | ⋮ | ⋮ | ⋮ |
| | 236 | 1 | 1 | 0 | 1 |
| | 237 | 0 | 1 | 1 | 1 |
| | 238 | 0 | 0 | 0 | 1 |
| | 239 | 0 | 1 | 0 | 0 |

| FRAME COUNT 274 | SCANNING FUNCTION DATA 278 | | | |
|---|---|---|---|---|
| | W0 | W1 | W2 | W3 |
| 0 | 1 | 0 | 1 | 1 |
| 1 | 0 | 1 | 0 | 0 |
| 2 | 0 | 0 | 0 | 1 |
| 3 | 1 | 1 | 1 | 0 |
| 4 | 0 | 1 | 1 | 1 |
| 5 | 1 | 0 | 0 | 0 |
| 6 | 0 | 0 | 1 | 0 |
| 7 | 1 | 1 | 0 | 1 |
| ⋮ | ⋮ | ⋮ | ⋮ | ⋮ |

FIG. 46

| FRAME COUNT 292 | 4-LINE COUNT 293 | SCANNING FUNCTION DATA 295 | | | |
|---|---|---|---|---|---|
| | | W0 | W1 | W2 | W3 |
| 0 | 0 | 1 | 0 | 1 | 1 |
| | 1 | 0 | 1 | 0 | 0 |
| | 2 | 0 | 0 | 0 | 1 |
| | 3 | 1 | 1 | 1 | 0 |
| | 4 | 0 | 1 | 1 | 1 |
| | 5 | 1 | 0 | 0 | 0 |
| | 6 | 0 | 0 | 1 | 0 |
| | 7 | 1 | 1 | 0 | 1 |
| | ⋮ | ⋮ | ⋮ | ⋮ | ⋮ |
| | 56 | 0 | 1 | 1 | 1 |
| | 57 | 1 | 0 | 0 | 0 |
| | 58 | 0 | 0 | 1 | 0 |
| | 59 | 1 | 1 | 0 | 1 |

| FRAME COUNT 292 | 4-LINE COUNT 293 | SCANNING FUNCTION DATA 295 | | | |
|---|---|---|---|---|---|
| | | W0 | W1 | W2 | W3 |
| 1 | 0 | 0 | 1 | 0 | 0 |
| | 1 | 0 | 0 | 0 | 1 |
| | 2 | 1 | 1 | 1 | 0 |
| | 3 | 0 | 1 | 1 | 1 |
| | 4 | 1 | 0 | 0 | 0 |
| | 5 | 0 | 0 | 1 | 0 |
| | 6 | 1 | 1 | 0 | 1 |
| | 7 | 1 | 0 | 1 | 1 |
| | ⋮ | ⋮ | ⋮ | ⋮ | ⋮ |
| | 56 | 1 | 0 | 0 | 0 |
| | 57 | 0 | 0 | 1 | 0 |
| | 58 | 1 | 1 | 0 | 1 |
| | 59 | 1 | 0 | 1 | 1 |

FIG. 54

| FRAME COUNT 174 | LINE COUNT 175 | SCANNING FUNCTION DATA 178 | | | |
|---|---|---|---|---|---|
| | | W0 | W1 | W2 | W3 |
| 0 | 0 | 1 | 0 | 0 | 0 |
| | 1 | 0 | 0 | 1 | 0 |
| | 2 | 1 | 0 | 1 | 1 |
| | 3 | 1 | 1 | 1 | 0 |
| | 4 | 0 | 1 | 1 | 1 |
| | 5 | 1 | 1 | 0 | 1 |
| | 6 | 0 | 1 | 0 | 0 |
| | 7 | 0 | 0 | 0 | 1 |
| 1 | 0 | 0 | 1 | 1 | 1 |
| | 1 | 1 | 1 | 0 | 1 |
| | 2 | 0 | 1 | 0 | 0 |
| | 3 | 0 | 0 | 0 | 1 |
| | 4 | 1 | 0 | 0 | 0 |
| | 5 | 0 | 0 | 1 | 0 |
| | 6 | 1 | 0 | 1 | 1 |
| | 7 | 1 | 1 | 1 | 0 |
| 2 | 0 | 0 | 0 | 1 | 0 |
| | 1 | 1 | 0 | 1 | 1 |
| | 2 | 1 | 1 | 1 | 0 |
| | 3 | 1 | 0 | 0 | 0 |
| | 4 | 1 | 1 | 0 | 1 |
| | 5 | 0 | 1 | 0 | 0 |
| | 6 | 0 | 0 | 0 | 1 |
| | 7 | 0 | 1 | 1 | 1 |
| 3 | 0 | 1 | 1 | 0 | 1 |
| | 1 | 0 | 1 | 0 | 0 |
| | 2 | 0 | 0 | 0 | 1 |
| | 3 | 0 | 1 | 1 | 1 |
| | 4 | 0 | 0 | 1 | 0 |
| | 5 | 1 | 0 | 1 | 1 |
| | 6 | 1 | 1 | 1 | 0 |
| | 7 | 1 | 0 | 0 | 0 |

| FRAME COUNT 174 | LINE COUNT 175 | SCANNING FUNCTION DATA 178 | | | |
|---|---|---|---|---|---|
| | | W0 | W1 | W2 | W3 |
| 4 | 0 | 1 | 0 | 1 | 1 |
| | 1 | 1 | 1 | 1 | 0 |
| | 2 | 1 | 0 | 0 | 0 |
| | 3 | 0 | 0 | 1 | 0 |
| | 4 | 0 | 1 | 0 | 0 |
| | 5 | 0 | 0 | 0 | 1 |
| | 6 | 0 | 1 | 1 | 1 |
| | 7 | 1 | 1 | 0 | 1 |
| 5 | 0 | 0 | 1 | 0 | 0 |
| | 1 | 0 | 0 | 0 | 1 |
| | 2 | 0 | 1 | 1 | 1 |
| | 3 | 1 | 1 | 0 | 1 |
| | 4 | 1 | 0 | 1 | 1 |
| | 5 | 1 | 1 | 1 | 0 |
| | 6 | 1 | 0 | 0 | 0 |
| | 7 | 0 | 0 | 1 | 0 |
| 6 | 0 | 1 | 1 | 1 | 0 |
| | 1 | 1 | 0 | 0 | 0 |
| | 2 | 0 | 0 | 1 | 0 |
| | 3 | 1 | 0 | 1 | 1 |
| | 4 | 0 | 0 | 0 | 1 |
| | 5 | 0 | 1 | 1 | 1 |
| | 6 | 1 | 1 | 0 | 1 |
| | 7 | 0 | 1 | 0 | 0 |
| 7 | 0 | 0 | 0 | 0 | 1 |
| | 1 | 0 | 1 | 1 | 1 |
| | 2 | 1 | 1 | 0 | 1 |
| | 3 | 0 | 1 | 0 | 0 |
| | 4 | 1 | 1 | 1 | 0 |
| | 5 | 1 | 0 | 0 | 0 |
| | 6 | 0 | 0 | 1 | 0 |
| | 7 | 1 | 0 | 1 | 1 |

DRIVING CIRCUITS FOR A PASSIVE MATRIX LCD WHICH USES ORTHOGONAL FUNCTIONS TO SELECT DIFFERENT GROUPS OF SCANNING ELECTRODES

BACKGROUND OF THE INVENTION

The present invention relates to a liquid crystal display unit and its driving method, and more particularly to a data electrode driving circuit, a scanning electrode driving circuit, a liquid crystal display unit and a driving method thereof in which a plurality of rows are scanned and driven simultaneously in a passive matrix type liquid crystal display unit.

As a driving system for a passive matrix type liquid crystal display unit, recently, there has been proposed a driving system in which a plurality of row scanning electrodes for a liquid crystal panel are selected simultaneously to thereby reduce a liquid crystal driving voltage and reduce a power consumption of a display system. This technique is disclosed in, for example, JP-A-6-67628.

The principle of this driving system is now described.

In this description, a liquid crystal panel of N rows×M columns is premised on an assumption.

FIG. 1 shows a voltage function for scanning electrodes in which a voltage function applied to N row scanning electrodes is defined to the Walsh function by eight rows and a period T for one frame is defined to 2N (N is the number of rows to be displayed), the Walsh function for the eight rows being divided by 16 to drive the scanning electrodes.

The voltage function applied to the scanning electrodes and a voltage function applied to data electrodes are given by the following expressions (1) and (2), respectively.

$$f(i) = FpB(i, t) \tag{1}$$

$$g(j) = \frac{1}{\sqrt{N}} \sum_{i=1}^{N} P(i, j)f(t) \tag{2}$$

where Fp is a constant described in the following expression (3) and B(i,t) is a function shown in FIG. 1.

$$Fp = \sqrt{\frac{N}{8} \cdot \frac{\sqrt{N}}{2(\sqrt{N} - 1)}} \tag{3}$$

Further, P(i,j) represents a display data which is −1 when a dot in the i-th row and the j-th column is displayed "ON" and which is 1 when it is displayed "OFF". Root mean square (R, M, S) value Urms(i,j) of a dot U(i,j) is calculated as follows by using the expressions (1) and (2).

$$Urms(i, j) = [[I(i) - g(i)]^2]^{1/2} =$$

$$\frac{1}{T}\int_0^T f(i)^2 dt + \frac{1}{T}\int_0^T g(j)^2 dt - \frac{2}{T}\int_0^T r(i)g(j)dt$$

T=2N is defined and each term is calculated.

$$\begin{aligned}
\frac{1}{T}\int_0^T f(i)^2 dt &= \frac{1}{2N}\sum_{i=1}^{2N}\frac{N}{8}\cdot\frac{\sqrt{N}}{2(\sqrt{N}-1)}B(i, t)^2 \\
&= \frac{1}{16}\cdot\frac{\sqrt{N}}{2(\sqrt{N}-1)}\sum_{i=1}^{2N}B(i, t)^2 \\
&= \frac{1}{16}\cdot\frac{\sqrt{N}}{2(\sqrt{N}-1)}(B(i, 1)^2 + B(i, 2)^2 + \\
&\quad \ldots + B(i, 2N))^2
\end{aligned}$$

As understood from FIG. 1, only 16 dots of B(i,j) for the i-th row have a value of ±1 for the Walsh function and the remaining dots have a value of 0.

$$\text{Above Expression} = \frac{1}{16}\cdot\frac{\sqrt{N}}{2(\sqrt{N}-1)}\cdot 16 = \frac{\sqrt{N}}{2(\sqrt{N}-1)}$$

$$\begin{aligned}
\frac{1}{T}\int_0^T g(j)^2 dt &= \frac{1}{2N}\sum_{i=1}^{2N}\frac{1}{N}\left[\sum_{i=1}^{N}P(i, j)\sqrt{\frac{N}{8}\ \frac{\sqrt{N}}{2(\sqrt{N}-1)}}\ B(i, t)\right]^2 \\
&= \frac{1}{2N}\cdot\frac{1}{8}\cdot\frac{\sqrt{N}}{2(\sqrt{N}-1)}\sum_{i=1}^{2N}\left[\sum_{i=1}^{N}P(i, j)B(i, t)\right]^2 \\
&= \frac{1}{2N}\cdot\frac{1}{8}\cdot\frac{\sqrt{N}}{2(\sqrt{N}-1)}\sum_{i=1}^{2N}(P(i, j)^2B(1, t)^2 + P(2, j)^2B(2, t)^2 + \\
&\quad \ldots + P(N, j)^2B(N, t)^2)
\end{aligned}$$

As understood from FIG. 1, only 8 lines of B(i,j) at a certain time t in the B(i,t) of the i-th row have a value of ±1 for the Walsh function and the remaining lines have a value of 0.

$$\begin{aligned}
\text{Above Expression} &= \frac{1}{2N}\cdot\frac{1}{8}\cdot\frac{\sqrt{N}}{2(\sqrt{N}-1)}\sum_{i=1}^{2N} 8-t \\
&= \frac{1}{2N}\cdot\frac{1}{8}\cdot\frac{\sqrt{N}}{2(\sqrt{N}-1)}\cdot 8\cdot \\
&\quad 2N = \frac{\sqrt{N}}{2(\sqrt{N}-1)} \\
\frac{2}{T}\int_0^T f(i)g(j)dt &= \frac{2}{2N}\sum_{i=1}^{2N} FpB(i,t)\frac{1}{\sqrt{N}}\sum_{i=1}^{N} P(i,j)FpB(i,t) \\
&= \frac{2}{2N}\cdot\frac{1}{\sqrt{N}}\cdot\frac{N}{8}\cdot \\
&\quad \frac{N}{2(\sqrt{N}-1)}\sum_{i=1}^{2N} B(i,t)\sum_{i=1}^{N} P(i,j)B(i,t) \\
&= \frac{1}{8}\cdot\frac{N}{2(\sqrt{N}-1)}\sum_{i=1}^{2N} B(i,t)\{P(1,j)B(1,t)+ \\
&\quad P(2,j)B(2,t)+\ldots+P(N,j)B(N,t)\} \\
&= \frac{1}{8}\cdot\frac{1}{2(\sqrt{N}-1)}\sum_{i=1}^{2N} P(i,j)B(i,t)^2
\end{aligned}$$

As understood from FIG. 1, only 16 dots of B(i,t) have a value of ±1 for the Walsh function and the remaining dots have a value of 0.

$$\begin{aligned}
\text{Above Expression} &= \frac{1}{8}\cdot\frac{N}{2(\sqrt{N}-1)}\cdot 16P(i,j) \\
&= \frac{2P(i,j)}{2(\sqrt{N}-1)}
\end{aligned}$$

From the above, $$\begin{aligned}
Urms(i,j) &= \left[\frac{\sqrt{N}}{2(\sqrt{N}-1)}+\frac{\sqrt{N}}{2(\sqrt{N}-1)}+\frac{2P(i,j)}{2(\sqrt{N}-1)}\right]^{1/2} \\
&= \left[\frac{2\sqrt{N}}{2(\sqrt{N}-1)}-\frac{2P(i,j)}{2(\sqrt{N}-1)}\right]^{1/2}
\end{aligned}$$

Thus, the R.M.S voltage value of U(i,j) is expressed by the expression (4) and when U(i,j) is displayed "ON", P(i,j) is −1. Accordingly, its R.M.S. voltage value is expressed by the expression (5) and when it is displayed "OFF", P(i,j) is 1. Accordingly, the R.M.S. voltage value is expressed by the expression (6).

$$Urms(i,j) = \left[\frac{2\sqrt{N}}{2(\sqrt{N}-1)}-\frac{2P(i,j)}{2(\sqrt{N}-1)}\right]^{1/2} \tag{4}$$

$$\begin{aligned}
Urms(i,j) &= \left[\frac{2\sqrt{N}}{2(\sqrt{N}-1)}-\frac{-2}{2(\sqrt{N}-1)}\right]^{1/2} \\
&= \sqrt{\frac{\sqrt{N}+1}{\sqrt{N}-1}}
\end{aligned} \tag{5}$$

$$\begin{aligned}
Urms(i,j) &= \left[\frac{2\sqrt{N}}{2(\sqrt{N}-1)}-\frac{2}{2(\sqrt{N}-1)}\right]^{1/2} \\
&= 1
\end{aligned} \tag{6}$$

When a ratio of the expressions (5) and (6) is calculated, the following expression (7) is obtained and this value is equal to a value of an operation margin indicative of an operation characteristic of a liquid crystal cell.

$$\text{Expression (5)/Expression (6)} = \sqrt{\frac{\sqrt{N}+1}{\sqrt{N}-1}} \tag{7}$$

As described above, even when the voltage function applied to the scanning electrodes is set as shown in FIG. 1, the liquid crystal panel can perform display.

In the foregoing description, the voltage function for 8 rows of N rows is the Walsh function and the Walsh function for 8 rows is divided by 16 to drive the scanning electrodes. However, the number of rows for the Walsh function and the number of division are not limited to the above values. Generally, the voltage function for R rows of N rows may be the Walsh function and the Walsh function may be divided by K to drive the scanning electrodes. At this time, a relation of R<N and K≧R is to be established.

Generalized functions of f(i) and g(j) are given by the following expressions (8) and (9) and the constant Fp in this case is also given by the following expression (10).

$$f(i) = FpB(i,t) \tag{8}$$

$$g(j) = \frac{1}{\sqrt{N}}\sum_{i=1}^{N} P(i,j)f(i) \tag{9}$$

$$Fp = \sqrt{\frac{N}{R}\cdot\frac{\sqrt{N}}{2(\sqrt{N}-1)}} \tag{10}$$

Further, the R.M.S. voltage value Urms(i,j) for U(i,j) is calculated as follows:

$$Urms(i,j) = [(f(i)-g(i))^2]^{1/2}$$

$$\frac{1}{T}\int_0^T f(i)^2dt+\frac{1}{T}\int_0^T g((j)^2dt-\frac{2}{T}\int_0^T f(i)g(j)dt$$

When T=N·K/R is defined, $$\frac{1}{T}\int_0^T f(i)^2dt = \frac{1}{T}\sum_{i=1}^{T}\frac{N}{R}\cdot\frac{\sqrt{N}}{2(\sqrt{N}-1)}B(i,j)^2$$

Only K dots of B(i,j) for the i-th row have a value of ±1 for the Walsh function and the remaining dots have a value of 0.

$$\text{Above Expresssion} = \frac{1}{T}\cdot\frac{N}{R}\cdot\frac{\sqrt{N}}{2(\sqrt{N}-1)}\cdot K = \frac{1}{T}\cdot T\cdot\frac{\sqrt{N}}{2(\sqrt{N}-1)}$$

$$= \frac{\sqrt{N}}{2(\sqrt{N}-1)}$$

$$\frac{1}{T}\int_0^T g(j)^2 dt = \frac{1}{T}\sum_{i=1}^{T}\left[\frac{1}{\sqrt{N}}\sum_{i=1}^{N} P(i,j)\cdot FpB(i,t)\right]^2$$

$$= \frac{1}{R}\cdot\frac{1}{R}\cdot\frac{\sqrt{N}}{2(\sqrt{N}-1)}\sum_{i=1}^{T}\left[\sum_{i=1}^{N} P(i,j)\cdot B(i,t)\right]^2$$

$$= \frac{1}{R}\cdot\frac{1}{R}\cdot\frac{\sqrt{N}}{2(\sqrt{N}-1)}\sum_{i=1}^{T} P(i,j)^2B(i,t)^2 + P(2,j)^2B(2,t)^2 \ldots + P(N,j)^2B(N,t)^2)$$

Only R dots of B(i,j) at a certain time t have a value of ±1 for the Walsh function and the remaining dots have a value of 0. Accordingly, $$\text{Above Expression} = \frac{1}{T}\cdot\frac{1}{R}\cdot\frac{\sqrt{N}}{2(\sqrt{N}-1)}\sum_{t=1}^{T} Rt = \frac{\sqrt{N}}{2(\sqrt{N}-1)}$$

$$\frac{2}{T}\int_0^T f(i)g(j)dt = \frac{2}{T}\sum_{t=1}^{T} FpB(i,t)\cdot\frac{1}{N}\sum_{t=1}^{N} P(i,j)FpB(i,j)$$

$$= \frac{2}{T}\cdot\frac{1}{\sqrt{N}}\cdot\frac{N}{R}\cdot\frac{\sqrt{N}}{2(\sqrt{N}-1)}\sum_{t=1}^{T} B(i,t)\sum_{i=1}^{N} P(i,j)\cdot B(i,t)$$

$$= \frac{2}{T}\cdot\frac{1}{\sqrt{N}}\cdot\frac{N}{R}\cdot\frac{\sqrt{N}}{2(\sqrt{N}-1)}\sum_{t=1}^{T} P(i,j)\cdot B(i,t)^2$$

Only K dots of B(i,t) for the i-th row have a value of ±1 for the Walsh function and the remaining dots have a value of 0. Accordingly, $$\text{Above Expression}\ \frac{2}{T}\cdot$$

$$\frac{1}{\sqrt{N}}\cdot\frac{N}{R}\cdot\frac{\sqrt{N}}{2(\sqrt{N}-1)}P(i,j)\cdot K = \frac{2P(i,j)}{2(\sqrt{N}-1)}$$

From the above, $$U\text{rms}(i,j) = \left[\frac{2\sqrt{N}}{2(\sqrt{N}-1)} - \frac{2P(i,j)}{2(\sqrt{N}-1)}\right]^{1/2}$$

This expression is coincident with the expression (4).

The Walsh function is used in the above description, while it is not limited to the Walsh function. As understood from the course of the calculation for the R.M.S. value, an orthogonal function having values of 1 and −1 may be used. This driving method is hereinafter referred to as a "partial orthogonal function driving method".

In the above-mentioned prior art, when the number of rows for the liquid crystal panel is N and the number of divided rows to be driven is R, a line memory for writing and reading having a memory capacity corresponding to m rows is required. Further, since a writing circuit, a reading circuit, an operation circuit, a voltage conversion circuit and the like for driving the line memory is required, the number of components and the power consumption are increased as compared with a voltage averaging method which is a general driving system for the passive matrix type liquid crystal display. Accordingly, it is difficult to apply the passive matrix type liquid crystal display unit featured by low power consumption and low cost.

Furthermore, a data electrode driving circuit is supplied with an analog display data and applies an analog voltage corresponding to the data to data electrodes. Accordingly, there is a problem that when the analog display data contains an error, the error appears as a display error, that is, unevenness of display as it is. In order to solve this problem, there is another problem that high accuracy is required in the voltage conversion means for producing the analog display data.

In addition, when the conventional partial orthogonal function driving is made, horizontal stripes are sometimes displayed on the liquid crystal display for each selected scanning electrode.

As another subject, there is the need for a liquid crystal panel driving system capable of treating a liquid crystal display having the higher-speed responsive characteristic. A liquid crystal display unit capable of being graded up in accordance with development of the technique and having reduced components in number and a lower cost is desired.

SUMMARY OF THE INVENTION

It is a primary object of the present invention to provide a liquid crystal display unit, a driving system, a data electrode driving circuit and a scanning electrode driving circuit thereof in which the partial orthogonal function driving is performed with the same number of components as that of a voltage averaging method which is a general driving system of a passive matrix type liquid crystal display.

It is another object of the present invention to provide a liquid crystal display unit, a driving system, a data electrode driving circuit and a scanning electrode driving circuit thereof capable of performing the partial orthogonal function driving while suppressing the power consumption.

It is still another object of the present invention to provide a liquid crystal display unit, a driving system, a data electrode driving circuit and a scanning electrode driving circuit thereof capable of performing the partial orthogonal function driving with higher display quality.

It is a still further object of the present invention to provide a liquid crystal display unit, a driving system, a data electrode driving circuit and a scanning electrode driving circuit capable of attaining a lower cost.

The liquid crystal display unit according to the present invention includes a scanning function generating circuit provided in a scanning electrode driving circuit for generating scanning function for m rows for driving scanning electrodes in a divided manner and selects a scanning voltage in accordance with the scanning function to supply a driving voltage to the scanning electrodes. On the other hand, a data electrode driving circuit includes shift registers for m rows for driving data electrodes in the divided manner. Display data for m rows taken in the shift registers are produced at the same time. Comparison operation of the display data for m rows and the scanning function supplied from the scanning electrode driving circuit is performed to select one level voltage of m+1 level voltages in accordance with the operation result and supply the selected level voltage to the data electrodes.

The configuration of the present invention is now described in detail for each aspect.

The liquid crystal display unit according to a first aspect of the present invention comprises a liquid crystal panel including M (M is a natural number) data electrodes and N (N is a natural number) scanning electrodes for performing display in accordance with an R.M.S. value of a difference of voltages applied to intersecting points of both of the electrodes, a scanning electrode driving circuit for supplying a selection voltage or a non-selection voltage to each of the scanning electrodes, and a data electrode driving circuit for supplying a display voltage corresponding to display data inputted separately to the data electrodes, the scanning electrode driving circuit comprising an orthogonal function generating circuit for generating m orthogonal functions, and a scanning circuit for successively selecting m (m is a natural number equal to or smaller than N) continuous scanning electrodes of the scanning electrodes and applying the selection voltage to the selected m scanning electrodes in accordance with the m orthogonal functions generated by the orthogonal function generating circuit and the non-selection voltage to N-m scanning electrodes not selected at this time, the scanning circuit changing p (p is a natural number equal to or smaller than m) scanning electrodes of m scanning electrodes selected at this time to scanning electrodes not selected at this time and continuing to the m scanning electrodes selected at this time upon next selection of the scanning electrodes, the data electrode driving circuit comprising a shift register for storing the separately inputted display data by p rows, an m-stage latch circuit for reading the display data stored in the shift register and holding the read display data during a predetermined selected period, a correlator for performing a predetermined operation by using the display data of m rows held in the latch circuit and the m orthogonal functions, and an output circuit for selecting any one of predetermined m+1 level voltages in accordance with an operation result of the correlator and supplying the selected level voltage to the data electrodes as the display voltage.

In this case, p may be 1.

Further, m may be 4. Furthermore, m may be 4 and p may be 4. In this case, the orthogonal function is a binary function and satisfies the following conditions (1), (2) and (3). (1) A ratio of periods constituting each value scanning function data for m=4 rows is 3 to 1 or 1 to 3 during the selected period. (2) A ratio of numbers constituting each value of scanning function data for four rows is 3 to 1 or 1 to 3 every a half of the selected period and is reversed every a half of the selected period. (3) Contents of the orthogonal function are changed every one selected period while the contents thereof are changed every a plurality of selected periods and have periodicity over the plurality of selected periods.

The correlator performs the operation defined by the following expression (11):

$$Sj = \frac{\sum_{i=j}^{N} Iij \cdot Wi + m}{2} \tag{11}$$

where

Iij is display data of an i-th row and a j-th column stored in the shift register (it is a value of −1 when it is displayed "ON" and +1 when it is displayed "OFF");

wi is an orthogonal function taking an i-th value of +1 and −1; and

Sj is an operation result of the j-th column;

The output circuit selects one level of the predetermined m+1 level voltages in accordance with the operation result Sj of the correlator (138) to supply the selected level voltage to the j-th column data electrode. The data electrode driving circuit preferably includes the correlators (138) and the output circuits (140) each provided by M rows in number. In this case, the latch circuit preferably reads display data from the shift register by one row together.

A liquid crystal display unit preferably includes a liquid crystal controller for converting frequencies of the separately inputted display data and a liquid crystal driving signal and supplying the display data and the liquid crystal driving signal having the converted frequencies to the scanning electrode driving circuit and/or the data electrode driving circuit. In this case, the liquid crystal controller preferably converts the frequencies of the display data and the liquid crystal driving signal to frequencies exceeding 150 Hz in a frame frequency particularly if the liquid crystal panel is of a high-speed responsive type.

The data electrode driving circuit preferably includes output transistors having a resistible voltage equal to 5 volts.

There are provided a plurality of the scanning electrode driving circuits. Each of the scanning electrode driving circuits includes the orthogonal function generating circuit (160) and the scanning circuit. A predetermined scanning electrode driving circuit (hereinafter referred to as a "master scanning electrode driving circuit") of the plurality of scanning electrode driving circuits causes the scanning circuit to operate in accordance with the orthogonal function generated by the orthogonal function generating circuit provided in the scanning electrode driving circuit itself and supplies the orthogonal function to other scanning electrode driving circuits (hereinafter referred to as a "slave scanning electrode driving circuit"). The scanning circuit of the slave scanning electrode driving circuit is preferably operated in accordance with the orthogonal function produced by the master scanning electrode driving circuit.

The data electrode driving circuit and the scanning electrode driving circuit are preferably formed into one chip LSI, respectively.

The liquid crystal display unit according to a second aspect of the present invention comprises a liquid crystal panel including M (M is a natural number) data electrodes and N (N is a natural number) scanning electrodes for performing display in accordance with an R.M.S. value of a difference of voltages applied to intersecting points of both of the electrodes, a scanning electrode driving circuit for supplying a selection voltage or a non-selection voltage to each of the scanning electrodes, a data electrode driving circuit for supplying a display voltage corresponding to display data inputted separately to the data electrodes, and an orthogonal function generating circuit provided separately from the scanning electrode driving circuit for generating m (m is a natural number equal to or smaller than N) orthogonal functions, the scanning electrode driving circuit comprising a scanning circuit for successively selecting m continuous scanning electrodes of the scanning electrodes and applying the selection voltage to the selected m scanning electrodes in accordance with the m orthogonal functions generated by the orthogonal function generating circuit and the non-selection voltage to N-m scanning electrodes not selected at this time, the data electrode driving circuit comprising a shift register for storing the separately inputted display data by m rows, a latch circuit for reading the display data stored in the shift register and holding the read display data during a predetermined selected period, a correlator for performing a predetermined operation by using the display data of m rows held in the latch circuit and the m orthogonal functions, and an output circuit for selecting any one of predetermined m+1 level voltages in accordance with an operation result of the correlator and supplying the selected level voltage to the data electrodes as the display voltage.

The liquid crystal display unit according to a third aspect of the present invention comprises a matrix liquid crystal panel including M (M is a natural number) column data electrodes and N (N is a natural number) row scanning electrodes, a data electrode driving circuit for supplying a data voltage determined in accordance with a separately inputted display data to the data electrodes, a scanning electrode driving circuit for selecting m (m is a natural number equal to or smaller than N) row scanning electrodes at a time and supplying a separately determined scanning voltage to the selected scanning electrodes, and a power supply circuit for receiving a single DC voltage as an input to produce a plurality of DC level voltages and supplying the plurality of voltages to the data electrode driving circuit and the scanning electrode driving circuit, the power supply circuit supplying three DC level voltages of +Vsel, 0 and −Vsel to the scanning electrode driving circuit and supplying m+1 DC level voltages of Vx0, Vx1, . . . , Vxm to the data electrode driving circuit.

The voltage of Vsel in the power supply circuit is preferably given by the following expression (12):

$$Vsel = \sqrt{\frac{N}{m}} \sqrt{\frac{\sqrt{N}}{2(\sqrt{N}-1)}}\, Vth \tag{12}$$

where Vth is a threshold voltage of the liquid crystal panel.

The voltage of Vxk (k is an integer equal to 0 or m or larger than 0 and smaller than m) is given by the following expression (13):

$$V \times k = \frac{1}{\sqrt{N}} \sqrt{\frac{\sqrt{N}}{2(\sqrt{N}-1)}}\, (2k-m)Vth \tag{13}$$

where Vth is a threshold voltage of the liquid crystal display panel.

According to a fourth aspect of the present invention, a driving method of a passive matrix type liquid crystal panel including scanning electrodes and data electrodes, comprises selecting four rows of the scanning electrodes at a time and applying a voltage determined in accordance with an orthogonal function to the selected four scanning electrodes.

The orthogonal function is a binary function and preferably satisfies the following conditions (1), (2) and (3). (1) A ratio of periods constituting each value of scanning function data for m=4 rows is 3 to 1 or 1 to 3 during the selected period. (2) A ratio of numbers constituting each value of scanning function data for four rows is 3 to 1 or 1 to 3 every a half of the selected period and is reversed every a half of the selected period. (3) Contents of the orthogonal function are changed every one selected period while the contents thereof are changed every a plurality of selected periods and have periodicity over the plurality of selected periods.

According to a fifth aspect of the present invention, the liquid crystal display unit comprises a liquid crystal panel including data electrodes and scanning electrodes for performing display in accordance with an effective value of a difference of voltages applied to intersecting points of the data electrodes and the scanning electrodes, a scanning electrode driving circuit for supplying a selection voltage to a scanning electrode corresponding to a pixel to be supplied with display data at this time and a non-selection voltage to other scanning electrodes, and a data electrode driving circuit for supplying a display voltage corresponding to separately inputted display data to the data electrode, the scanning electrode driving circuit producing 0 volt as the non-selection voltage.

According to a sixth aspect of the present invention, there is provided a scanning electrode driving circuit for applying a selection voltage or a non-selection voltage to each of scanning electrodes of a liquid crystal panel in accordance with a horizontal synchronous signal and a vertical synchronous signal inputted externally, an output bus including a plurality of output terminals, an orthogonal function generating circuit for generating m orthogonal functions, and a scanning circuit for successively selecting m (m is a natural number equal to or smaller than N) continuous output terminals of the output terminals to produce the selection voltage from the selected m output terminals in accordance with the m orthogonal functions generated by the orthogonal function generating circuit and produce the non-selection voltage from N-m output terminals not selected at this time, the scanning circuit changing p (p is a natural number equal to smaller than m) output terminals of the m output terminals selected at this time to p next output terminals not selected at this time upon next selection of the output terminals.

The scanning circuit is further constituted to be able to be inputted with an orthogonal function and a selection signal externally and selects any one of the externally inputted orthogonal function and an orthogonal function generated by an orthogonal function generating circuit included in the scanning circuit itself in accordance with the selection signal to be operated by using the selected orthogonal function.

According to a seventh aspect of the present invention, there is provided a data electrode driving circuit for driving data electrodes of a liquid crystal panel on the basis of a horizontal synchronous signal, a dot clock and display data inputted externally, comprising a shift register for storing the externally inputted display data by p (p is a natural number) rows, an m-stage latch circuit for reading the display data stored in the shift register and holding the reading display data during a predetermined selected period, a correlator for performing a predetermined operation by using the display data of m (m is a natural number equal to or larger than p) rows held in the latch circuit and m orthogonal functions, and an output circuit for selecting any one of predetermined m+1 level voltages in accordance with an operation result of the correlator to supply the selected level voltage to the data electrodes as a display voltage.

The correlator performs the operation defined by the following expression (11):

$$Sj = \frac{\sum_{i=l}^{N} Iij \cdot Wi + m}{2} \tag{11}$$

where

Iij is display data of an i-th row and a j-th column stored in the shift register (it is a value of −1 when it is displayed "ON" and +1 when it is displayed "OFF"), wi is an orthogonal function (114) taking an i-th value of +1 and −1, and Sj is an operation result of the j-th column.

The output circuit selects one level of the predetermined m+1 level voltages in accordance with the operation result Sj of the correlator to supply the selected level voltage to the j-th column data electrode. Each of the correlators and the output circuits is provided by M rows in number.

The latch circuit preferably reads the display data from the shift register by one row together.

The data electrode driving circuit supplies the display voltage corresponding to the separately inputted display data to the data electrodes. The process of the inside of the data electrode driving circuit in this case is performed as follows:

The shift register stores the separately inputted display data by p rows. The m-stage latch circuit reads the display data stored in the shift register and holds the read display data during the predetermined selected period. The correlator performs the predetermined operation by using the display data of m rows held in the latch circuit and the m orthogonal functions. The contents of the operation are to be defined by the expression (11), for example. The output circuit selects any one of the predetermined m+1 level voltages in accordance with the operation result of the correlator (Sj when the contents of the operation are defined by the expression (11)). The selected level voltage is supplied to the j-th row data electrode as the display voltage.

The correlator and the output circuit are provided and the latch circuit reads the display data from the shift register by one row together, so that the processing can be made at a very high speed. Accordingly, the frequency of the separately inputted display data and the liquid crystal driving signal is merely converted by the liquid crystal controller (for example, the converted frame frequency preferably exceeds 150 Hz) to be able to treat the high-speed responsive type liquid crystal panel.

On the other hand, the scanning electrode driving circuit supplies the selection voltage or the non-voltage to each of the scanning electrodes. The process of the inside of the scanning electrode driving circuit in this case is performed as follows:

The orthogonal function generating circuit of the scanning electrode driving circuit generates m orthogonal functions. The scanning circuit selects m electrodes of the scanning electrodes successively. The selected m scanning electrodes are applied with the selection voltage in accordance with m orthogonal functions generated by the orthogonal function generating circuit. On the other hand, N-m scanning electrodes not selected at this time are applied with the non-selection voltage. The scanning circuit performs the scanning operation by changing p scanning electrodes of the m scanning electrodes selected at this time to scanning electrodes not selected at this time and continuing to the p scanning electrodes upon next selection.

Definite values of the above m and p and its combination are 4 and 1 or 4 (m=4, p=1 or 4), respectively.

When there are provided a plurality of the scanning electrode driving circuits, one of them is set as a master scanning electrode driving circuit and the master scanning electrode driving circuit causes the scanning circuit to be operated in accordance with the orthogonal function generated by the orthogonal function generating circuit provided in the master scanning electrode driving circuit itself and supplies the orthogonal function to other slave scanning electrode driving circuits. The scanning circuits of the slave scanning electrode driving circuits are operated in accordance with the orthogonal function generated by the master scanning electrode driving circuit. With such a configuration, the scanning circuit is further configured to be able to be inputted with the orthogonal function and the selection signal externally. The scanning circuit selects any one of the externally inputted orthogonal function and the orthogonal function generated by the orthogonal function generated circuit provided in itself in accordance with the selection signal and is operated by using the selected orthogonal function. In this manner, the liquid crystal panel with high resolution can be driven by using the scanning electrode driving circuit having reduced terminals.

When each of the data electrode driving circuit and the scanning electrode driving circuit is integrated into one chip LSI, the number of components is reduced. Further, adoption of the shift register which reads the display data and produces the display data by one row together (or in order of the direction of row) in addition of the integration to the LSI can attain the high-speed processing. The provision of the correlators equal to the data electrodes in number is not considered without the integration of the data electrode driving circuit to the LSI if the liquid crystal display unit is commercialized.

When the orthogonal function generating circuit is configured separately from the scanning electrode driving circuit, only the orthogonal function generating circuit can be replaced. Accordingly, the orthogonal function can be changed easily upon grading up of the liquid crystal display unit.

Other aspects are now described.

The power supply circuit receives a single DC voltage as an input voltage and generates a plurality of DC level voltages to supply the voltages to the data electrode driving circuit and the scanning electrode driving circuit. The power supply circuit supplies three DC level voltages of +Vsel, 0 and −Vsel to the scanning electrode driving circuit. The voltage of Vsel is defined by the above expression (12), for example.

Further, by setting the non-selection voltage to 0 volt, the circuit can be simplified.

The data electrode driving means is supplied with m+1 DC level voltages of Vx0, Vx1, . . . , Vxm. The voltage Vxk (k is an integer equal to 0 or m or larger than 0 and smaller than m) is defined by the above expression (13), for example.

BRIEF DESCRIPTION OF THE DRAWINGS

Preferred embodiments of the present invention will now be described in conjunction with the accompanying drawings, in which:

FIG. 9 shows an example of scanning function data generated by the scanning function generating circuit 160;

FIG. 17 is a diagram showing a logic of a decoder 155 in the correlator 138;

FIG. 20 shows an example of scanning function data generated by the scanning function generating circuit 160;

FIG. 21 shows an example of scanning function data generated by the scanning function generating circuit 160;

FIG. 22 shows an example of scanning function data generated by the scanning function generating circuit 160;

FIG. 26 shows an example of scanning function data generated by the scanning function generating circuit 160;

FIG. 46 shows an example of scanning function data generated by the scanning function generating circuit 260;

FIG. 54 shows scanning function data in case where the display quality in the embodiment 1 is considered.

DESCRIPTION OF THE PREFERRED EMBODIMENTS

A first embodiment of the present invention is now described with reference to FIGS. 2 to 27.

In the basic configuration of the embodiment, a plurality of row scanning electrodes of a liquid crystal panel are selected simultaneously to thereby reduce a liquid crystal driving voltage so that the power consumption of a display system is reduced. This basic concept is simply described with reference to FIGS. 3 and 4.

Figure 3:
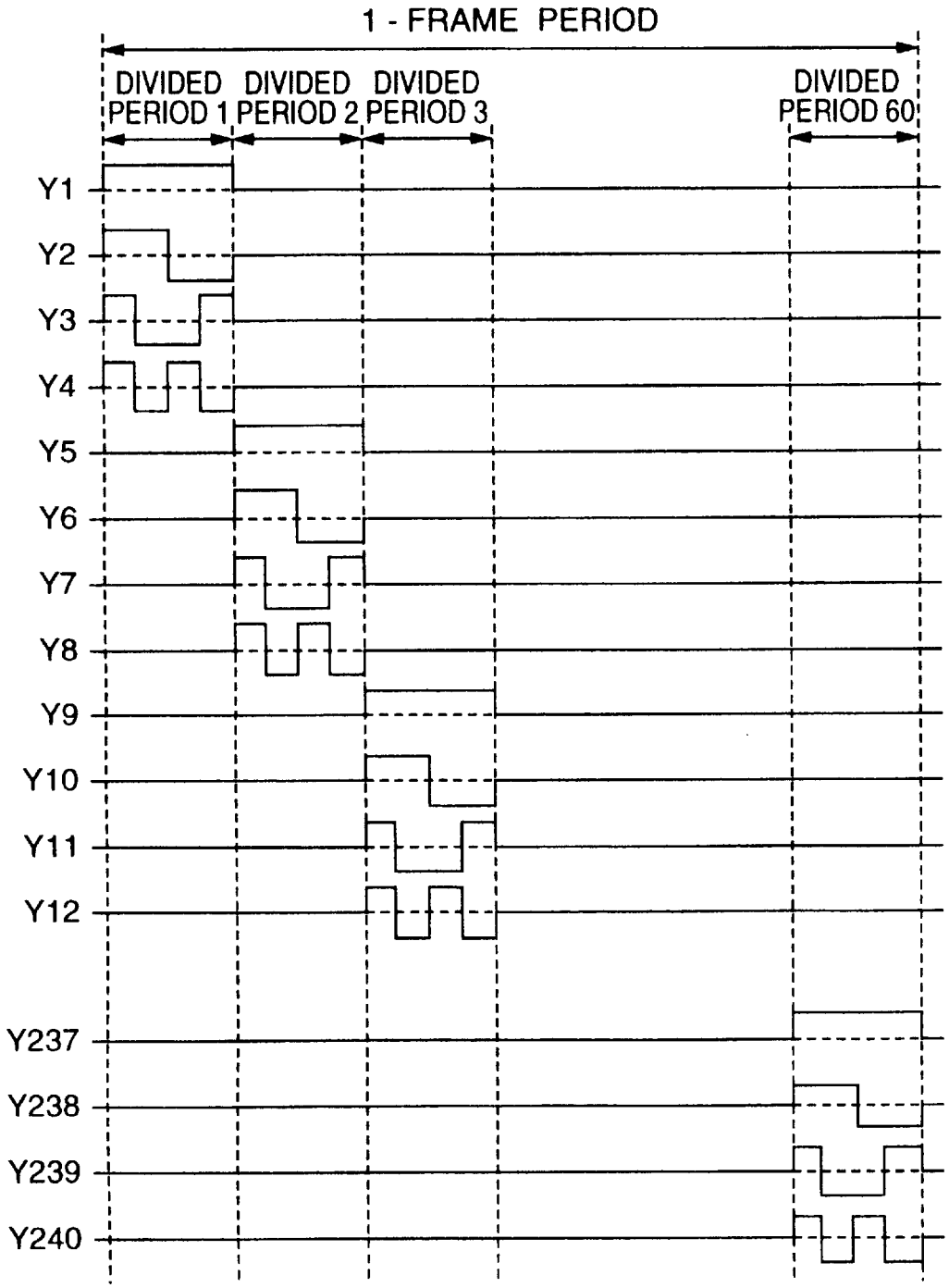
FIG. 3 shows an example of waveforms of scanning signals for selecting a plurality of scanning electrodes of a passive matrix type liquid crystal panel simultaneously.

FIG. 3 shows an example of signal waveforms at the scanning electrodes in case where the plurality of row scanning electrodes of the passive matrix type liquid crystal panel are selected simultaneously. In FIG. 3, the liquid crystal panel includes 240 scanning electrodes designated by Y1 to Y240. In the first embodiment, four row scanning electrodes are driven simultaneously. Accordingly, the liquid crystal panel having 240 scanning electrodes is scanned by four row scanning electrodes 60 times as a whole to thereby apply a scanning signal to all of the scanning electrodes. A period for simultaneously selecting the plurality of (in this embodiment four) scanning electrodes is named a "divided period". The scanning electrodes Y1 to Y4 are selected to be driven in a first divided period 1, the scanning electrodes Y5 to Y8 in a divided period 2, and the scanning electrodes Y9 to Y12 in a divided period 3. Similarly, the scanning electrodes are successively selected to be driven four by four and the scanning electrodes Y237 to Y240 are selected to be driven in a last divided period 60. Further, a "selected period" described in the claims corresponds to the divided period used in the first embodiment.

Figure 1:
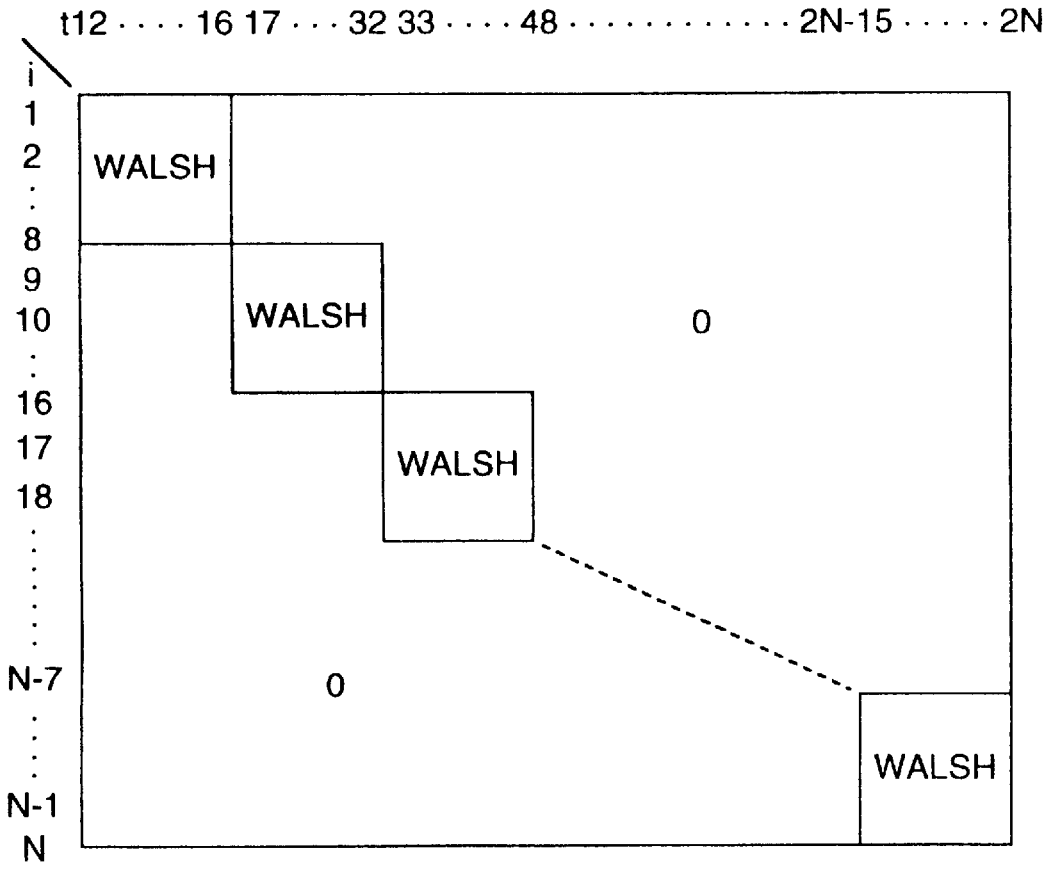
FIG. 1 PRIOR ART
FIG. 1 is a diagram illustrating a voltage function in a method of selecting a plurality of electrodes simultaneously in a prior art.
Figure 4:
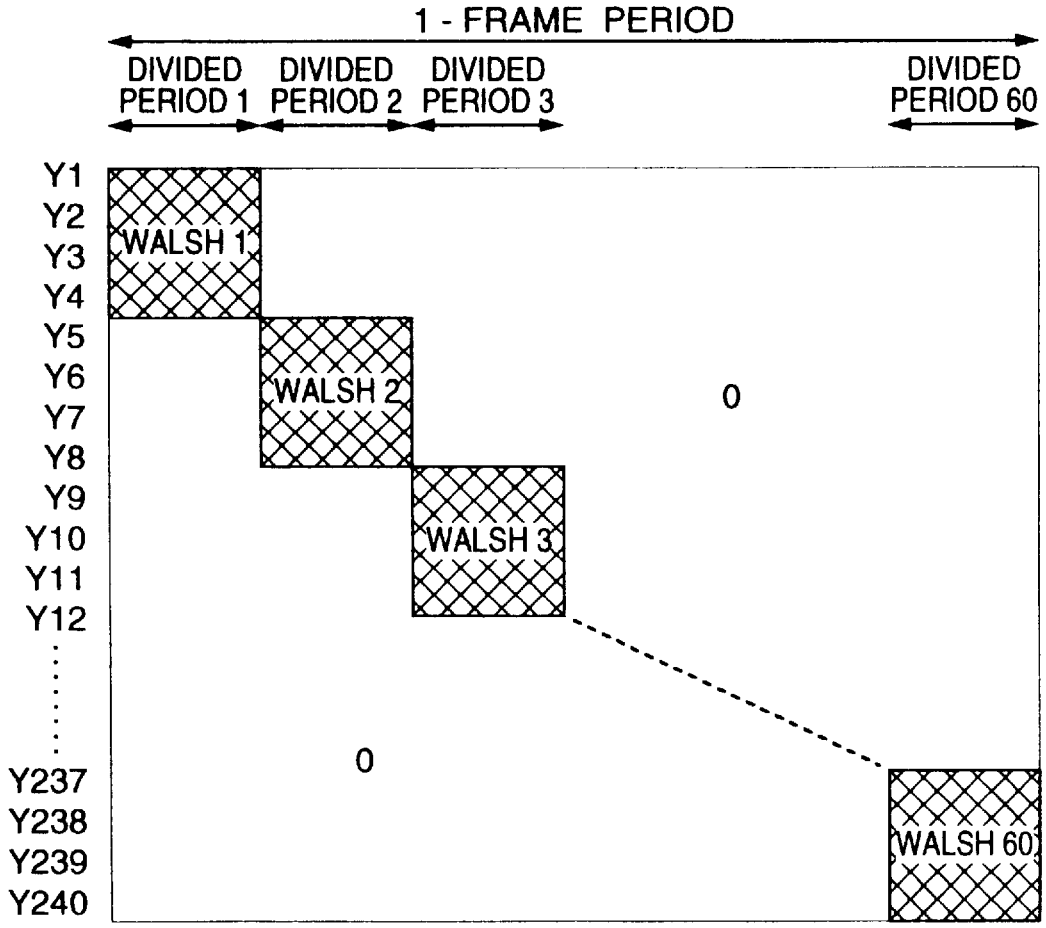
FIG. 4 is a diagram schematically illustrating the waveforms of FIG. 3.

FIG. 4 is a diagram schematically illustrating the waveforms of FIG. 3 and is described based on the same idea as that of FIG. 1 described in the prior art. In FIG. 3, the scanning electrodes selected in each divided period are applied with a voltage +Vsel or −Vsel and other unselected scanning electrodes are applied with 0 [V]. The voltage Vsel is obtained from the expression (10) and is defined by the following expression (12):

$$Vsel = \sqrt{\frac{N}{m}} \sqrt{\frac{\sqrt{N}}{2(\sqrt{N}-1)}}\ Vth \tag{12}$$

where N is the number of scanning electrodes, m is the number of scanning electrodes to be simultaneously selected and Vth is a threshold voltage of a liquid crystal. Generally, a scanning voltage for the i-th row is given by the following expression (14):

$$Fi(t) = Vsel \cdot Wi \tag{14}$$

where wi is a function having a value of +1 or −1 during a selected period and 0 during an unselected period. The function uses an orthogonal function during the selected period. There is a Walsh function as an example of the orthogonal function. Accordingly, the value of the expression (14) is equal to a value obtained by multiplying +1, 0 or −1 by a value of the expression (12). For such a scanning voltage, a data electrode driving voltage Gj(t) for the j-th column is given by the following expression (15):

$$Gj(t) = \frac{1}{\sqrt{N}} \sum_{i=1}^{N} Iij \cdot Fi(j) \tag{15}$$

where Iij is a display data of a display pixel in the i-th row and j-th column having −1 when the pixel is displayed "ON" and +1 when it is displayed "OFF". The expression (15) is transformed into the expression (16) by using the expressions (12) and (14).

$$Gj(t) = \frac{1}{\sqrt{N}} \cdot \sqrt{\frac{\sqrt{N}}{2(\sqrt{N}-1)}}\ (2D-m)Vth \tag{16}$$

where D is a coincident number equal to a count obtained by counting a coincidence in the i-th row (i=1 to N) for a value +1 and −1 of the display data Iij and a value +1 and −1 for the function Wi. When Iij=−1 and Wi=−1 or Iij=+1 and Wi=+1 in the i-th row, it is defined that there is a coincidence and when a combination of Iij and Wi is other than the above combinations, it is defined that there is no coincidence. The coincident number D thus defined is an integer in the range of 0 to m. The expression (16) is substantially identical with the expression (13) described in the claims.

By driving the liquid crystal panel in accordance with the expressions (14) and (16), effective value Vrms(on) and Vrms(off) applied with the display pixel in the i-th row and j-th column are expressed by the following expressions (17) and (18). These values are the same as those in the case of the hitherto-known voltage averaging driving method.

$$Vrms(on) = \sqrt{\frac{\sqrt{N}+1}{\sqrt{N}-1}}\ Vth \tag{17}$$

$$Vrms(off) = Vth \tag{18}$$

When the foregoing description is summarized, the scanning voltage is given by the expression (14) and the data voltage is given by the expression (16) in the method of the present invention in which a plurality of electrodes are simultaneously selected. Further, when the maximum permissible voltage or resistible voltage required for a driving circuit LSI for driving the liquid crystal panel is calculated from the expressions (14) and (16), a driving LSI on the scanning side requires 28.3 Vp-p and a driving LSI on the data side requires 7.3 Vp-p for N=240, m=4 and Vth=2.5v. When the liquid crystal panel having N=240 and Vth=2.5v is driven in the conventional voltage averaging driving method, both of the driving LSI's on the scanning side and the data side require the resistible voltage exceeding 30 volts. Accordingly, in the method of the present invention, the resistible voltage required for the driving LSI on the data side is reduced to a quarter of that required in the conventional method and the resistible voltage required for the driving LSI on the scanning side is also reduced sightly. In other words, the power consumption of the liquid crystal display unit can be reduced.

The liquid crystal display unit to which the method of simultaneously selecting a plurality of electrodes on the basis of the basic concept as described above is applied is now described with reference to FIGS. 2 and 5 to 27. In the liquid crystal display unit described below as the first embodiment, m and p described in the claims are both 4 by way of example. Another example for m=4 and p=1 will be described in a second embodiment.

An outline of the liquid crystal display unit is first described.

Figure 2:
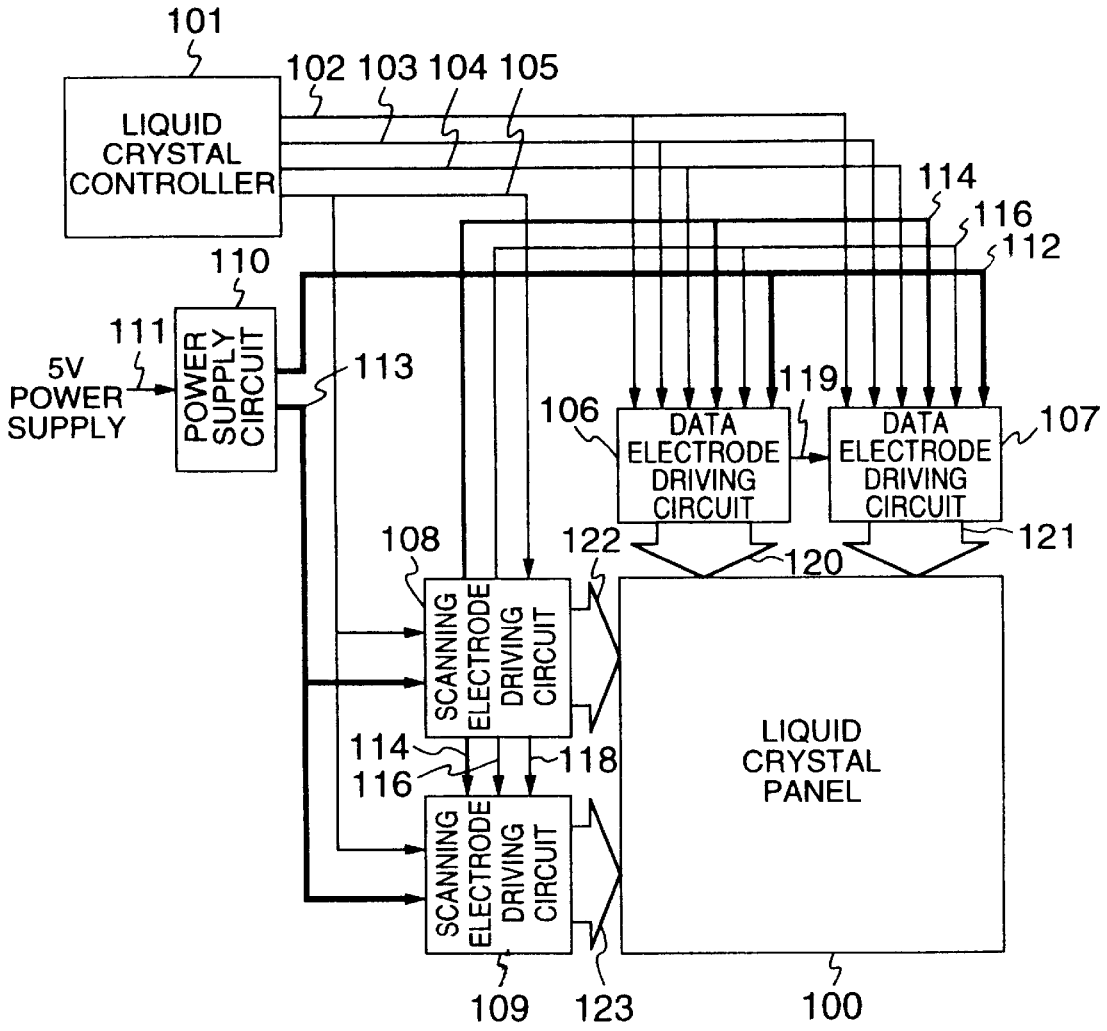
FIG. 2 is a schematic diagram illustrating a liquid crystal display system according to a first embodiment of the present invention.

As shown in FIG. 2, the liquid crystal display unit comprises a liquid crystal panel 100, a liquid crystal controller 101, data electrode driving circuits 106 and 107, scanning electrode driving circuits 108 and 109 and a power supply circuit 110.

Figure 5:
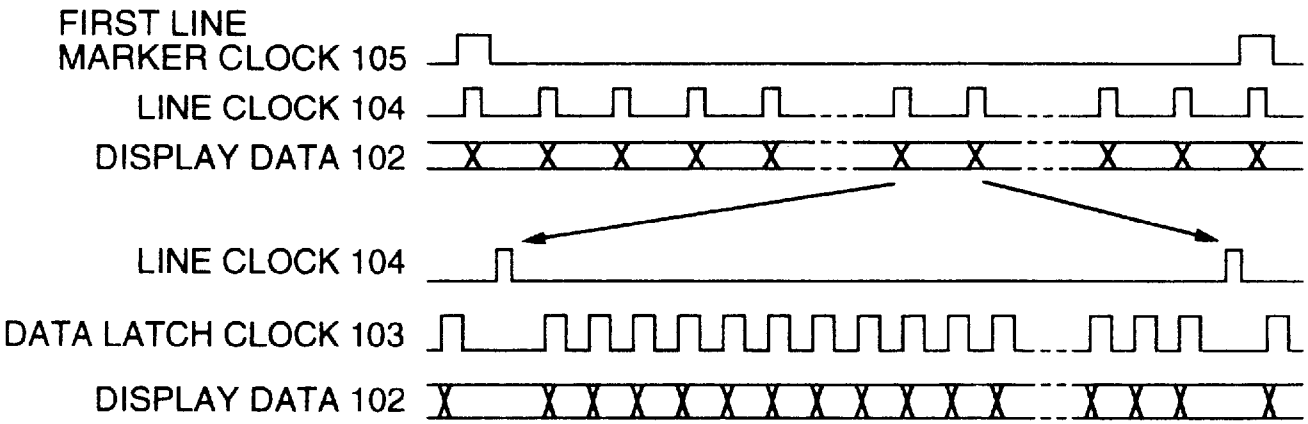
FIG. 5 is a timing diagram showing display data 102, a first line marker clock 105, a line clock 104 and a data latch clock 103.

The liquid crystal controller 101 generates display data 102, a data latch clock 103, a line clock 104, a first line marker clock 105 for driving the liquid crystal panel as in HD66850 (CLINE) manufactured by Hitachi, for example. A timing relation among these signals is shown in FIG. 5. In FIG. 5, the display data 102 is supplied in synchronism with the data latch clock 103 and the line clock 104 is supplied each time the display data for one row are supplied. Further, each time a predetermined rows of display data are supplied, the first line marker clock 105 is supplied. The following description is made on the assumption that the liquid crystal panel includes display dots consisting of 320 dots/row and 240 rows as far as there is no description for modification.

The scanning electrode driving circuits 108 and 109 generate a four-line clock 116 and a scanning function data 114 from the line clock 104 and the first line marker clock 105 and supply scanning electrode driving voltages 122 and 123 to the liquid crystal panel 100.

On the other hand, the data electrode driving circuits 106 and 107 are supplied with the display data 102 in synchronism with the data latch clock 103. Further, the four-line clock 116 and the scanning function data 114 generated by the scanning electrode driving circuit 108 are also supplied to the data electrode driving circuits 106 and 107. The data electrode driving circuits 106 and 107 perform a predetermined operation between the scanning function data 114 and the four-line display data supplied thereto and supply data electrode driving voltages 120 and 121 obtained in accordance with the predetermined operation to the liquid crystal panel 100.

The power supply circuit 110 produces a power supply voltage 112 for the data electrode driving circuit and a power supply voltage 113 for the scanning electrode driving circuit from a 5-volt power supply 111 to supply these voltages to the data electrode driving circuits 106 and 107 and the scanning electrode driving circuits 108 and 109, respectively. In the embodiment, the power supply voltage 112 for the data electrode scanning circuit includes five level voltages (Vx0, Vx1, Vx2, Vx3 and Vx4), and the power supply voltage 113 for the scanning electrode driving circuit includes three level voltages (Vy0, Vy1 and Vy2).

The above mentioned portions are now described in detail by citing an example for each portion. The scanning electrode driving circuits 108 and 109 are described with reference to FIGS. 6 to 13, the data electrode driving circuits 106 and 107 with reference to FIGS. 14 to 18, and the power supply circuit 110 with reference to FIG. 19.

First of all, the scanning electrode driving circuit 108 is described with reference to FIGS. 6 to 13.

Figure 6:
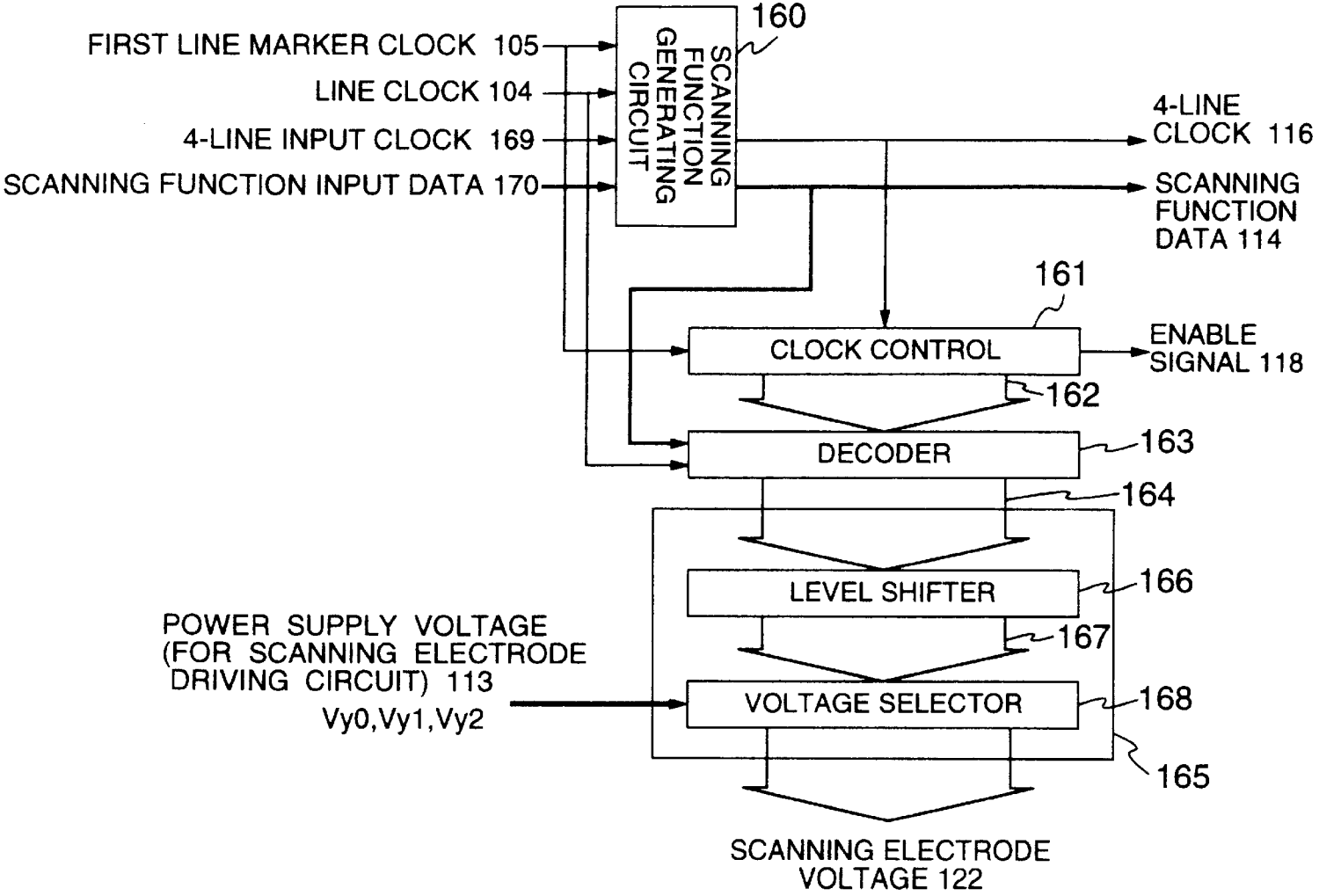
FIG. 6 is a block diagram schematically illustrating a scanning electrode driving circuit 108, 109 in detail.
Figure 13:
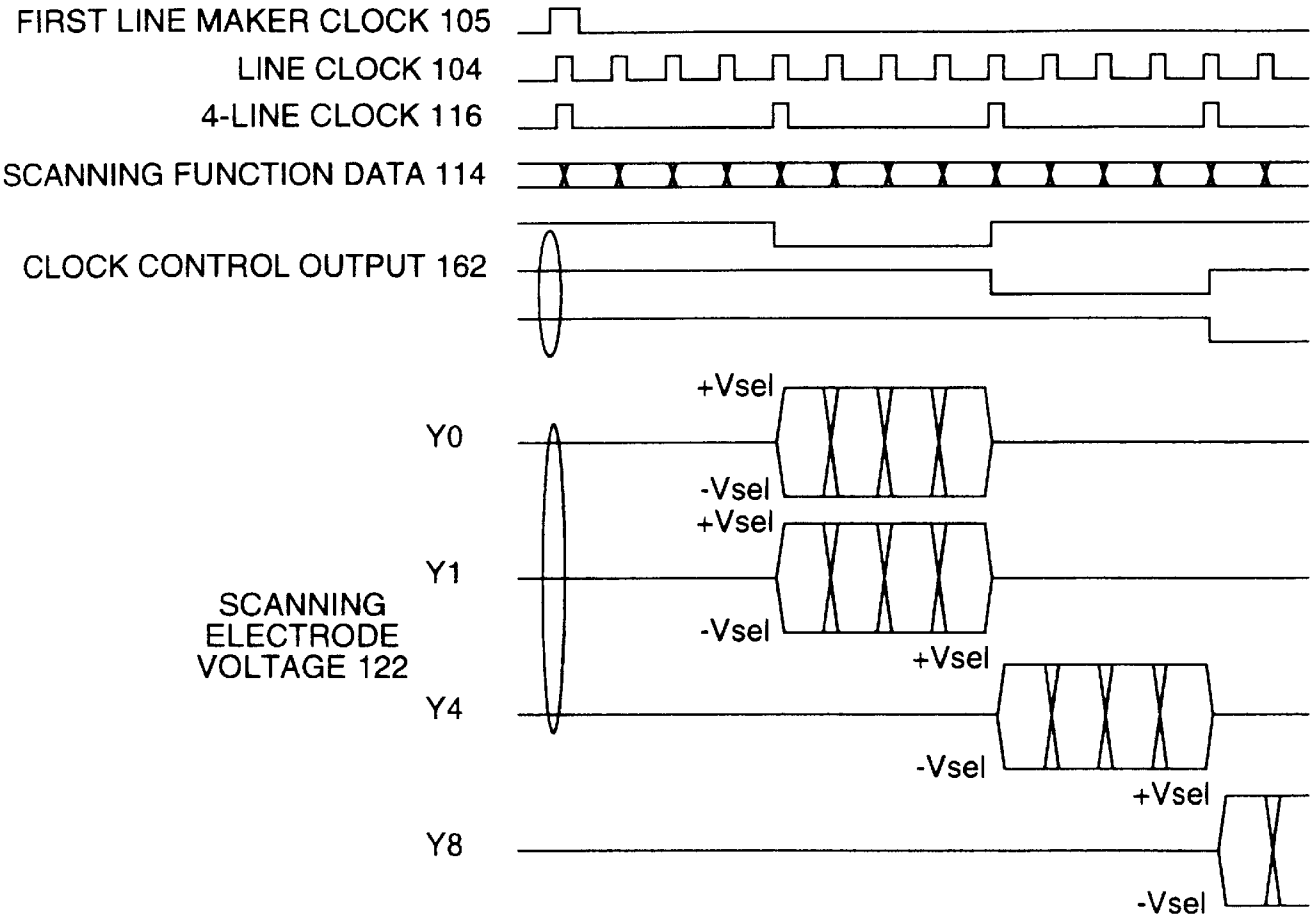
FIG. 13 is a timing diagram illustrating operation of the scanning electrode driving circuit 108, 109.

As shown in FIG. 6, the scanning electrode driving circuit 108 includes a scanning function generating circuit 160, a clock control circuit 161, a decoder 163, and an output circuit 165 (consisting of a level shifter 166 and a voltage selector 168). A timing relation of signals at the portions of FIG. 6 is shown in FIG. 13. An "orthogonal function generating circuit" described in the claims is realized by the scanning function generating circuit 160 in this embodiment (a scanning function generating circuit 260 in a second embodiment described later). A "scanning circuit" is realized by the clock control circuit 161, the decoder 163 and the output circuit 165 (in the second embodiment a clock control circuit 261, a decoder 263 and an output circuit 265).

The clock control circuit 161 generates a clock control output signal 162 and an enable signal 118 from the first line marker clock 105 and the four-line clock 116. Further, the scanning function generating circuit 160 generates the scanning function data 114 in synchronism with the line clock 104. The scanning function data 114 and the output 162 of the clock control circuit 161 are supplied to the decoder 163, which supplies an output 164 to the output circuit 165. The output circuit 165 includes the level shifter 166 and the voltage selector 168. The voltage selector 168 selects one of the three level voltages of the power supply voltage 113 for the scanning electrode driving circuit from outputs 167 of the level shifter and outputs the selected voltage as the scanning electrode driving voltage 122.

The portions constituting the scanning electrode driving circuit 108, 109 shown in FIG. 6 are now described in detail.

Figure 7:
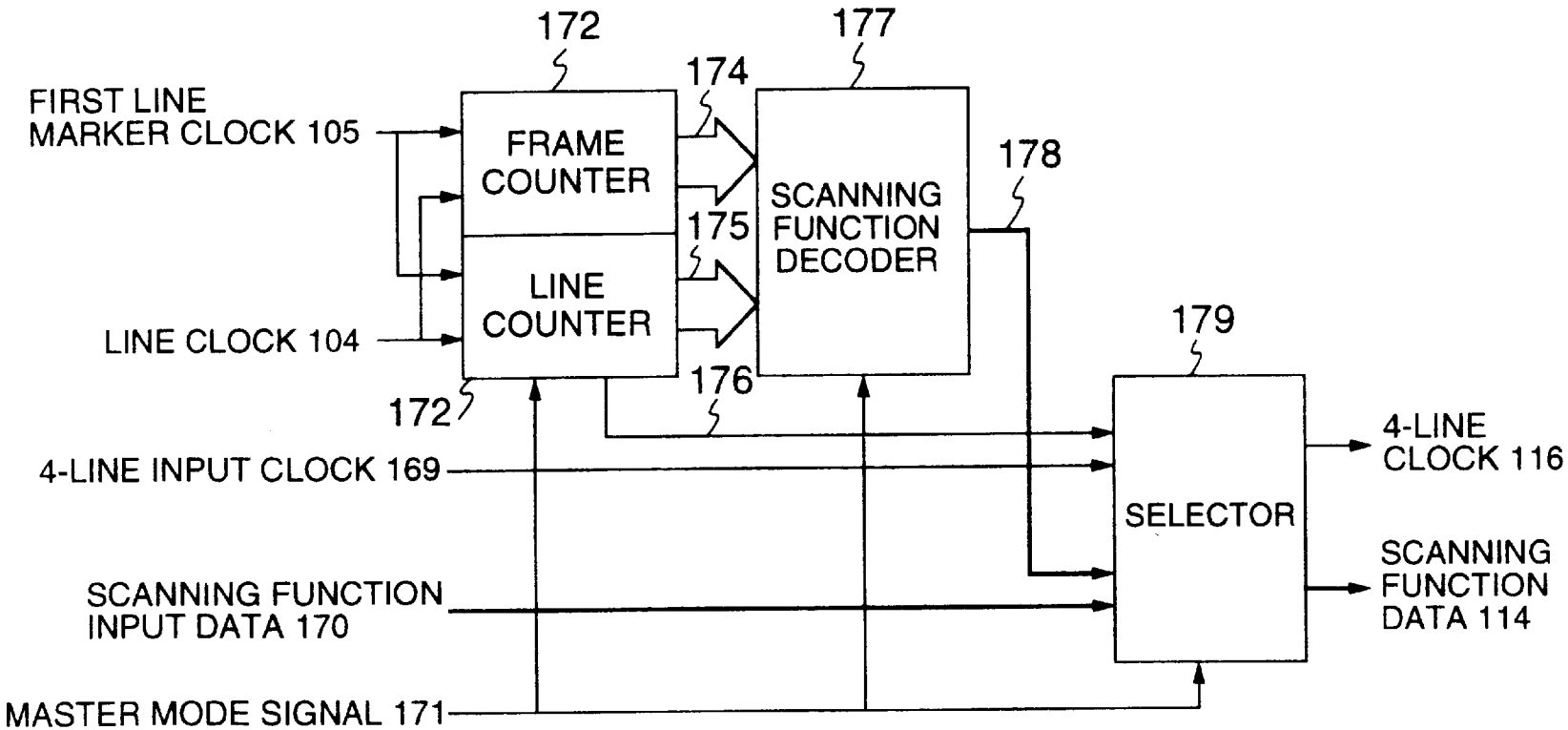
FIG. 7 is a block diagram schematically illustrating a scanning function generating circuit 160 in detail.
Figure 8:
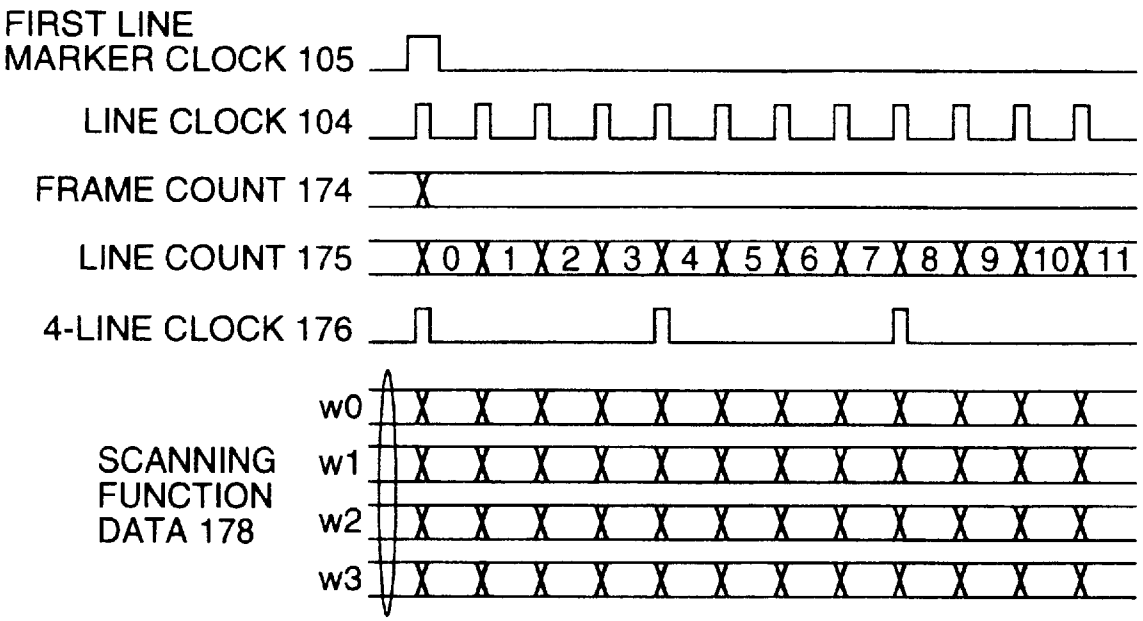
FIG. 8 is a timing diagram illustrating operation of the scanning function generating circuit 160.

An example of the scanning function generating circuit 160 (see FIG. 6) is described with reference to FIGS. 7 to 9. FIG. 7 is a block diagram schematically illustrating the internal configuration of the scanning function generating circuit 160 and FIG. 8 is a timing diagram showing operation of the scanning function generating circuit 160.

As shown in FIG. 7, the scanning function generating circuit 160 includes a frame counter 172, a line counter 173, a scanning function decoder 177 and a selector 179.

The frame counter 172 is to take in the first line marker signal 105 by the line clock 104 to count the first line marker clock and generate a frame count 174. The line counter 173 generates a line count 175 and a four-line clock 176 from the first line marker clock 105 and the line clock 104. One four-line clock 176 is generated each time four line clocks 104 are inputted as shown in FIG. 8.

The scanning function decoder 177 generates a predetermined scanning function data 178 on the basis of the frame count 174 and the line count 175. The scanning function data 178 is updated each time the first line marker clock 105 and the line clock 104 are inputted (see FIG. 8).

The selector 179 performs different operations depending on whether the scanning electrode driving circuit is operated in the master driving state or the slave driving state. In the master driving state, the selector outputs the scanning function data 178 generated by the scanning function decoder 177 as the scanning function data 114. In the slave driving state, the selector outputs a scanning function input data 170 supplied externally of the scanning electrode driving circuit as the scanning function data 114. Similarly, the selector outputs the four-line clock 176 generated by the line counter 173 as the four-line clock 116 in the master driving state and outputs a four-line input clock 169 as the four-line clock 116 in the slave driving state.

Designation as to whether the scanning electrode driving circuit is operated in the master driving state or the slave driving state is made by a master mode signal 171. In the slave driving state, the frame counter 172, the line counter 173 and the scanning function decoder 177 are stopped. A "master scanning driving circuit" described in the claims designates a master-driven scanning electrode driving circuit 108 in the embodiment. A "selection signal" corresponds to the master mode signal 171.

An example of the scanning function data 178 generated by the scanning function decoder 177 is shown in FIG. 9. In FIG. 9, when the frame count 174 is even and the line count 175 of the line counter 173 is 0, w0, w1 w2 an w3 of the scanning function data 178 are all 1. When the line count becomes 1, the scanning function data 178 has w0=1, w1=1, w2=0 and w3=0. When the line count 175 becomes 2, the scanning function data 178 has w0=1, w1=0, w2=0 and w3=1. Similarly, the scanning function data 178 is produced as shown in FIG. 9. The scanning voltage in the divided period 1 of FIG. 3 described above corresponds to data for the line counts 175 of 0 to 3 and the scanning voltage in the divided period 2 corresponds to data for the line counts 175 of 4 to 7. Similarly, the scanning voltage in the divided period 60 corresponds to data for the line counts 175 of 236 to 239. Further, the logic of the scanning function data in odd and even frames has the reversed relation in accordance with the frame count 174. Thus, voltages applied to the liquid crystal cells have the polarities capable of being reversed alternately every frame while the R.M.S. values thereof are kept constant, so that deterioration of liquid crystal material can be prevented.

Figure 10:
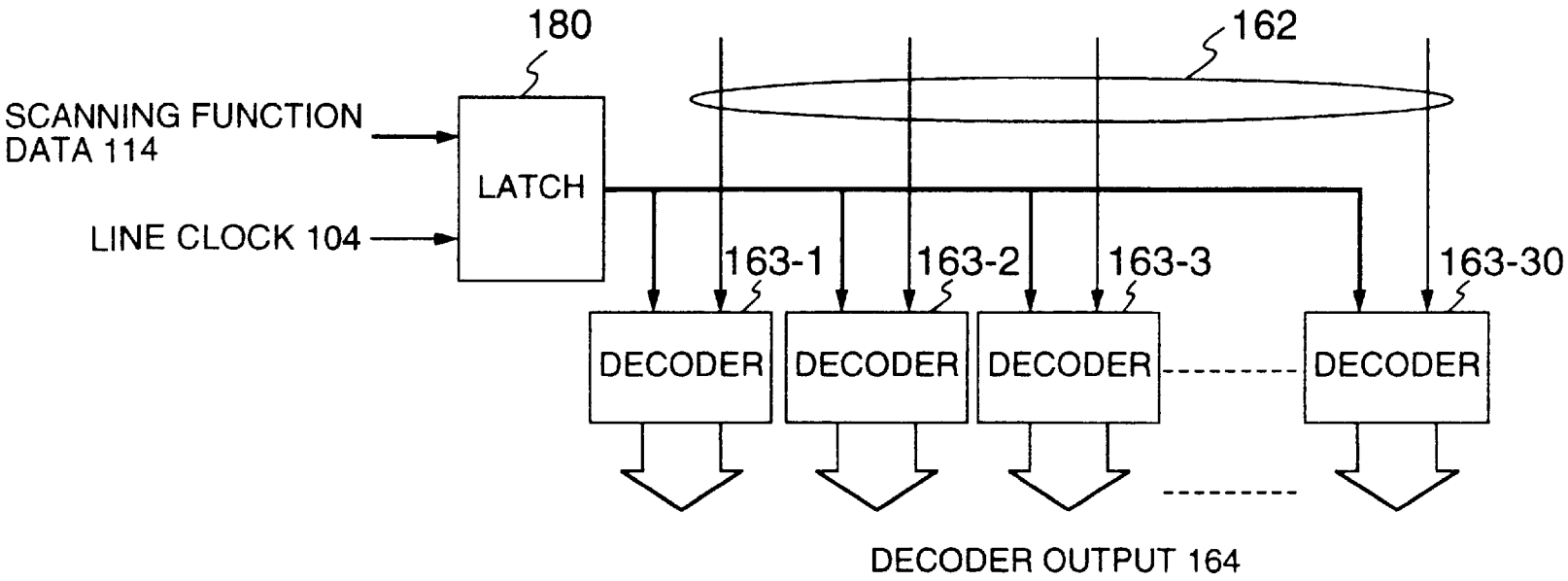
FIG. 10 is a schematic diagram illustrating a decoder 163 in detail.

An example of the decoder 163 (FIG. 6) is described with reference to FIG. 10.

Figure 11:
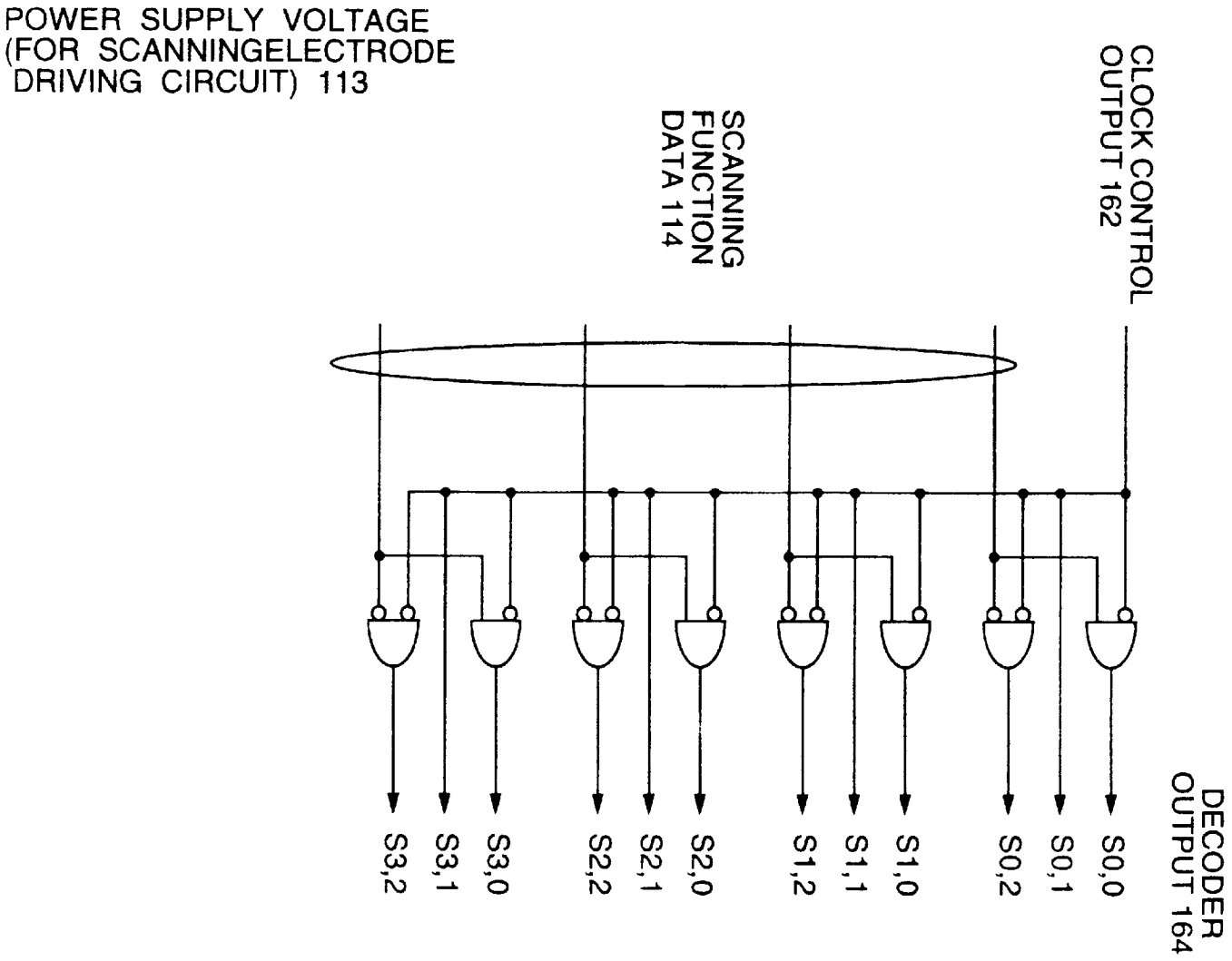
FIG. 11 is a schematic diagram illustrating a decoder 163-1 in detail.

The decoder 163 includes a latch circuit 180 and decoders 163-1, 163-2, 163-3, . . . , 163-30. Components corresponding to those of FIG. 6 are designated by the same reference numerals. In FIG. 10, the decoder 163 is consisted of 30 decoders 163-1, 163-2, 163-3, . . . , 163-30. One of the decoders is selected by the output 162 of the clock control circuit 161. The selected decoder produces the decoder output 164 in accordance with the scanning function data 114 latched in the latch circuit 180 and the remaining unselected decoders produce unselected decoder output 164. Each of the decoders 163-1 to 163-30 are constituted as shown in FIG. 11. The decoders are in the selected state when the output 162 of the clock control circuit 161 is a logic 0 and are in the unselected state when the output is a logic 1. The decoders produce the signal in accordance with the logic of the scanning function data 114 as the decoder output 164 to the output circuit 165 in the selected state.

Figure 12:
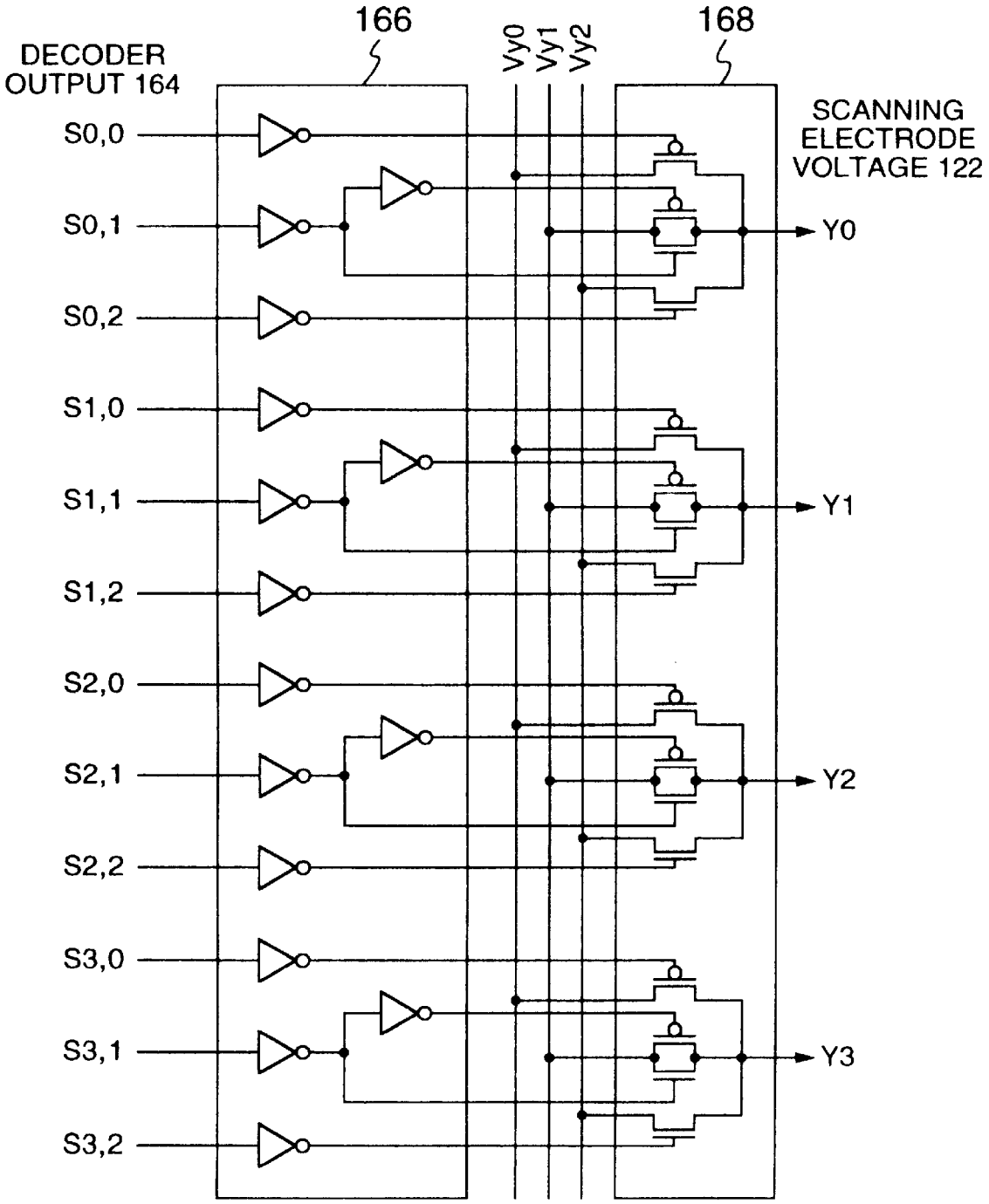
FIG. 12 is a schematic diagram illustrating an output circuit 165 in detail.

An example of the output circuit 165 (see FIG. 6) is now described with reference to FIG. 12.

The components corresponding to those of FIG. 6 are designated by the same reference numerals. In FIG. 12, the level of the decoder output 164 is shifted by the level shifter 166 and the voltage selector 168 is operated by outputs of the level shifter. In the selected state, the voltage selector 168 is operated in accordance with the decoder output 164. In other words, when the scanning function data 114 is a logic 1, a voltage Vy0 (+Vsel in FIG. 13) is selected and when the scanning function data 114 is a logic 0, a voltage Vy2 (−Vsel in FIG. 13) is selected. The selected voltages are produced as the scanning electrode voltage 122. Further, in the unselected state, a voltage Vy1 (0V) is produced as the scanning electrode voltage 122 irrespective of the logic of the scanning function data 114.

The scanning electrode driving circuit 108 has been described, while the other scanning electrode driving circuit 109 is also constituted in the same manner as the circuit 108. However, since the scanning electrode driving circuit 109 is operated in the slave driving state differently from the scanning electrode driving circuit 108, the scanning function generating circuit 160 shown in FIG. 7 becomes the slave mode. That is, since the selector 179 of FIG. 7 is operated in the slave driving state, the selector 179 selects the externally supplied four-line input clock 169 (in this case, the four-line clock 116 produced by the scanning electrode driving circuit 108 is inputted) as the four-line clock and selects the externally supplied scanning function input data 170 (in this case, the scanning function data 114 produced by the scanning electrode driving circuit 108 is inputted) as the scanning function data.

An example of the data electrode driving circuit 106, 107 of FIG. 2 is now described in detail with reference to FIGS. 14 to 18.

Figure 14:
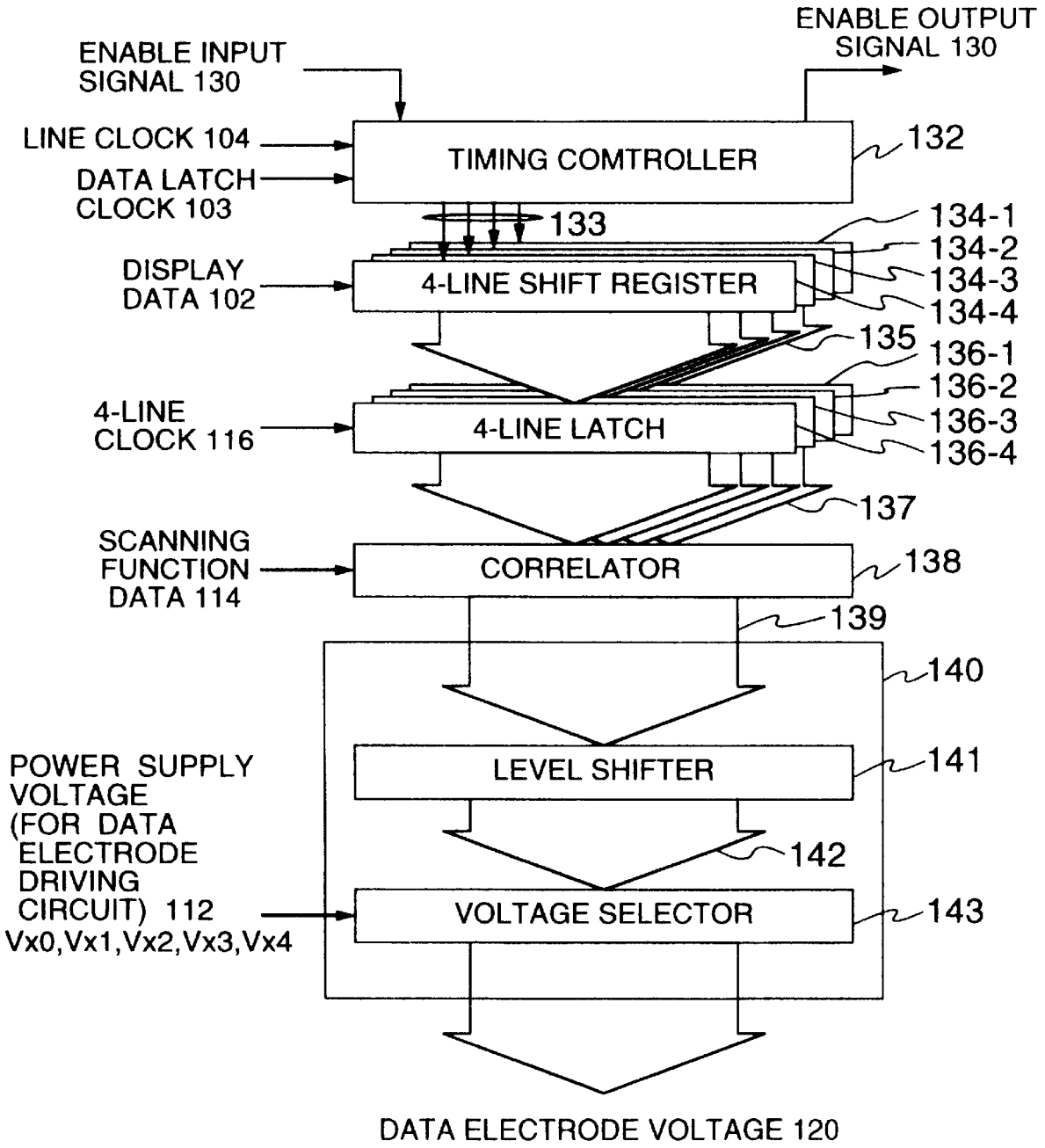
FIG. 14 is a block diagram schematically illustrating a data electrode driving circuit 106, 107 in detail.
Figure 15:
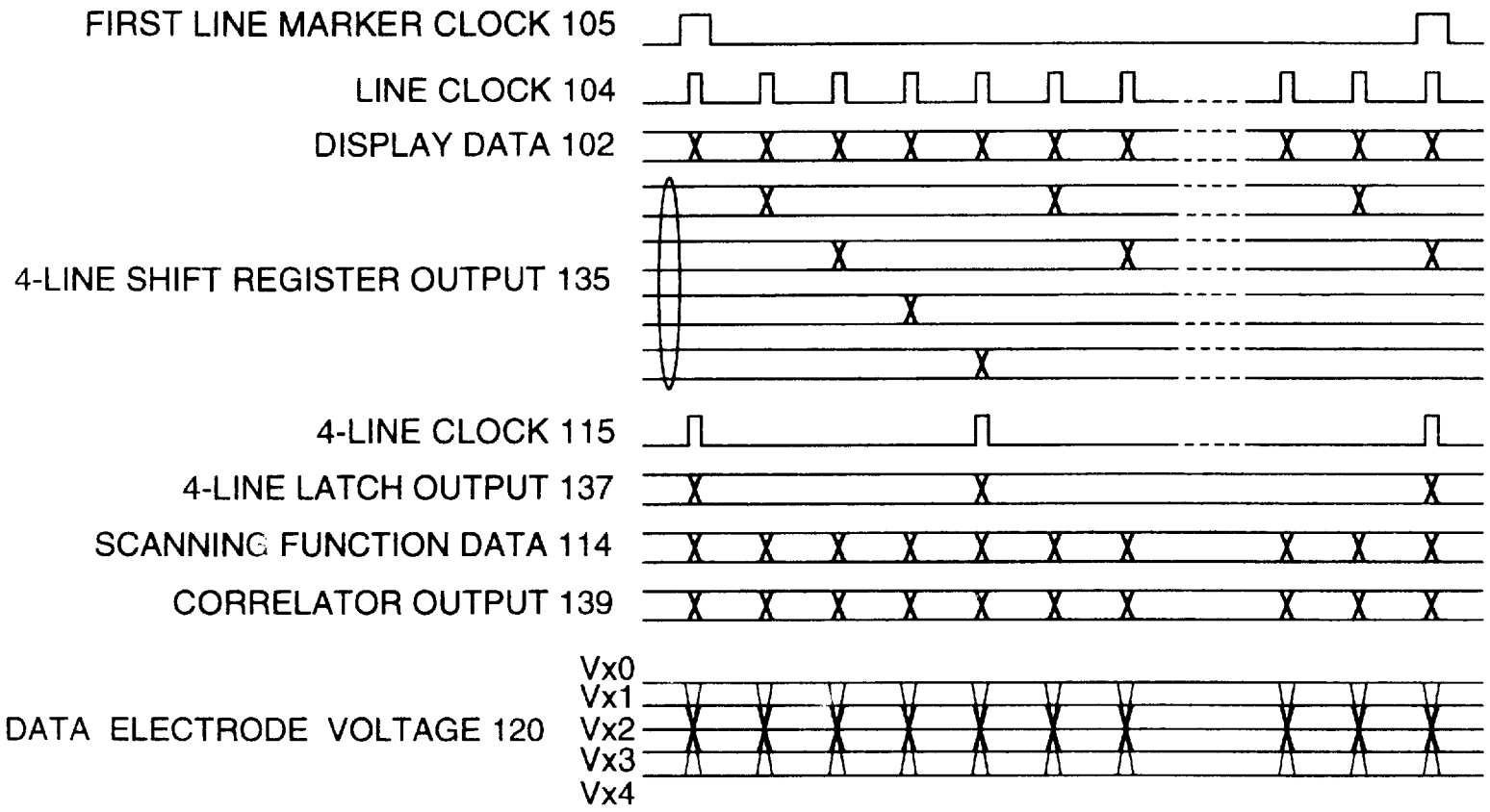
FIG. 15 is a timing diagram illustrating operation of the data electrode driving circuit 106, 107.

As shown in FIG. 14, the data electrode driving circuit 106, 107 includes a timing controller 132, four-line shift registers 134-1 to 134-4, four-line latches 136-1 to 136-4, a correlator 138, and the output circuit 140 (a level shifter 141 and a voltage selector 143). Signals corresponding to those shown in FIG. 2 are designated by the same reference numerals. FIG. 15 shows a timing of signals in the data electrode driving circuit 106, 107.

In FIG. 14, an enable input signal 130 is to control operation and non-operation of the data electrode driving circuit. An enable output signal 131 is supplied to an enable input of a next data electrode driving circuit when a plurality of data electrode driving circuits are connected. Since the enable input signal 131 and the enable output signal 131 are used in a commercially available data electrode driving circuit (generally named a "data driver") and are put into practice, detailed description thereof is omitted.

The timing controller 132 produces a shift clock 133 and the enable output signal 131 on the basis of the line clock 104 and the data latch clock 103. The four-line shift register 134 takes in the display data 102 successively at the timing of the shift clock and when the taking in of the display data is completed, the four-line shift register 134 produces the display data as the shift register output (display data) 135. A "shift register" described in the claims is realized by the four-line shift register 134 in the first embodiment (a shift register 234 in a second embodiment described later).

The four-line latch 136 latches the shift register output 135 by the four-line clock 116. That is, each of the latches 136-1, 136-2, 136-3 and 136-4 stores one line of the display data 135 and outputs the display data as the latch output 137. The correlator 138 performs a predetermined operation using the latch outputs 137 and the scanning function data 114. In the output circuit 140, the level shifter 141 shifts a level of an output 139 of the correlator 138. Then, the voltage selector 143 selects one of five level voltages of the power supply voltages 112 for the data electrode driving circuit in accordance with an output 142 of the level shifter 141 and produces it as the data electrode voltage 120. A "latch circuit" described in the claims is realized by the four-line latch 136 of the first embodiment (a four-line latch 236 in the second embodiment).

Figure 16:
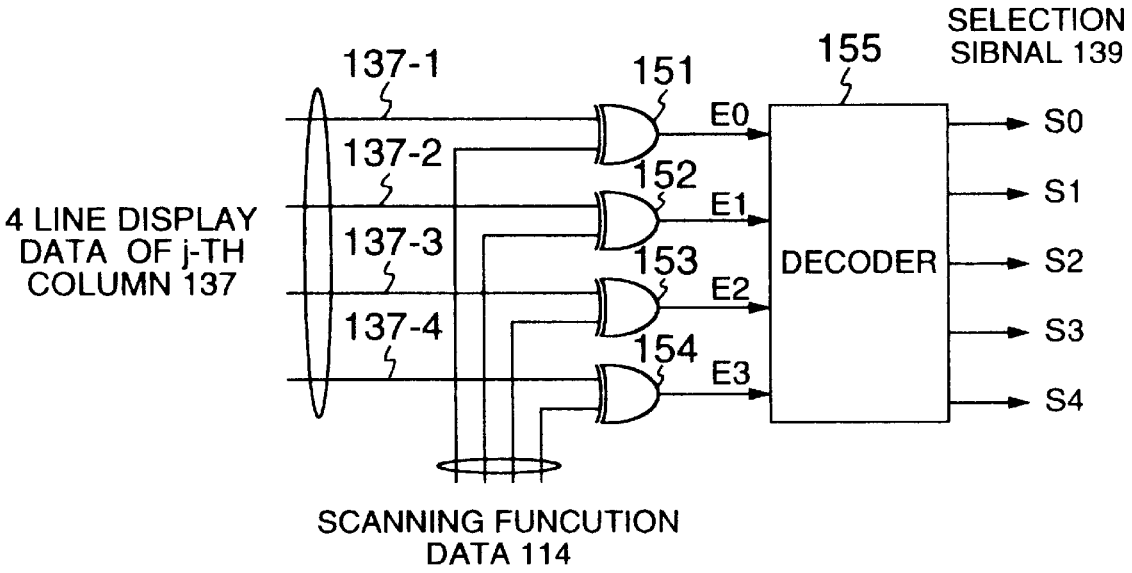
FIG. 16 is a schematic diagram illustrating a correlator 138 in detail.

An example of the correlator 138 (see FIG. 14) is now described with reference to FIG. 16.

The correlator 138 includes exclusive OR circuits 151 to 154 and a decoder 155. One correlator 138 shown in FIG. 16 is necessary in order to drive one data electrode. If it is assumed that each of the data electrode driving circuits 106 and 107 of the first embodiment drives 160 data electrodes, 160 correlators are required. The correlator is hereinafter assumed to be a j-th column (j-th dot) of 160 outputs. In FIG. 16, the exclusive OR circuits 151 to 154 perform the exclusive OR operation between the four-line display data 137 of the j-th column from the four-line latch 136 of FIG. 14 and the scanning function data 114.

The four-line display data 137 of the j-th column includes display data of j-th columns of the latches 136-1, 136-2, 136-3 and 136-4. These display data and the scanning function data 114 are subjected to the exclusive OR operation and data E0, E1, E2 and E3 are supplied to the decoder 155. The decoder 155 produces selection signals 139 (S0, S1, S2, S3 and S4) from the data E0, E1, E2 and E3. The relation of the data E0, E1, E2 and E3 and the selection signals S0, S1, S2, S3 and S4 is described in FIG. 17. In FIG. 17, the decoder 155 produces the selection signals so that S0 is a logic 1 when the number of logic 1 of the input data E0, E1, E2 and E3 is 0, S1 is a logic 1 when it is 1, S2 is a logic 1 when it is 2, S3 is a logic 1 when it is 3, and S4 is a logic 1 when it is 4. The selection signals 139 thus produced are supplied to the output circuit 140 shown in FIG. 14. The operation performed by the correlator 138 is given by the following expression (11):

$$Sj = \frac{\sum_{i=l}^{N} Iij \cdot Wi + m}{2} \tag{11}$$

where m is the number of simultaneously selected scanning electrodes, Wi is a function having +1 or −1 in the selected period and 0 in the unselected period, and Iij is a display data of a display pixel in the i-th row and the j-th column.

A "correlator" described in the claims is realized by the correlator 138 in the first embodiment (a correlator 138 in the second embodiment). An "output circuit" is realized by the output circuit 140 in the first embodiment (an output circuit 240 in the second embodiment).

Figure 18:
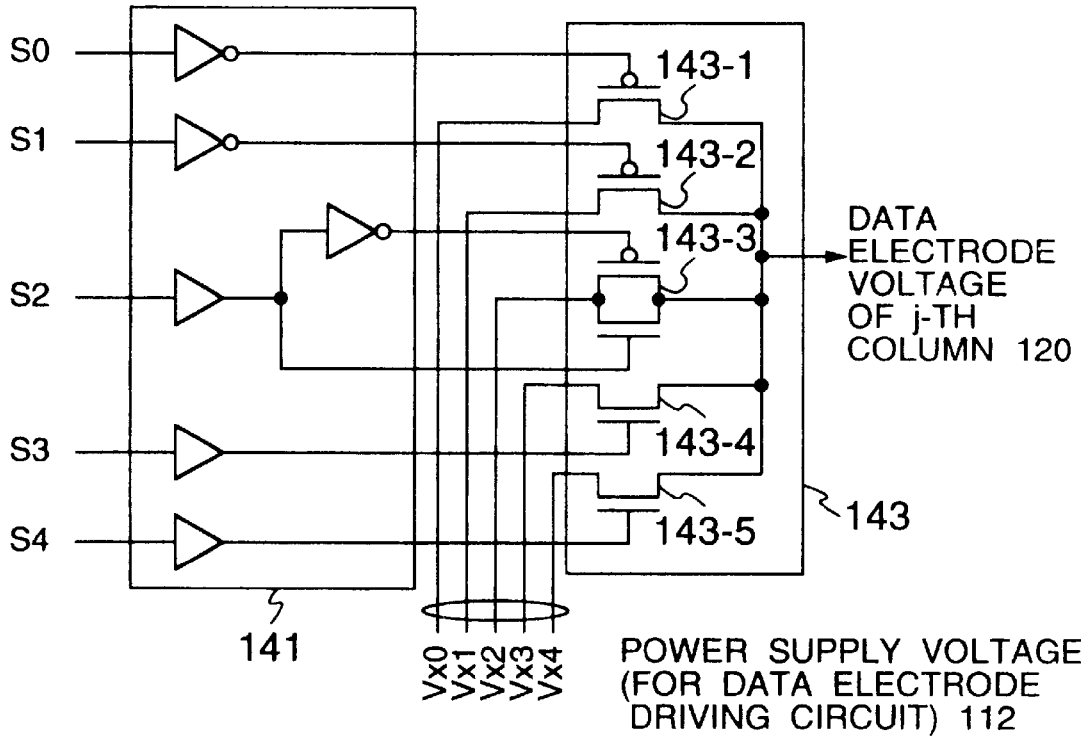
FIG. 18 is a schematic diagram illustrating an output circuit 140, and a level shifter 141 and a voltage selector 143 constituting the output circuit 40 in detail.

An example of the level shifter 141 and the voltage selector 143 (see FIG. 14) is described with reference to FIG. 18. In FIG. 18, numerals 143-1 to 143-5 denote output transistors. Components corresponding to those of FIG. 14 are designated by the same reference numerals. The circuit of FIG. 18 is connected to the output of the correlator shown in FIG. 16 and accordingly the circuits equal to the correlators 138 in number are used.

In FIG. 18, the selection signals 139 produced by the decoder 155 of the correlator 138 are supplied to the level shifter 141 of the output circuit 140. The level shifter 141 converts the selection signals 139 into voltages necessary to turn on and off the output transistors 143-1 to 143-5 of the voltage elector 143 in accordance with the logic of the election signals. The output transistors 143-1 to 143-5 selects one of five level voltages (Vx0, Vx1, Vx2, Vx3 and Vx4) of the power supply voltage 112 for the data electrode driving circuit in accordance with the outputs of the level shifter 141 and produces the selected voltage as the j-th data electrode voltage 120.

Figure 19:
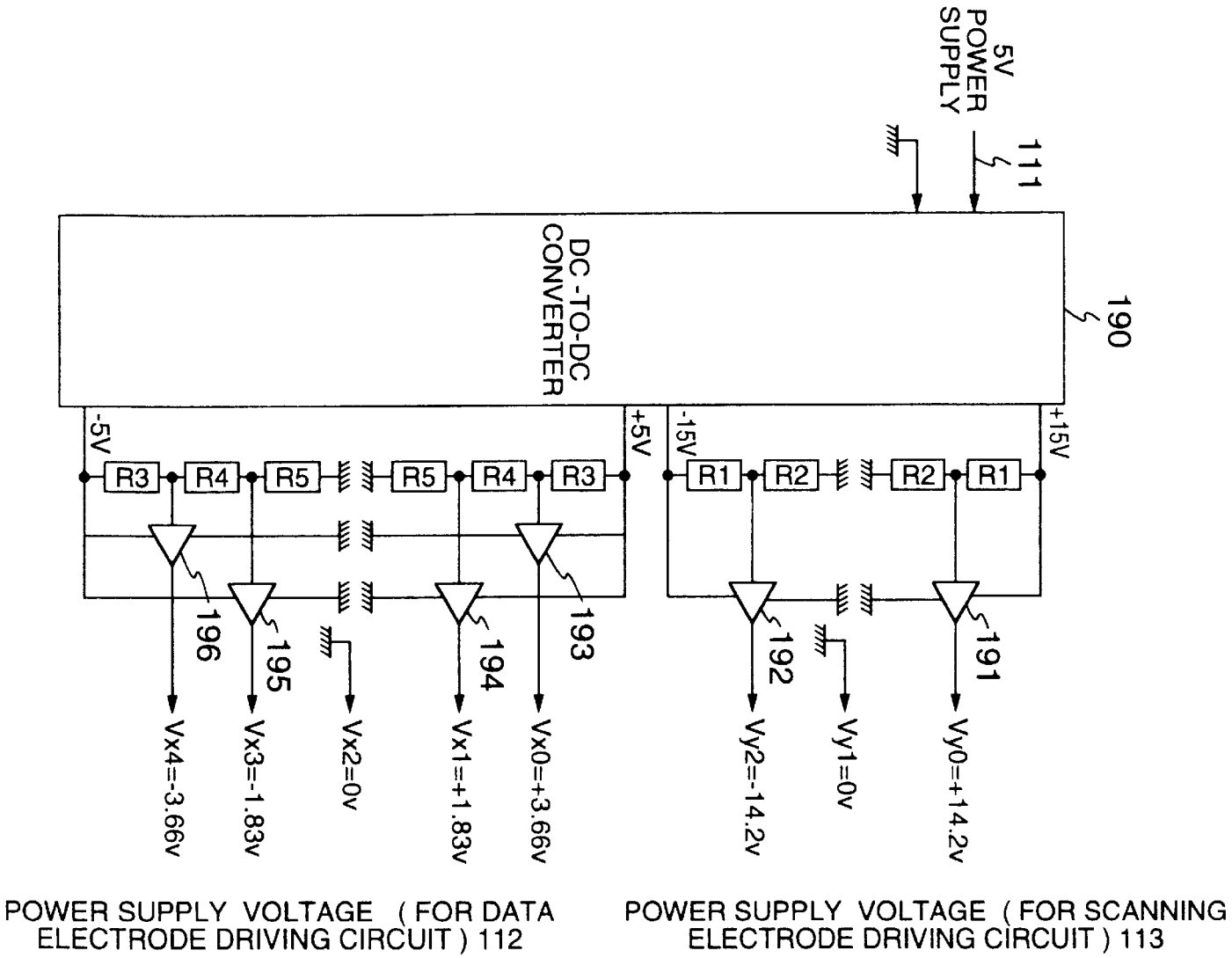
FIG. 19 is a schematic diagram illustrating a power supply circuit 110 in detail.

The power supply circuit 110 of FIG. 2 is described in detail with reference to FIG. 19.

The power supply circuit 110 includes a DC-to-DC converter which uses electric power supplied from a 5-V power supply 111 to produce predetermined voltages. The DC-to-DC converter 190 of the embodiment has four kinds of output voltages (+15V, −15V, +5V and −5V).

The power supply circuit 110 includes resistors R1 and R2 for dividing the +15V output voltage and an operation amplifier 191 for amplifying a current thereof to produce a voltage Vy0. Similarly, the −15V output voltage is divided by resistors R1 and R2 and a current thereof is amplified by an operation amplifier 192 to produce a voltage Vy1. Further, a voltage Vy1 is set to the ground (0V). The voltages Vy0, Vy1 and Vy2 thus produced are used as the power supply 113 for the scanning electrode driving circuit.

On the other hand, the power supply circuit 110 includes resistors R3, R4 and R5 for dividing the +5V output voltage and operation amplifiers 193 and 194 for amplifying currents thereof to produce voltages Vx0 and Vx1. Similarly, the −5V output voltage is divided by resistors R3, R4 and R5 and currents thereof are amplified by operation amplifiers 195 and 196 to produce voltages Vx3 and Vx4. Further, a voltage Vx2 is set to the ground (0V). The voltages Vx0, Vx1, Vx2, Vx3 and Vx4 thus produced are used as the power supply 112 for the data electrode driving circuit.

When N=240, m=4 and Vth=2.5v in the expression (12), the voltages produced by the power supply 113 for the scanning electrode driving circuit are as follows:

$$Vx0=14.2\ V,\ Vy1=0\ V,\ Vy2=-14.2\ V$$

Similarly, the voltages produced by the power supply 112 for the data electrode driving circuit are given as follows:

$$Vx0=+3.66\ V,\ Vx1=+1.83\ V,\ Vx2=0\ V,$$

$$Vx3=-1.83\ V,\ Vx4=-3.66\ V$$

The resistors R1 to R5 may be set to have a voltage division ratio so that the above voltages are produced.

Figure 23:
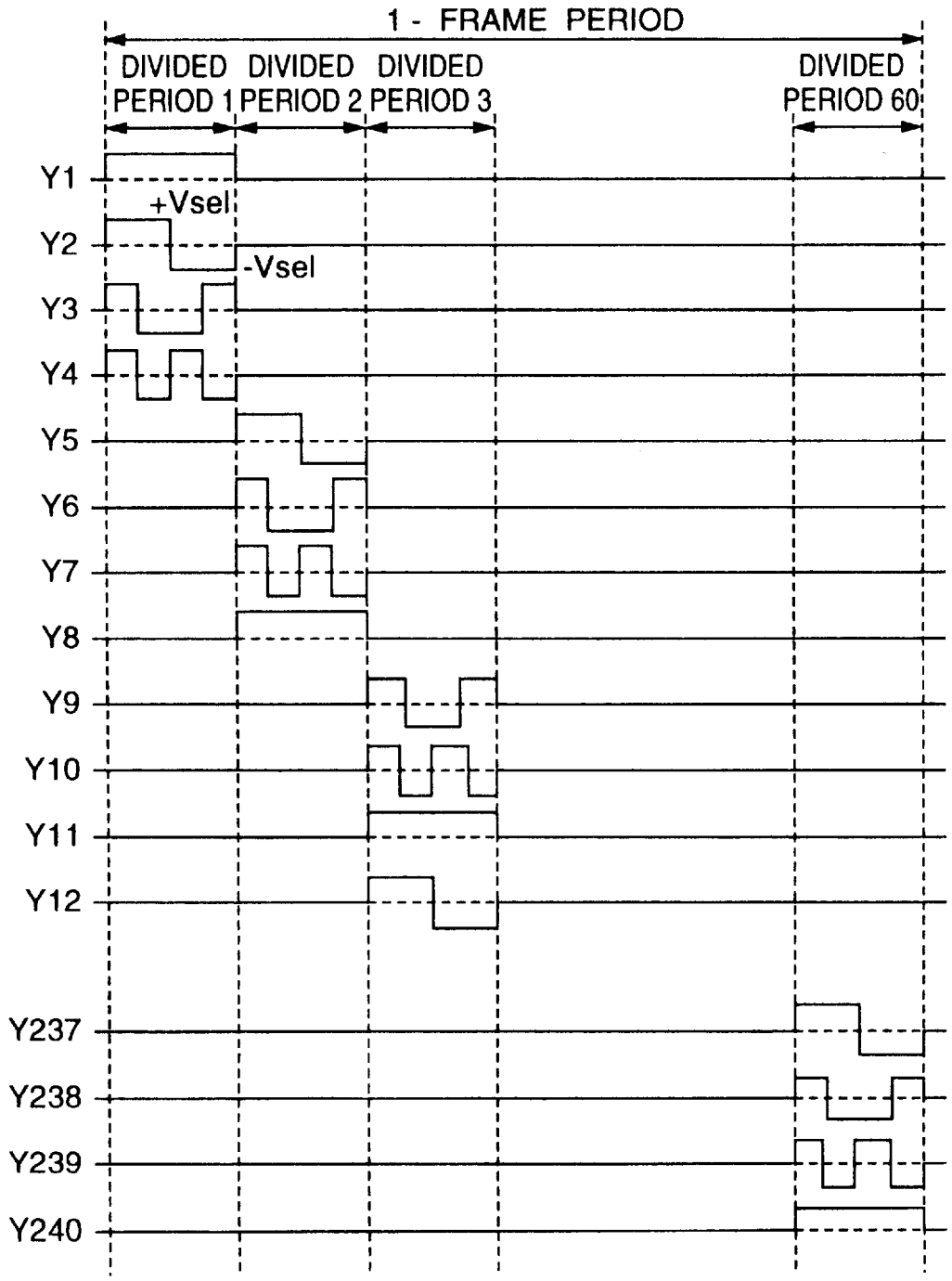
FIG. 23 shows an example of scanning signal waveforms based on the scanning function data of FIG. 20.
Figure 24:
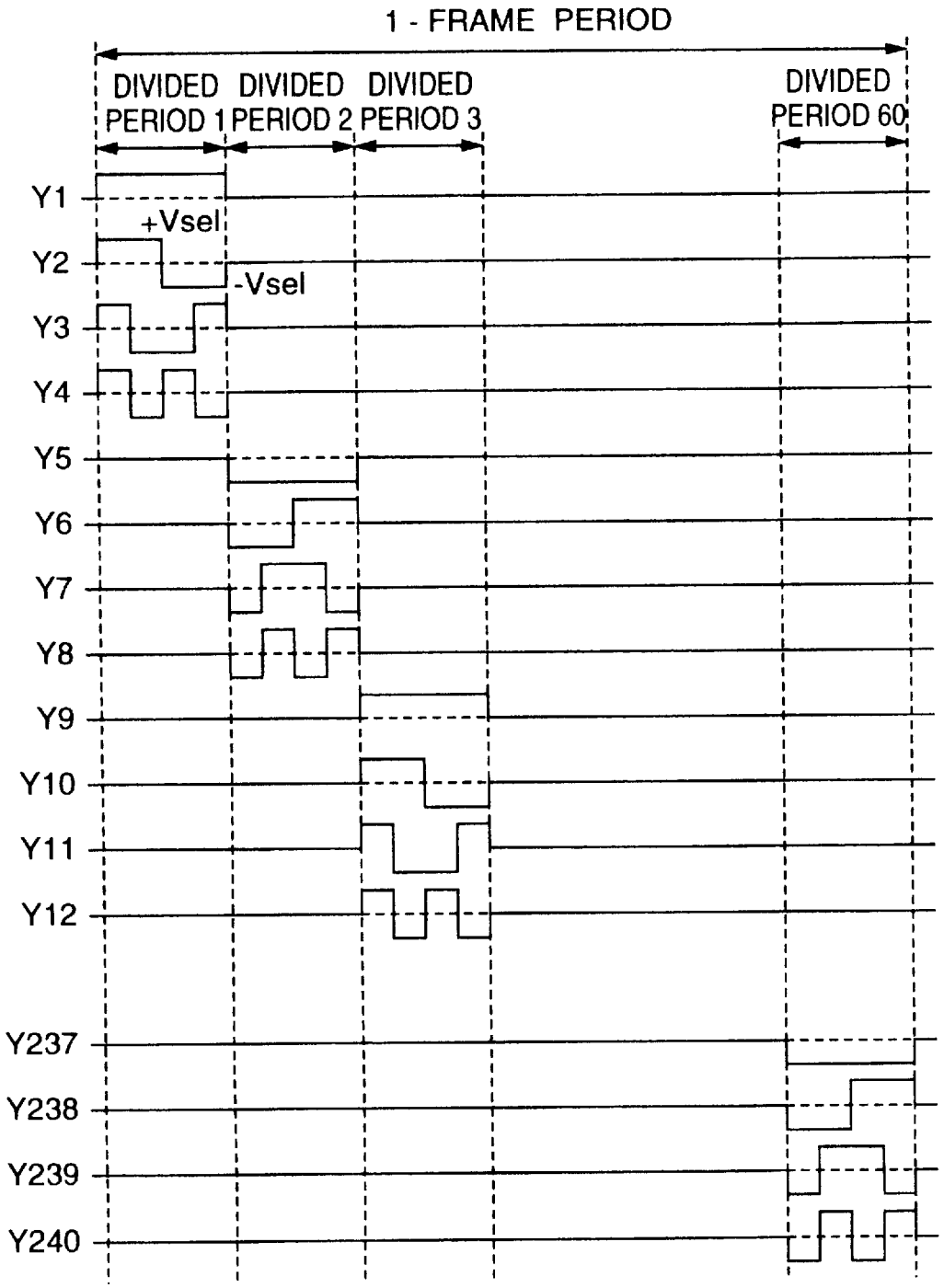
FIG. 24 shows an example of scanning signal waveforms based on the scanning function data of FIG. 21.

In the embodiment, the selection pulse (see FIG. 9) changed similarly in each divided period, that is, the orthogonal function is given as the scanning voltage waveform (see FIG. 3). However, an applicable scanning voltage waveform is not limited thereto. For example, the selection pulse in a combination different in each divided period may be applied. An example of the scanning function data 178 in this case is shown in FIG. 20 and scanning voltage waveforms at this time are shown in FIG. 23. The polarity of the selection pulse may be reversed in each divided period. An example of the scanning function data 178 in this case is shown in FIG. 21 and scanning voltage waveforms at this time are shown in FIG. 24. Further, a combination of the orthogonal functions may be changed in each frame. An example of the scanning function data 178 in this case is shown in FIG. 22 and scanning voltage waveforms for the scanning electrodes Y1 to Y4 at this time are shown in FIG. 25.

Figure 25:
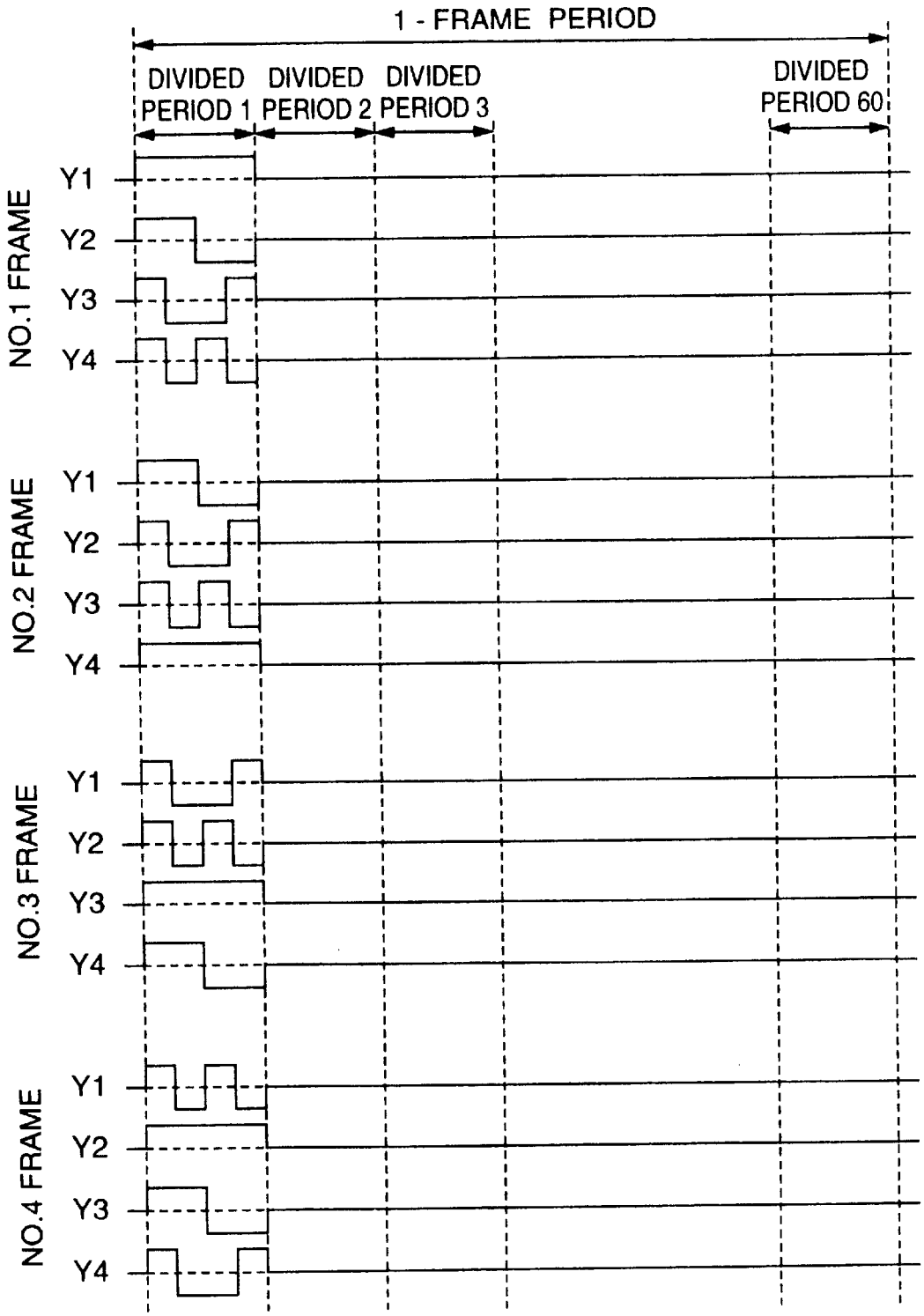
FIG. 25 shows an example of scanning signal waveforms based on the scanning function data of FIG. 22.

As shown in FIGS. 23 to 25, there are four kinds of selection pulses having the voltage polarity not changed in the divided period and the voltage polarity changed once, twice and three times in the divided period. The liquid crystal is known to have the optical characteristic changed depending on a changing frequency of the voltage applied thereto. Accordingly, difference of the number of times that the voltage polarity of the selection pulse is changed becomes difference of the frequency and hence appears as nonuniformity of display. Thus, as shown in FIGS. 23 to 25, by changing the combination of the scanning functions in each divided period, reversing the polarity and changing the combination of the scanning functions in each frame, the nonuniformity of display can be reduced. Further, when the polarity of the scanning voltages for four lines selected in one divided period has imbalance, optical flickering of display sometimes occurs since a direct current component produced in one divided period is applied to the liquid crystal cell.

The "imbalance of the voltage polarity" means that the number of times that the voltage +Vsel is applied is not equal to the number of times that the voltage −Vsel is applied. For example, in the case of FIG. 9, when the frame count 174 is even and the line count 175 is equal to 0 to 3, there are 10 voltages +Vsel indicated by "1" and 6 voltages −Vsel indicated by "0" in FIG. 9. On the other hand, when the frame count 174 is odd and the line count 175 is equal to 0 to 3, there are 6 voltages +Vsel indicated by "1" and 10 voltages −Vsel indicated by "0". That is, each frame has four imbalances between +Vsel and −Vsel.

Figure 27:
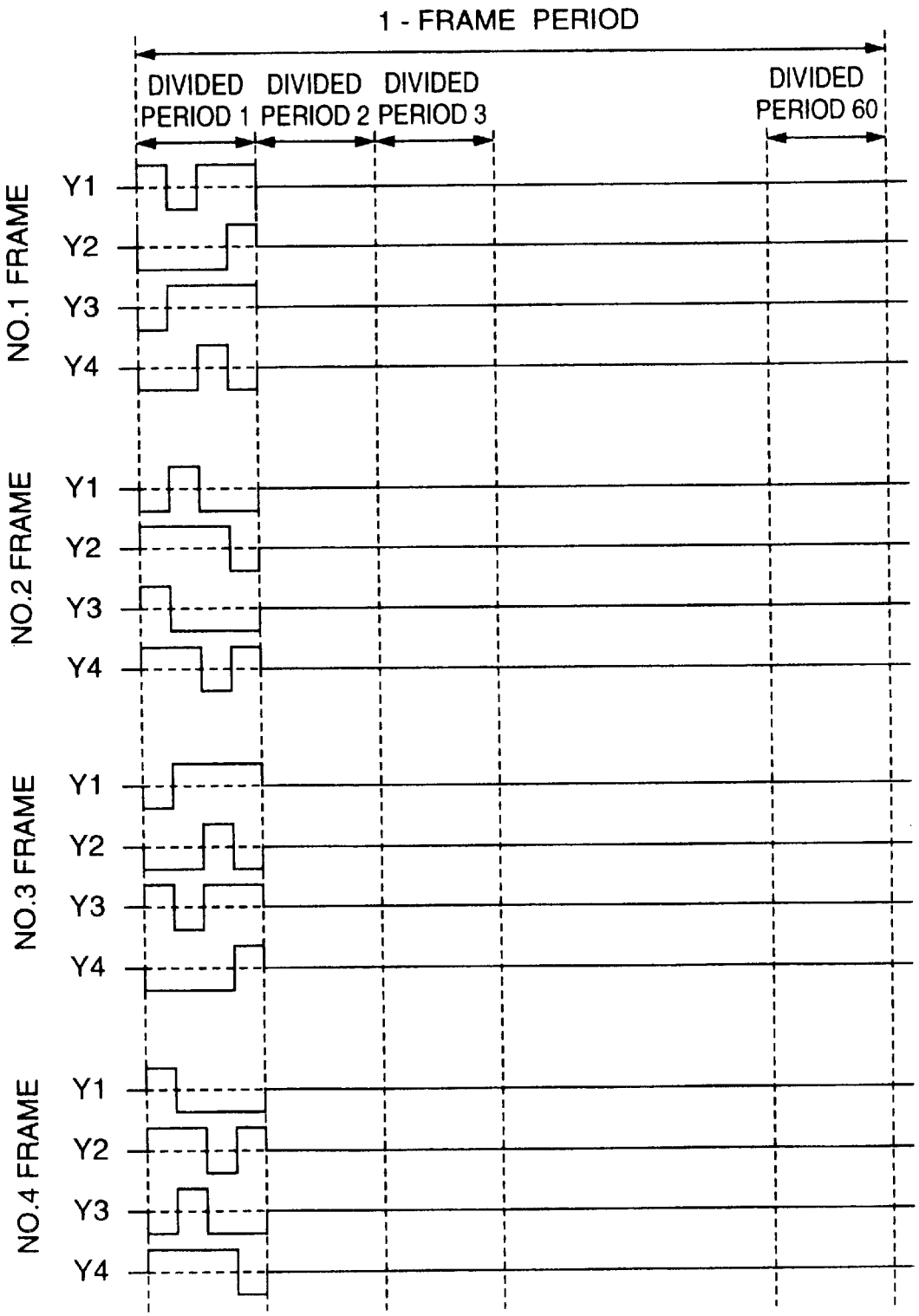
FIG. 27 shows an example of scanning signal waveforms based on the scanning function data of FIG. 26.

In order to solve this problem, the scanning function data 178 having no imbalance may be used. An example of the scanning function data 178 having no imbalance of the voltage polarity is shown in FIG. 26 and scanning voltage waveforms in this case are shown in FIG. 27. The scanning function data 178 always has 8 values of 1 and 8 values of 0 as the scanning function for four lines selected in one divided period. That is, as shown in FIG. 27, there are 8 voltages +Vsel and 8 voltages −Vsel in four lines selected in one divided period.

As shown in FIG. 26, the scanning function data has 8 values of 1 and 8 values of 0 in 16 scanning functions in total for four lines selected in one divided period (four-line period). In addition, conditions (1), (2) and (3) of the scanning function data in case where the display quality on a display screen of the liquid crystal panel is considered are as follows:

Condition (1)

The liquid crystal has the optical characteristic changed depending on a changing frequency of an applied voltage. Accordingly, when there is a difference in the number of changes of the scanning voltage applied to the scanning electrode, nonuniformity of display such as horizontal stripes is produced on a display screen of the liquid crystal panel. Thus, in order to solve this problem, the scanning function data (w0 to w3) for four lines having all 1 or all 0 in one divided period are removed. The function is set to have a ratio of 1 and 0 equal to 1 to 3 or 3 to 1.

Condition (2)

When the data electrode voltage is changed, crosstalk is produced through the liquid crystal from the data electrode to the scanning electrode at the time of change and nonuniformity of display is produced on the display screen of the liquid crystal panel. In order to reduce the change of the data scanning voltage, one divided period (four-line period) is divided into two and a ratio of combination of the functions of 1 and 0 for w0 to w3 is set to 1 to 3 or 3 to 1 in each 2-line period. Consequently, when the four-line display data is not changed as the background color by way of example, the data electrode voltage is changed only every two-line period.

Condition (3)

In order to reduce the display pattern dependency of the changing frequency of the data electrode voltage, the scanning function data is set to be changed every one divided period as shown in FIG. 21. Particularly, the largest effect is obtained when the scanning function data is reversed every one divided period. Further, in order to prevent application of the direct current component, the scanning function is reversed depending on the even and odd frames as shown in FIG. 22 and a combination of the scanning function data is changed in a plurality of frames. On the other hand, the ease of the scanning function generating circuit is considered and change of the combination of the scanning function data is caused to have the periodicity.

The scanning function data satisfying the aforementioned conditions (1), (2) and (3) is shown in FIG. 54.

In FIG. 54, the scanning function data for the frame count 174 equal to 0 and the line count 175 equal to 0 to 3 is described. In one divided period, the number of 1 is 8 and the number of 0 is 8. There is no scanning function data for four lines always equal to 1 or 0 in one divided period. The data has the function having a ratio of 1 and 0 equal to 1 to 3 and 3 to 1. That is, w0 has the ratio of 1 and 0 equal to 3 to 1, w1 1 to 3, w2 3 to 1, and w3 1 to 0. The condition (1) is satisfied.

Further, the ratio of the combination of the function of 1 and 0 for w0 to w3 is 1 to 3 or 3 to 1 every 2-line period or every 2 counts of the line count 175 and the condition (2) is satisfied. That is, when the line count 175 is 0 and 1, the ratio of the combination of the function of 1 and 0 for w0 to w3 1 is 1 to 3. When the line count 175 is 2 and 3, the ratio of the combination of the function of 1 and 0 for w0 to w3 is 3 to 1.

In addition, the scanning function data is reversed every four line counts and is also reversed every frame. Further, the combination thereof is also changed every two frames and is completed in 8 frames in total. That is, the conditions (3) and (4) are satisfied. The scanning function data is repeated when the line count 175 is larger than 8 in each frame.

A second embodiment of the present invention is now described with reference to FIGS. 29 to 47.

The embodiment is the same as the first embodiment in that a plurality of row scanning electrodes of the liquid panel are selected at the same time to thereby reduce the liquid crystal driving voltage so that the power consumption of a display system is reduced but is different therefrom in that the selected row is shifted to a lower row one by one. The basic concept of the driving method is described simply with reference to FIGS. 29 and 30.

Figure 29:
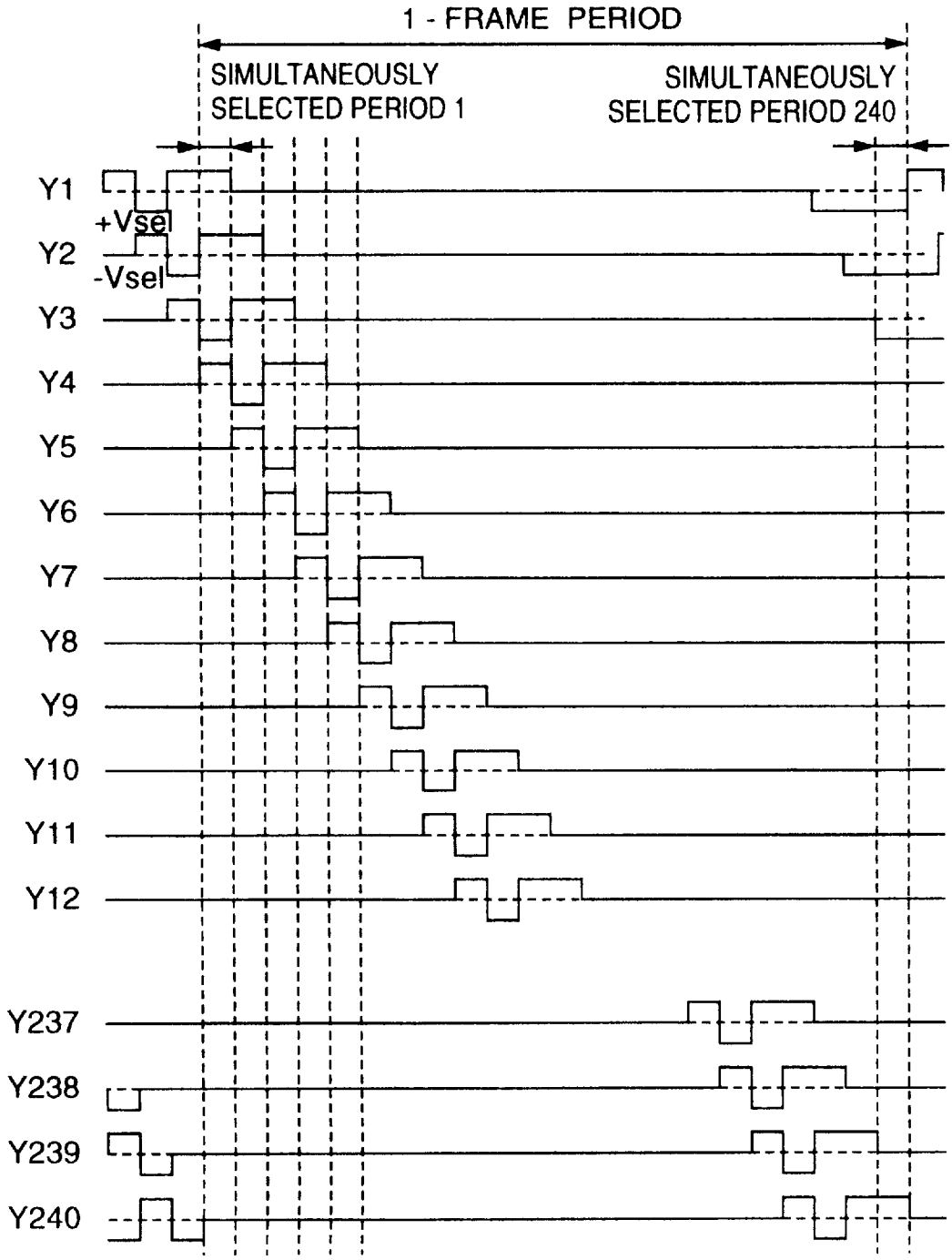
FIG. 29 shows scanning signal waveforms for simultaneously selecting a plurality of scanning electrodes of a passive matrix type liquid crystal panel and which illustrates a basic concept of a second embodiment of the present invention.

FIG. 29 shows an example of waveforms of signals applied to the scanning electrodes when a plurality of row scanning electrodes of a passive matrix type liquid crystal panel are selected at the same time and the selected row is shifted to a lower row one by one.

In FIG. 29, there are 240 scanning electrodes of the liquid crystal panel and these electrodes are assumed to be Y1 to Y240. The row scanning electrodes are driven by four rows at the same time and the row scanning electrodes are shifted to a lower row one by one at intervals of divided time t. Accordingly, the four-row simultaneous scanning operation is performed 240 times (240t) in one frame as the whole liquid crystal panel, so that the scanning signal is applied to all of the scanning electrodes during 4t in one frame. The period t that a plurality of row scanning electrodes are selected at the same time is named a "simultaneous selection period". The simultaneous selection period of the embodiment corresponds to a quarter of the divided period of the first embodiment. The scanning electrodes Y1 to Y4 are selected to be driven in the first simultaneous selection period 1, the scanning electrodes Y2 to Y5 in the simultaneous selected period 2, and the scanning electrodes Y3 to Y6 in the simultaneous selection period 3. Similarly, the scanning electrodes are selected to be driven successively by four rows and in the last simultaneous selection period 240 the scanning electrodes Y1 to Y3 are selected to be driven. The waveforms shown in FIG. 29 are schematically illustrated as in FIG. 30. In FIG. 29, the scanning electrodes selected in each simultaneous selection period are applied with +Vsel or −Vsel and other unselected scanning electrodes are applied with 0[V]. The driving voltage of the liquid crystal panel in the embodiment is the same as that of the first embodiment. In the second embodiment, the period that one row is selected in one frame is equal to four simultaneous selection periods (4t) since it is the same as the divided period of the first embodiment. A "selection period" described in the claims corresponds to four simultaneous selection periods of the second embodiment.

The liquid crystal display unit based on the above basic concept is now described with reference to FIGS. 31 to 47.

Figure 31:
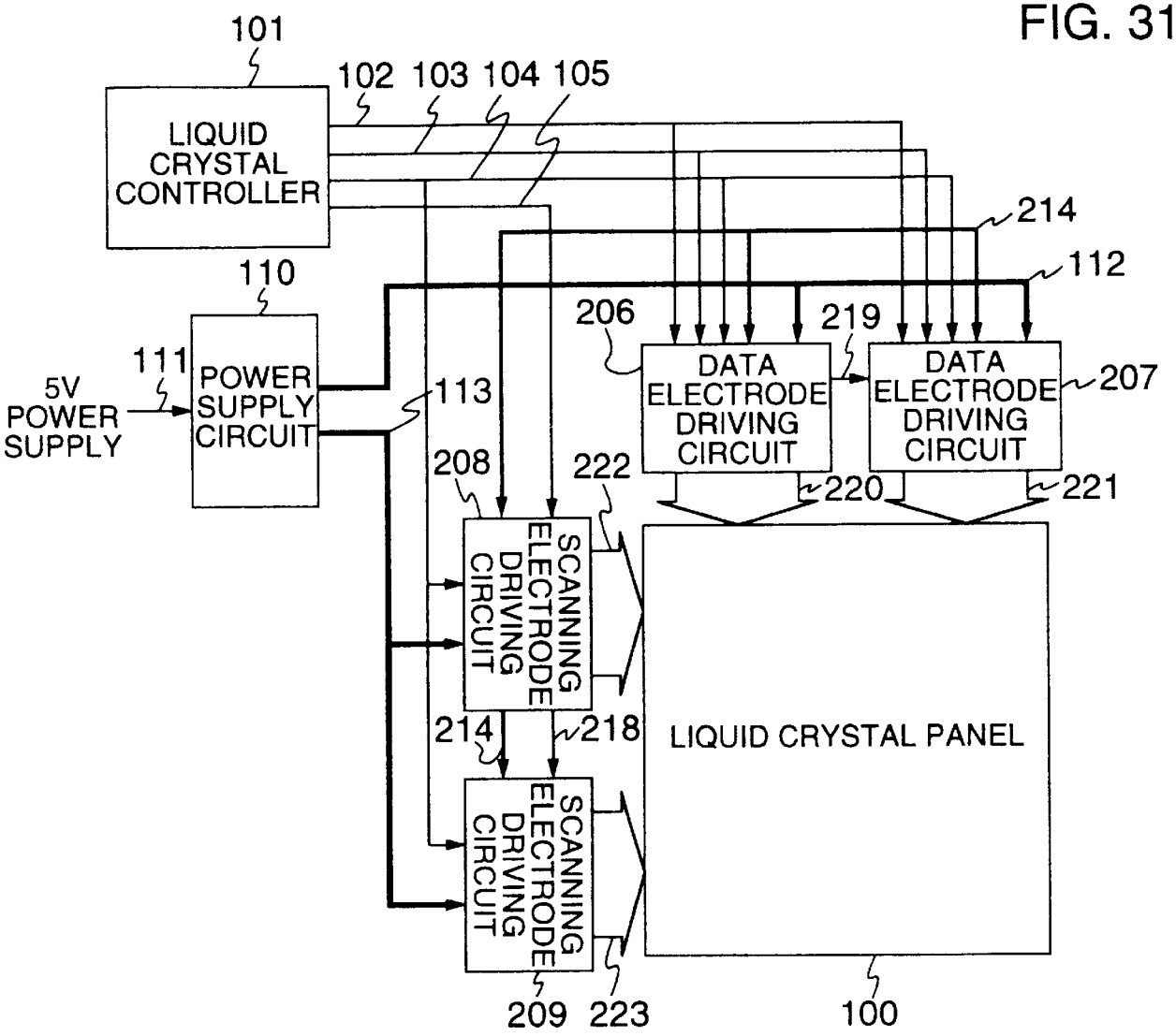
FIG. 31 is a schematic diagram illustrating a liquid crystal display system according to the second embodiment of the present invention.

As shown in FIG. 31, the liquid crystal display unit according to the second embodiment of the present invention includes a liquid crystal panel 100, a liquid crystal controller 101, data electrode driving circuits 206 and 207, scanning electrode driving circuits 208 and 209, and a power supply circuit 110. The elements designated by the same reference numerals as those of FIG. 2 showing the first embodiment have the same function.

The outline of the second embodiment is first described.

The scanning electrode driving circuits 208 and 209 produce scanning function data 214 from the line clock 104 and the first line marker clock 105 and supply scanning electrode driving voltages 222 and 223 to the liquid crystal panel 100.

The display data 102 are supplied to the data electrode driving circuits 206 and 207 in synchronism with the data latch clock 103. Further, the scanning function data 214 produced by the scanning electrode driving circuit 208 are also supplied to the data electrode driving circuits 206 and 207. The data electrode driving circuits 206 and 207 perform a predetermined operation between the scanning function data 214 and the four-line display data supplied thereto and supply data electrode driving voltages 220 and 221 based on a result thereof to the liquid crystal panel 100.

The power supply circuit 110 produces the power supply voltage 112 for the data electrode driving circuit from the 5V power supply 111 and supplies the voltage to the data electrode driving circuits 206 and 207. Further, the power supply circuit 110 produces the power supply voltage 113 for the scanning electrode driving circuit and supplies the voltage to the scanning electrode driving circuits 208 and 209. The power supply voltage 112 for the data electrode driving circuit consists of 5 level voltages (Vx0, Vx1, Vx2, Vx3, and Vx4). The power supply voltage 113 for the scanning electrode driving circuit consists of 3 level voltages (Vy0, Vy1 and Vy2). The levels of the power supply voltages produced by the power supply circuit 110 are the same as those of the first embodiment.

The abovementioned portions are now described in detail by citing an example for each portion.

The scanning electrode driving circuits.208 and 209 are described with reference to FIGS. 32 to 40 and the data electrode driving circuits 206 and 207 are described with reference to FIGS. 41 to 44.

First of all, the scanning electrode driving circuit 208 is described with reference to FIGS. 32 to 40.

Figure 32:
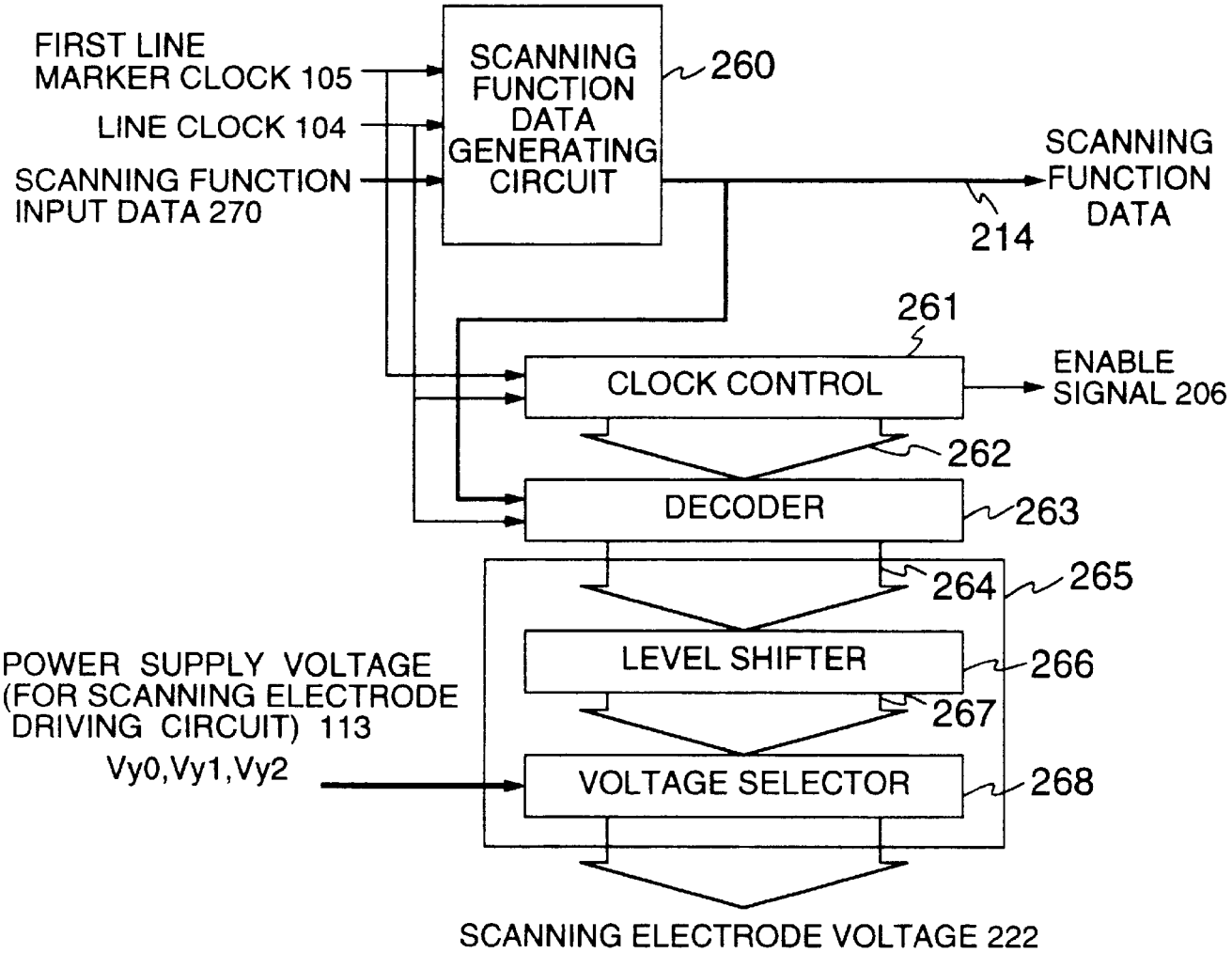
FIG. 32 is a block diagram illustrating a scanning electrode driving circuit 208, 209 in detail.

As shown in FIG. 32, the scanning electrode driving circuit 208 includes a scanning function data generating circuit 260, a clock control circuit 262, a decoder 263 and an output circuit 265 (a level shifter 266 and a voltage selector 268).

The clock control circuit 261 produces a clock control output 262 and an enable signal 206 from the first line marker clock 105 and the line clock 104. On the other hand, the scanning function generating circuit 260 produces the scanning function data 214 in synchronism with the line clock 104. The scanning function data 214 and the clock control output 262 are supplied to the decoder 263, which supplies a decoder output 264 to the output circuit 265. The output circuit 265 includes a level shifter 266 and a voltage selector 268. The voltage selector 268 selects one of three level voltages of the power supply voltage 113 for the scanning electrode driving circuit and produces the voltage of the selected level as the scanning electrode driving voltage 222.

Figure 33:
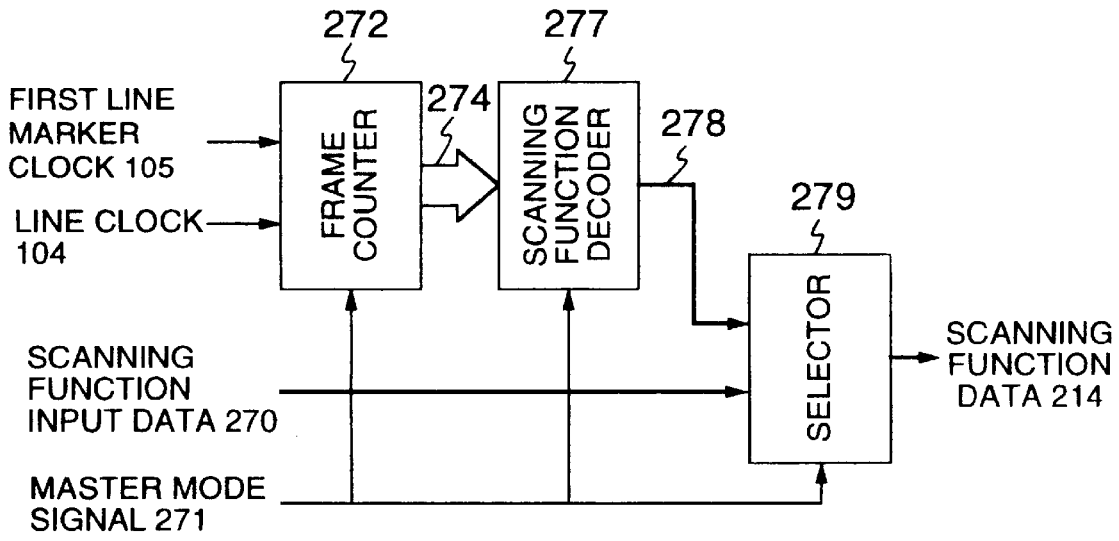
FIG. 33 is a block diagram illustrating a scanning function generating circuit 260 in detail.

Portions constituting the scanning function generating circuit 260 shown in FIG. 32 are now described with reference to FIGS. 33 to 35. FIG. 33 is a schematic diagram illustrating the internal configuration of the scanning function generating circuit 260 and FIG. 34 is a timing diagram showing operation thereof.

As shown in FIG. 33, the scanning function generating circuit 260 includes a frame counter 272, a scanning function decoder 277 and a selector 279.

Figure 34:
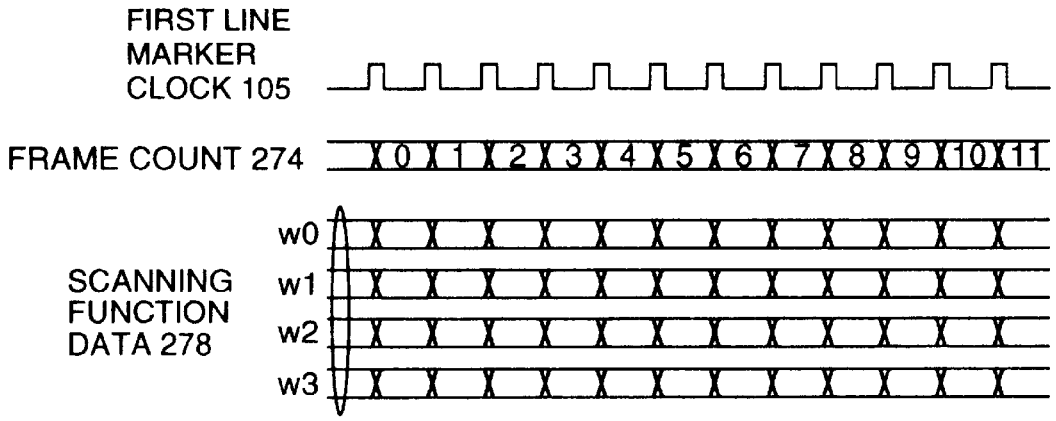
FIG. 34 is a timing diagram illustrating operation of the scanning function generating circuit 260.

As shown in FIGS. 33 and 34, the frame counter 272 takes in the first line marker clock 105 by the line clock 104 to count the first line marker clock and generate a frame count 274. The scanning function decoder 277 generates a predetermined scanning function data 278 on the basis of the frame count 274. The scanning function data 278 is to be updated each time the first line marker clock 105 is supplied.

The selector 279 performs different operations depending on whether the scanning electrode driving circuit 208,209 is operated in the master driving state or the slave driving state. In the master driving state, the selector 279 outputs the scanning function data 278 generated by the scanning function data 277 as the scanning function data 114. On the other hand, in the slave driving state, the selector 279 outputs a scanning function input data 270 supplied externally of the scanning electrode driving circuit as the scanning function data 214. Designation as to whether the scanning electrode driving circuit is operated in the master driving state or the slave driving state is made by a master mode signal 271. In the slave driving state, the frame counter 272 and the scanning function decoder 277 are stopped.

Figures 35, 36:
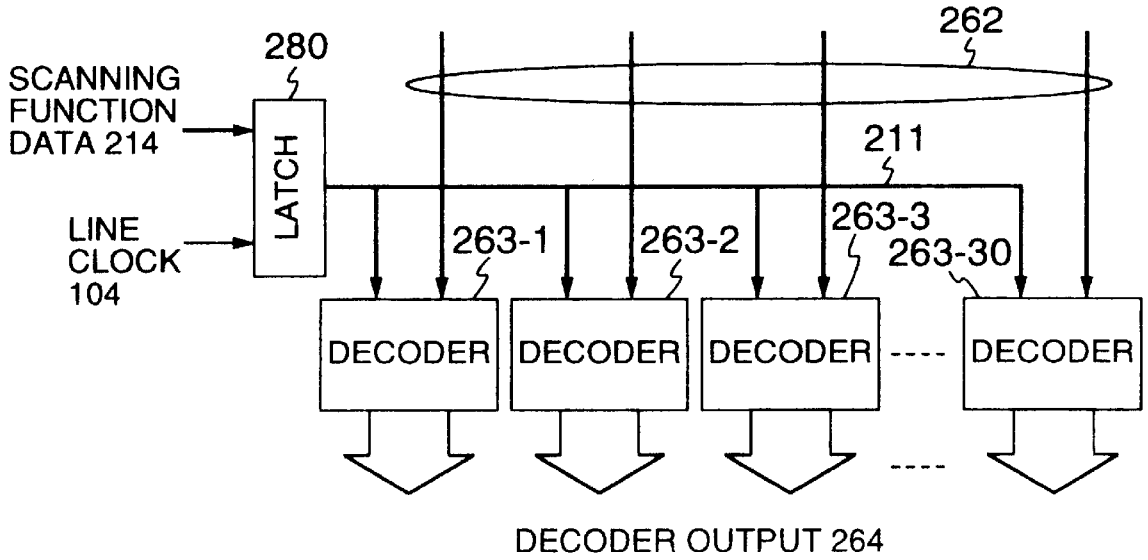
FIG. 35 shows an example of scanning function data generated by the scanning function generating circuit 260.
FIG. 36 is a schematic diagram illustrating a decoder 263 in detail.

An example of the scanning function data 278 produced by the scanning function decoder 277 is shown in FIG. 35. In FIG. 35, when the frame count 274 of the frame counter 272 is 0, the scanning function data 278 is w0=1, w1=0, w2=1 and w3=1. When the frame count 272 is 1, the scanning function data 278 is w0=0, w1=1, w2=0 and w3=0. When the frame count 278 is 2, the scanning function data 278 is w0=0, w1=0, w2=0 and w3=1. Similarly, the scanning function data 278 are produced in accordance with FIG. 35.

An example of the decoder 263 (see FIG. 32) is described with reference to FIG. 36. The decoder 263 includes a latch 280 and decoders 263-1, 263-2, 263-3, . . . , 263-30. Elements corresponding to those of FIG. 32 are designated by the same reference numerals. In FIG. 36, the decoder 263 produces the decoder data 264 in accordance with the output 262 of the clock control circuit and the scanning function latch data 211 latched in the latch 280.

Figure 37:
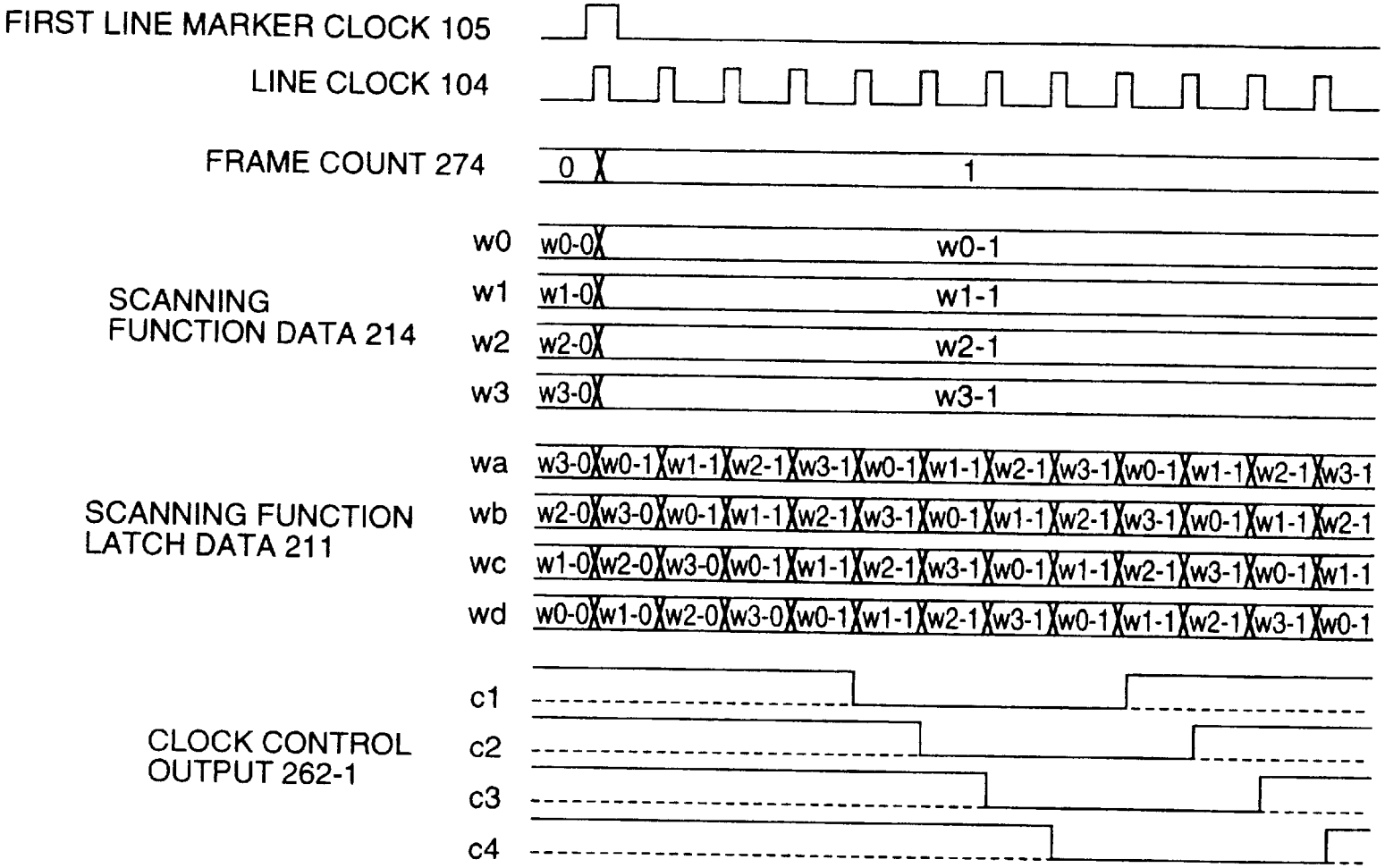
FIG. 37 is a timing diagram illustrating operation of the decoder 263.

A timing of the scanning function latch data 211 produced by the latch circuit 280 (see FIG. 36) and the output 262 of the clock control circuit 261 is shown in FIG. 37. As shown in FIG. 37, four data w0, w1, w2 and w3 of the scanning function data 214 are successively selected by the line clock 104 to form wa of the scanning function latch data 211. The data wa is latched by the line clock 104 successively to thereby form wb, wc and wd of the scanning function latch data 211. Further, the clock control circuit 261 produces c1 having a logic 0 for four clocks produced successively from the fourth line clock after the first line marker clock 105 is applied. Further, the output cl is latched by the line clock 104 successively to produce c2, c3 and c4.

Figure 38:
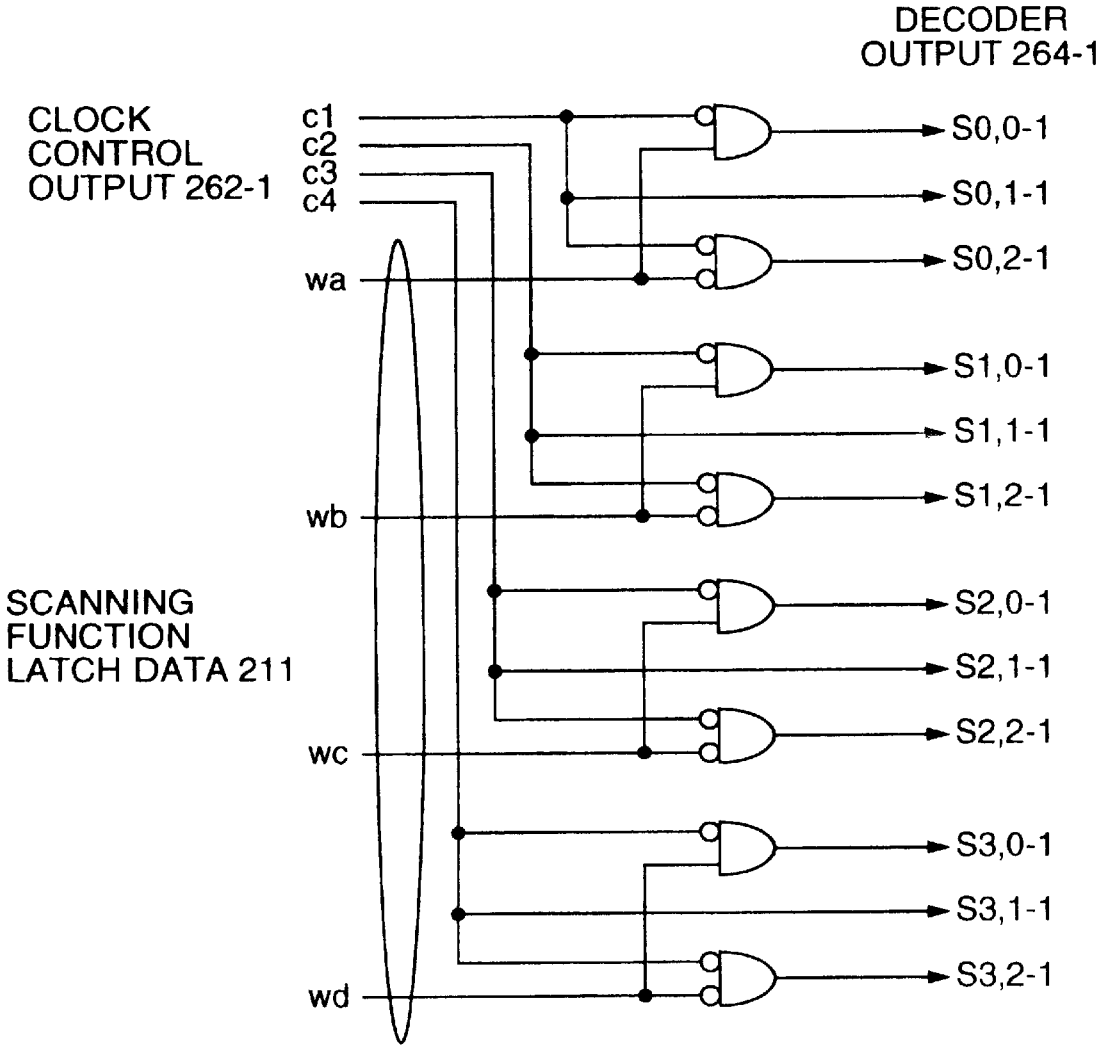
FIG. 38 is a schematic diagram illustrating a decoder 263-1 in detail.

The decoders 263-1 to 263-30 are constituted as shown in FIG. 38. The decoder 263-1 is selected when the output 262-1 of the clock control circuit 261 is a logic 0 and is not selected when the output is a logic 1. When selected, the decoder output 264-1 in accordance with the logic of the scanning function latch data 211 is supplied to the output circuit 265. The decoders 263-2 to 263-30 are also identical.

Figure 39:
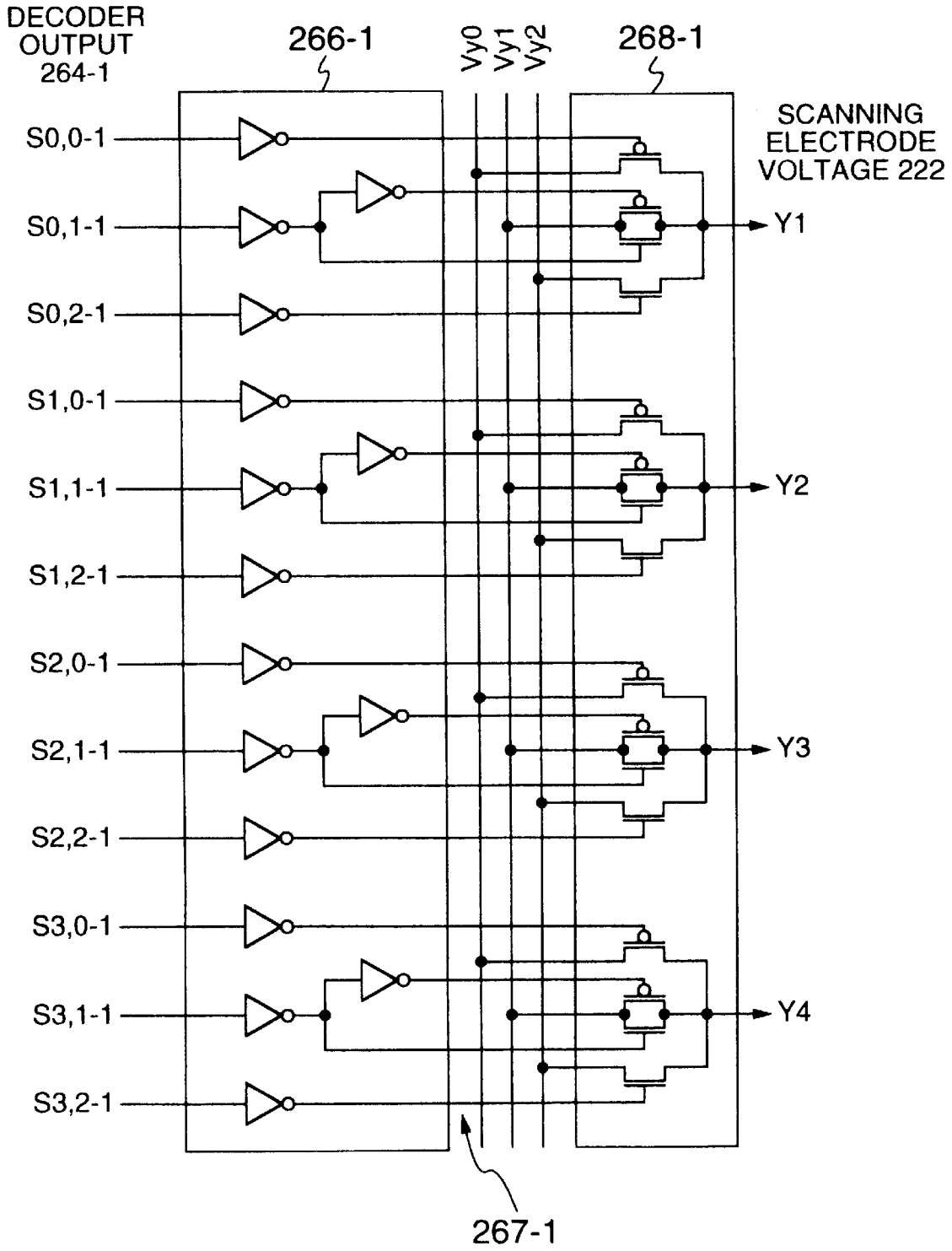
FIG. 39 is a schematic diagram illustrating an output circuit 265 in detail.
Figure 40:
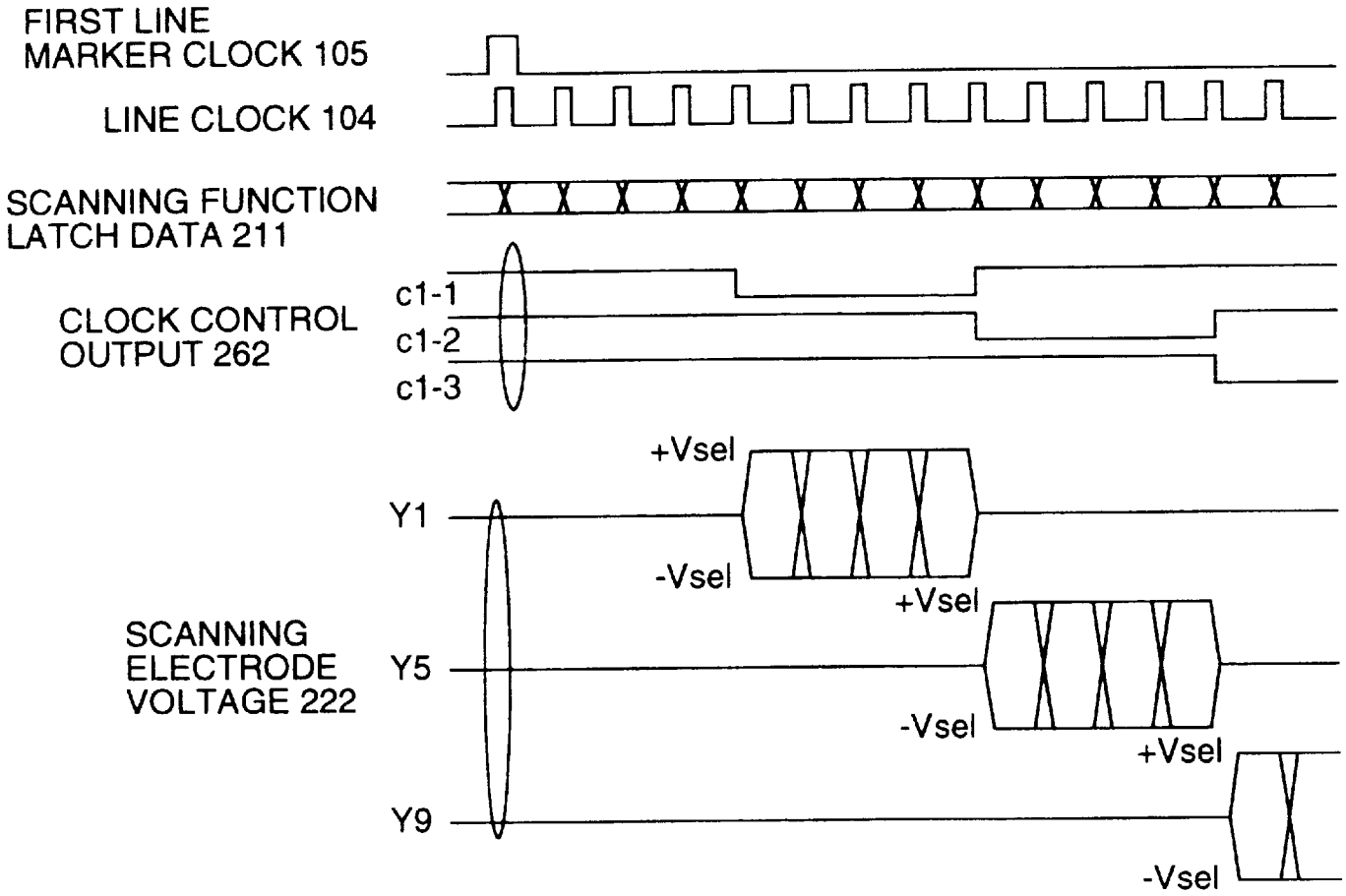
FIG. 40 is a timing diagram illustrating operation of the scanning electrode driving circuit 208, 209.

An example of the output circuit 265 (see FIG. 32) is now described with reference to FIG. 39.

Portions corresponding to those of FIG. 32 are designated by the same reference numerals. In FIG. 39, the levels of the decoder outputs 264-1 are shifted by the level shifter 266-1 and the voltage selector 268-1 is operated by outputs 267 thereof. When the corresponding decoder 263-1 is selected, the voltage selector 268-1 is operated in accordance with the decoder output 264-1. That is, when scanning function latch data 211 is a logic 1, the voltage vy0 (+Vsel shown in FIG. 40) is selected and when the scanning function latch data 211 is a logic 0, the voltage Vy2 (−Vsel shown in FIG. 40) is selected to be produced as the scanning electrode voltage 222. On the other hand, when not selected, the voltage selector 268-1 produces Vy1 (0V) as the scanning electrode voltage 222 irrespective of the logic of the scanning function latch data 211.

The scanning electrode driving circuit 208 of FIG. 31 has been described, while the other scanning electrode driving circuit 209 is also identical. However, since the scanning electrode driving circuit 209 is operated in the slave driving state differently from the scanning electrode driving circuit 208, the scanning function generating circuit 260 (see FIG. 33) becomes the slave mode. That is, since the selector 279 of FIG. 33 is operated in the slave driving state, the scanning function data 214 is operated to select the externally supplied scanning function input data 270 (in this case, the scanning function data 214 produced by the scanning electrode driving circuit 208 is inputted).

An example of the data electrode driving circuit 206, 207 shown in FIG. 31 is now described with reference to FIGS. 41 to 44.

Figure 41:
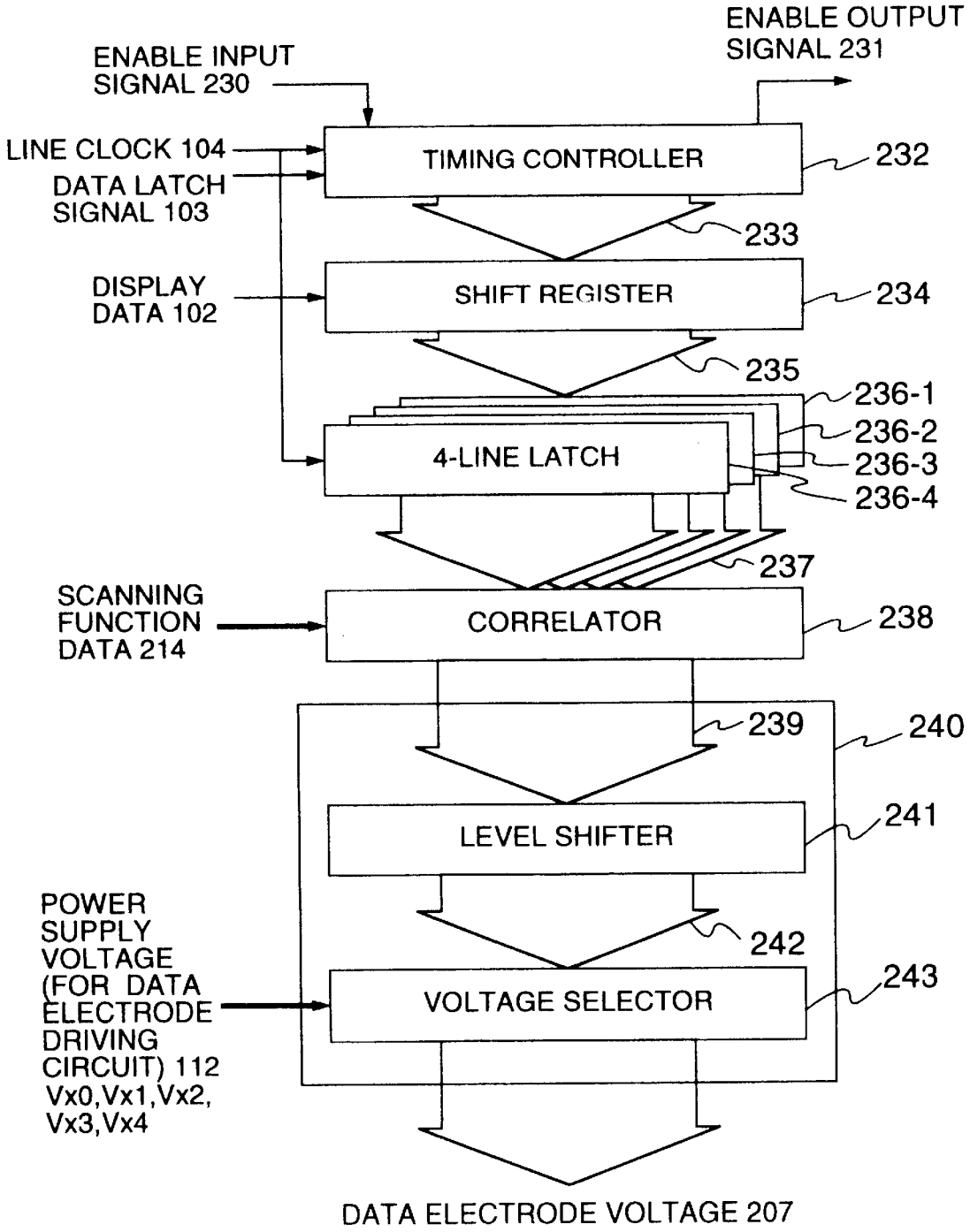
FIG. 41 is a block diagram schematically illustrating a data electrode driving circuit 206, 207 in detail.
Figure 42:
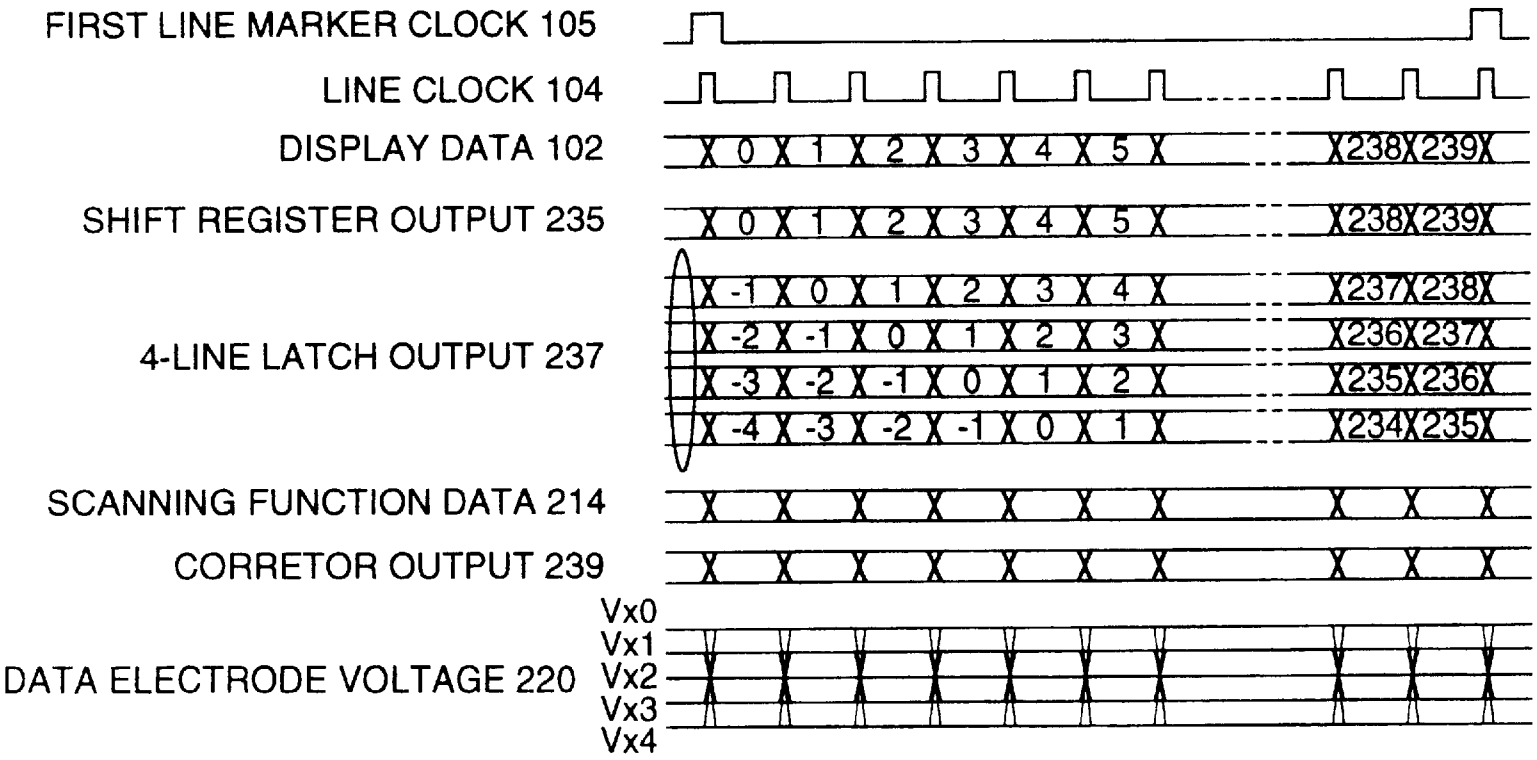
FIG. 42 is a timing diagram illustrating operation of the data electrode driving circuit 206, 207.

As shown in FIG. 41, the data electrode driving circuit 206, 207 includes a timing controller 232, a shift register 234, four-line latches 236-1 to 236-4, a correlator 238, an output circuit 240 (a level shifter 241 and a voltage selector 243). Signals corresponding to signals shown in FIG. 31 are designated by the same reference numerals.

In FIG. 41, an enable input signal 230 is to control operation and non-operation of the data electrode driving circuit. An enable output signal 231 is supplied to an enable input of a next data electrode driving circuit when a plurality of data electrode driving circuits are connected.

The timing controller 232 produces a shift clock 233 and the enable output signal 231 on the basis of the line clock 104 and the data latch clock 103. The shift register 234 takes in the display data at the timing of the shift clock 233 successively. When the taking in of the display data is completed, the display data is outputted as a shift register output 235. The four-line latch 236 latches the shift register output 235 by the line clock 104 successively and produces a latch output 237. The correlator performs a predetermined operation from the latch output 237 and the scanning function data 214. The level shifter 241 in the output circuit 240 produces an output 239 of the correlator 238 as a level shift output 242. Then, the voltage selector 243 selects one of five level voltages of the power supply voltage 112 for the data electrode driving circuit and produces the selected voltage as a data electrode voltage 207.

Figure 43:
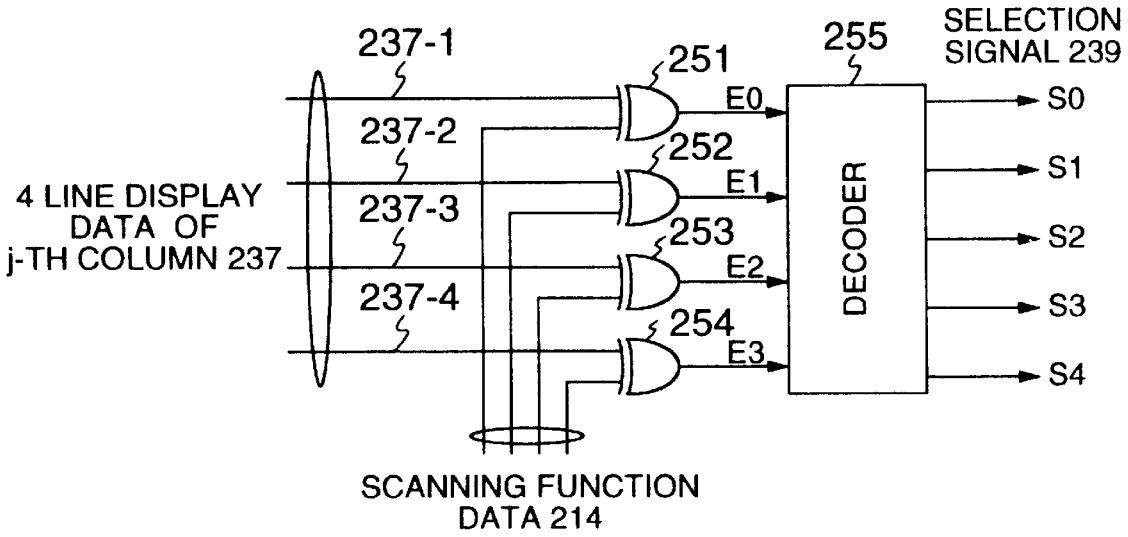
FIG. 43 is a schematic diagram illustrating a correlator 238 in detail.
Figure 44:
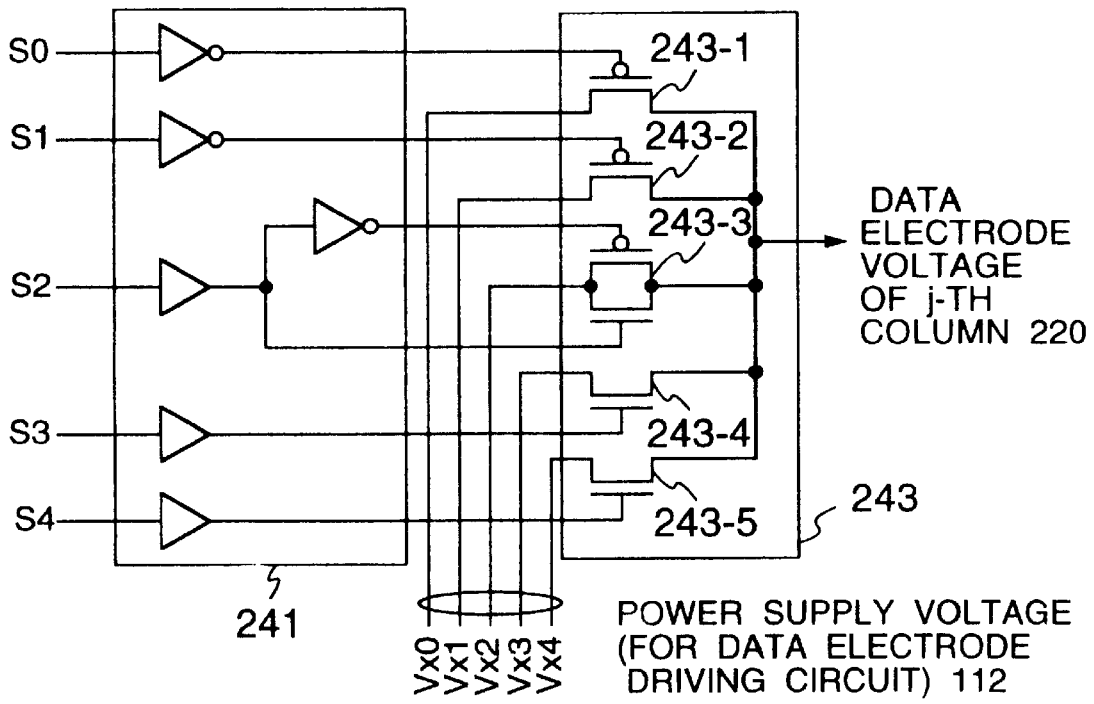
FIG. 44 is a schematic diagram illustrating an output circuit 240, and a level shifter 241 and a voltage selector 243 constituting the output circuit 240 in detail.

As shown in FIG. 43, the correlator 238 (see FIG. 41) includes exclusive OR circuits 251 to 254 and a decoder 255. The level shifter 241 and the voltage selector 243 (see FIG. 41) of the output circuit 240 include output transistors 243-1 to 243-5 as shown in FIG. 44. Portions corresponding to those of FIG. 39 are designated by the same reference numerals. The definite examples shown in FIGS. 43 and 44 are identical with FIGS. 16 and 17 described in the first embodiment and accordingly detailed description thereof is omitted.

When the scanning function data shown in FIG. 35 is used to drive the liquid crystal panel, flickering of display is apt to occur. The reason is that a direct current component of an applied voltage between the frames is increased since the same data electrode voltage is applied in each frame. For example, when one certain column is all displayed "ON", the four-line display data 237 of the j-th column are all logic 0 indicative of display "ON". On the other hand, the scanning function data is w0=1, w1=0, w2=1 and w3=1 when the frame counter 274 is 0. Since the number of coincidence therebetween is 1 during one frame period, the data electrode voltage 220 is Vx1. Since the scanning function data is w0=0, w1=1, w2=0 and w3=0 when the frame count 274 is 1, the coincidence number between the display data 237 is 3 during one frame period and the data electrode voltage 220 is Vx3. Similarly, when the frame count 274 is 2, the data electrode voltage 220 is Vx1 and when the frame count 274 is 3, the data electrode voltage 220 is Vx3.

As a method of solving this problem, it is considered that a combination of scanning function data is changed as in the first embodiment. This method is described with reference to FIGS. 45 to 47.

Figure 45:
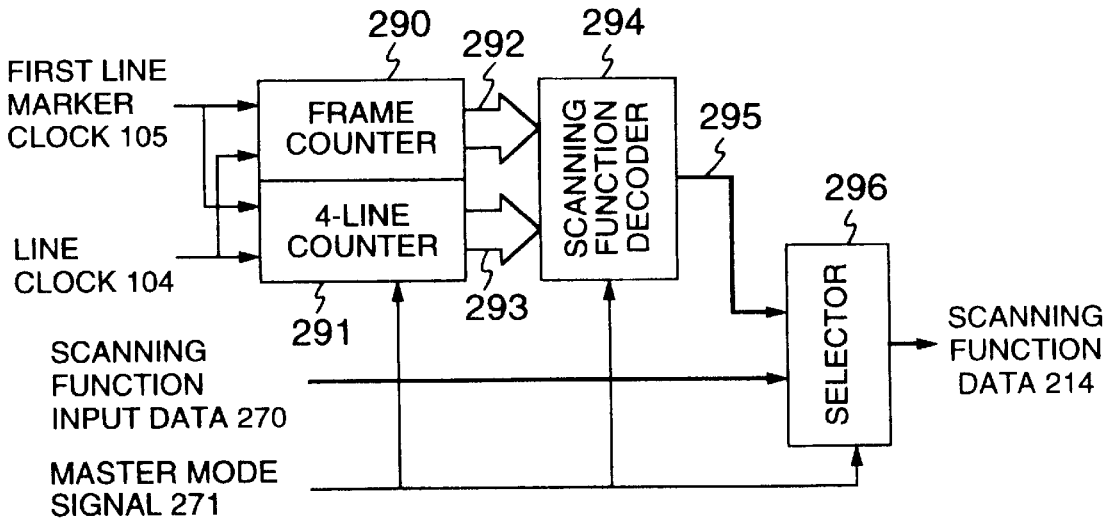
FIG. 45 is a block diagram schematically illustrating the scanning function generating circuit 260 in detail.
Figure 47:
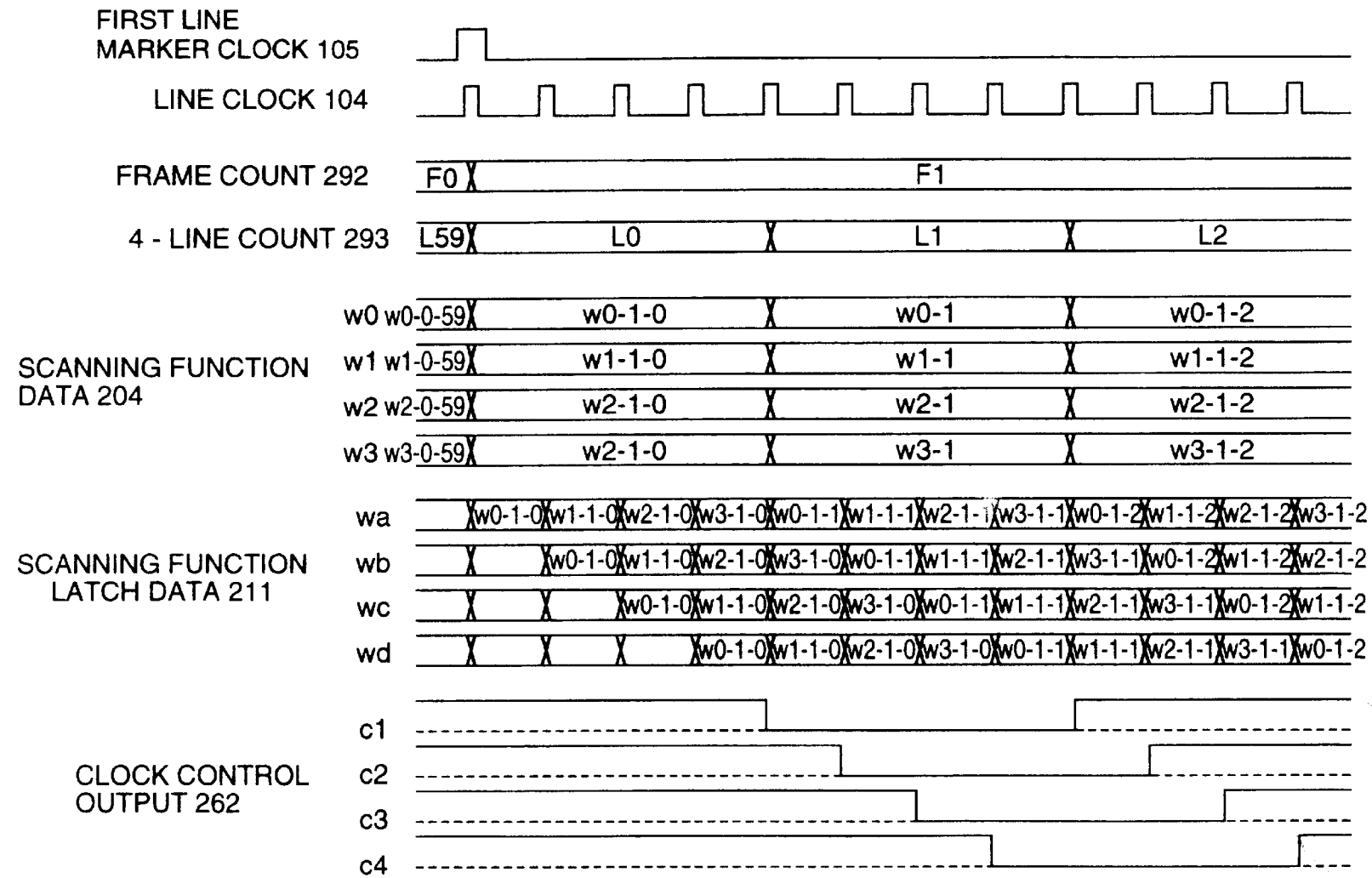
FIG. 47 is a timing diagram illustrating operation of the decoder 263 in case where the scanning function data generated by the scanning function generating circuit 260 shown in FIG. 45 is used.

FIG. 45 is a block diagram showing another definite example of the scanning function generating circuit 260 of the second embodiment. In FIG. 45, the scanning function generating circuit 260 includes a frame counter 290, a four-line counter 291, a scanning function decoder 294, and a selector 296. FIG. 46 shows an example of scanning function data generated by the scanning function generating circuit 260.

In FIG. 45, the frame counter 290 takes in the first line marker clock 105 by the line clock 104 to count the first line marker clock 105 and produces a frame count 292. The four-line counter 291 counts the line clock 104 to produce a four-line count 293. The four-line count 293 is reset by the first line marker clock 105. The scanning function decoder 294 produces a scanning function data 295 shown in FIG. 46 on the basis of the frame count 292 and the four-line count 293. The selector 296 operates in the same manner as the selector 279 shown in FIG. 33.

The above operation is described again with reference to FIG. 47. When the scanning electrode driving circuit is operated in the master driving state, the scanning function data 214 is updated each time the frame count 292 and the four-line count 293 are changed. When the liquid crystal panel is driven by this definite example and, for example, one certain column is all displayed "ON", the four-line display data 237 of the j-th column are all logic 0 indicative of display "ON". On the other hand, the scanning function data is w0=1, w1=0, w2=1 and w3=1 when the frame counter 292 is 0 and the four-line count 293 is 0. In this case, the number of coincidence therebetween is 1 and the data electrode voltage 220 is Vx1. Further, since the scanning function data is w0=1, w1=1, w2=0 and w3=0 when the frame count 292 is 0 and the four-line count 293 is 1, the coincidence number between the display data 237 is 3 and the data electrode voltage 220 is Vx3. When the frame count 292 is 0 and similarly when the four-line count 293 is 2, the data electrode voltage 220 is Vx1, and when the four-line count 293 is 3, the data electrode voltage 220 is Vx3.

In this manner, when the scanning function generating circuit 260 shown in FIGS. 45 to 46 is used, the data electrode voltage which is different each time the four-line count 293 is changed during one frame period is applied. Accordingly, flickering caused by the direct current component during one frame period does not occur.

As described above, according to the second embodiment of the present invention, the number of the shift registers in the data electrode driving circuit is reduced from four lines to only one line as compared with the first embodiment and large effect is attained in the data electrode driving circuit (LSI) requiring compactness and small area. In the first embodiment, since the operation in the data electrode driving circuit is performed by taking in the display data for four lines, it is required that the number of displayed rows (line number) is set to be a multiple of 4. In the second embodiment, since the display data for one row is taken in and the operation is performed by the display data for four rows after latching the display data for four rows, there is an effect that the number of display rows is not limited. Further, in the first embodiment, since simultaneous scanning for four lines is performed in one divided period (4t), a stripe pattern (crosstalk) is produced on the liquid crystal display panel every four lines, whereas in the second embodiment since the simultaneous scanning for four lines is performed in one simultaneous selection period (1t) and the selected line is shifted every one row, the stripe pattern is difficult to occur.

A third embodiment is now described with reference to FIGS. 48 to 50.

In the third embodiment, the scanning function generating circuit included in the scanning electrode driving circuit of the first embodiment is disposed outside of the scanning electrode driving circuit.

Figure 48:
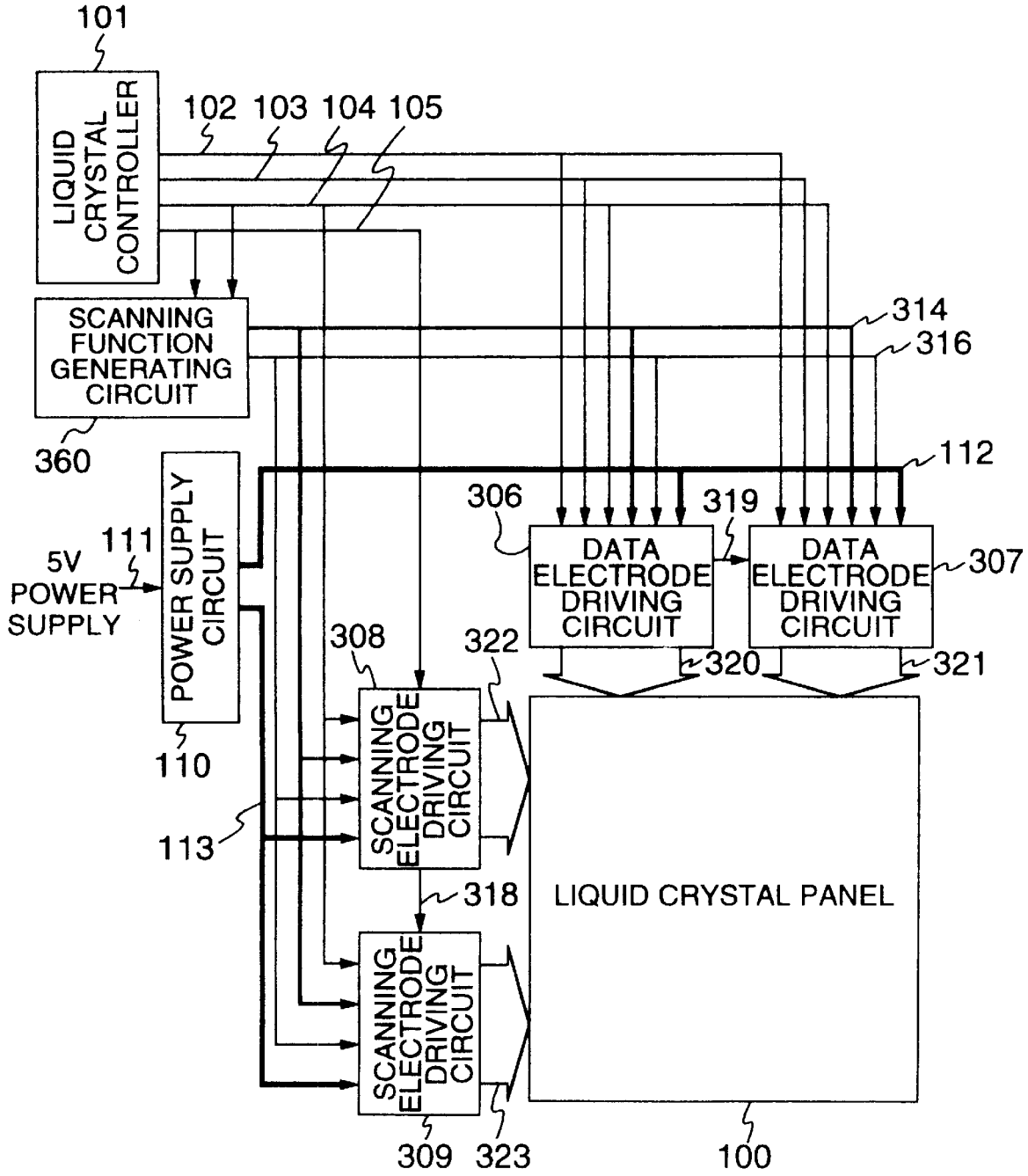
FIG. 48 is a schematic diagram illustrating a liquid crystal display system according to a third embodiment of the present invention.

The liquid crystal display unit of the third embodiment is shown in FIG. 48. In the liquid crystal display unit, the scanning function generating circuit 360, the scanning electrode driving circuits 308 and 309 are different from those of the embodiment 1. Components other than the above components are the same as those of FIG. 2.

Figure 50:
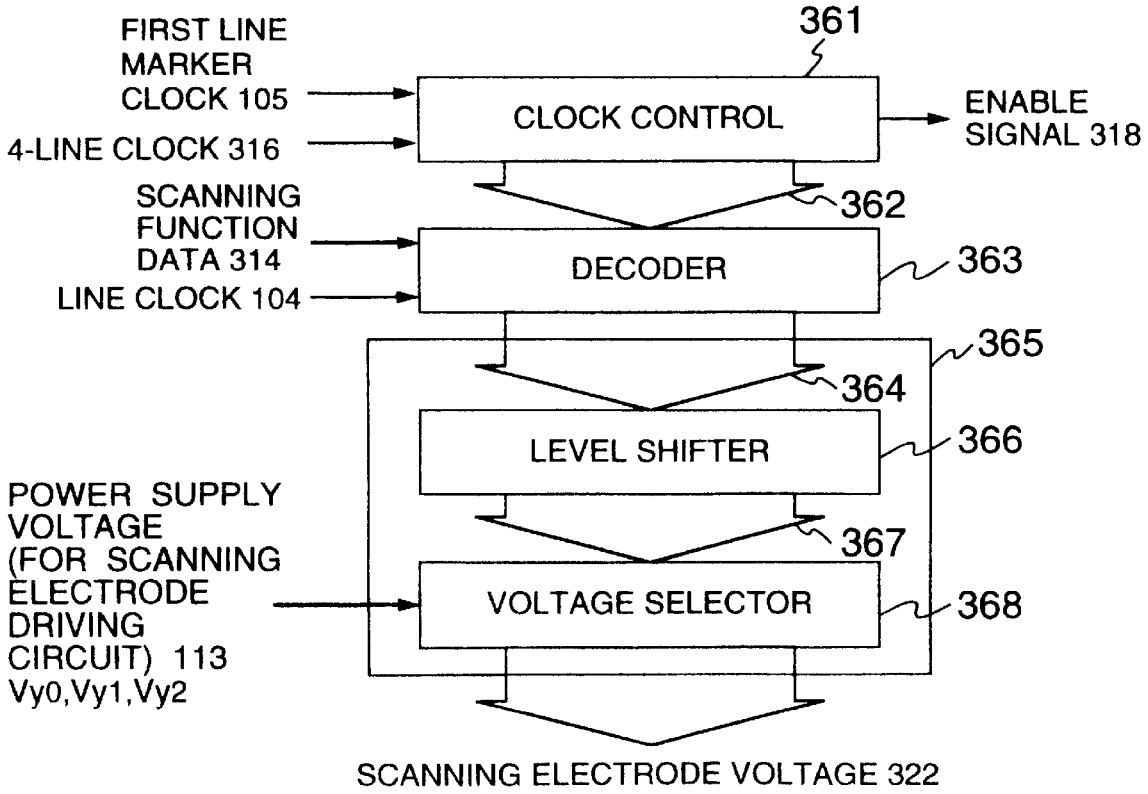
FIG. 50 is a block diagram illustrating a scanning electrode driving circuit 308, 309 in detail.

An example of the scanning electrode driving circuit 308, 309 is shown in FIG. 50. The function of each portion of the scanning electrode driving circuit 308, 309 is the same as that of the scanning electrode driving circuit 108, 109 shown in FIG. 6 except that the scanning function generating circuit 160 is not provided. The scanning electrode driving circuits 308 and 309 are used instead of the circuits 108 and 109 shown in FIG. 2 and can be operated in the slave driving state. As described above, the scanning function generating circuit is provided in the scanning electrode driving circuit 108, 109 in the embodiment 1, while in the third embodiment it is independently provided as the scanning function generating circuit 360. Accordingly, a scanning function data 314 (corresponding to the scanning function data 114 of the embodiment 1) and a four-line clock 316 (corresponding to the four-line clock 116 of the embodiment) are inputted from the scanning function generating circuit 360.

Figure 49:
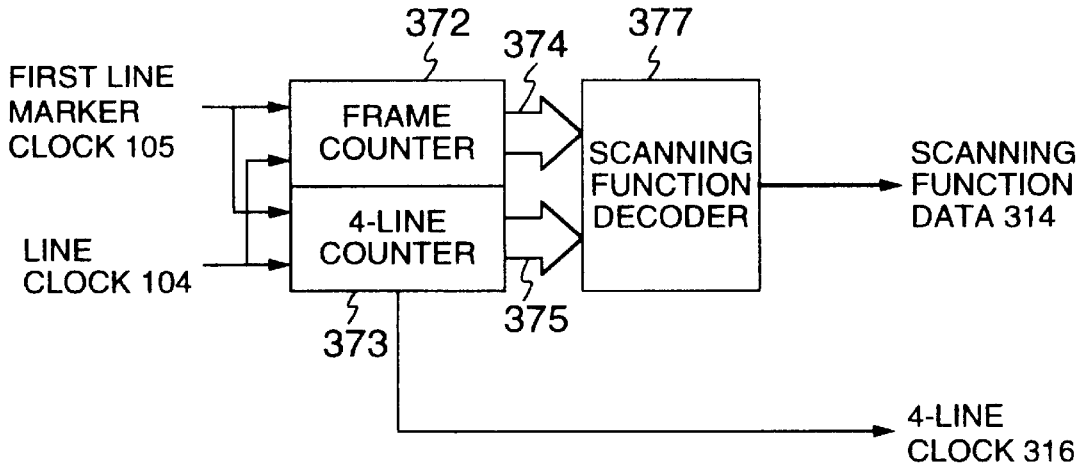
FIG. 49 is a block diagram illustrating a scanning function generating circuit 360 in detail.

An example of the scanning function generating circuit 360 is shown in FIG. 49. The function of each portion thereof is the same as that of the scanning function generating circuit 160 shown in FIG. 7 except that the selector 179 is not provided. The scanning function generating circuit 360 produces the scanning function data 314 and the four-line clock 316 to supply them to the data electrode driving circuits 306 and 307 and the scanning electrode driving circuits 308 and 309.

The data electrode driving circuits 306 and 307 are the same as the data electrode driving circuits 106 and 107 of the embodiment 1. In the embodiment 1, the scanning function data (114) and the four-line clock (116) are inputted from the scanning electrode driving circuit 108, while the scanning function data and the four-line clock are inputted from the scanning function generating circuit 360.

Figure 51:
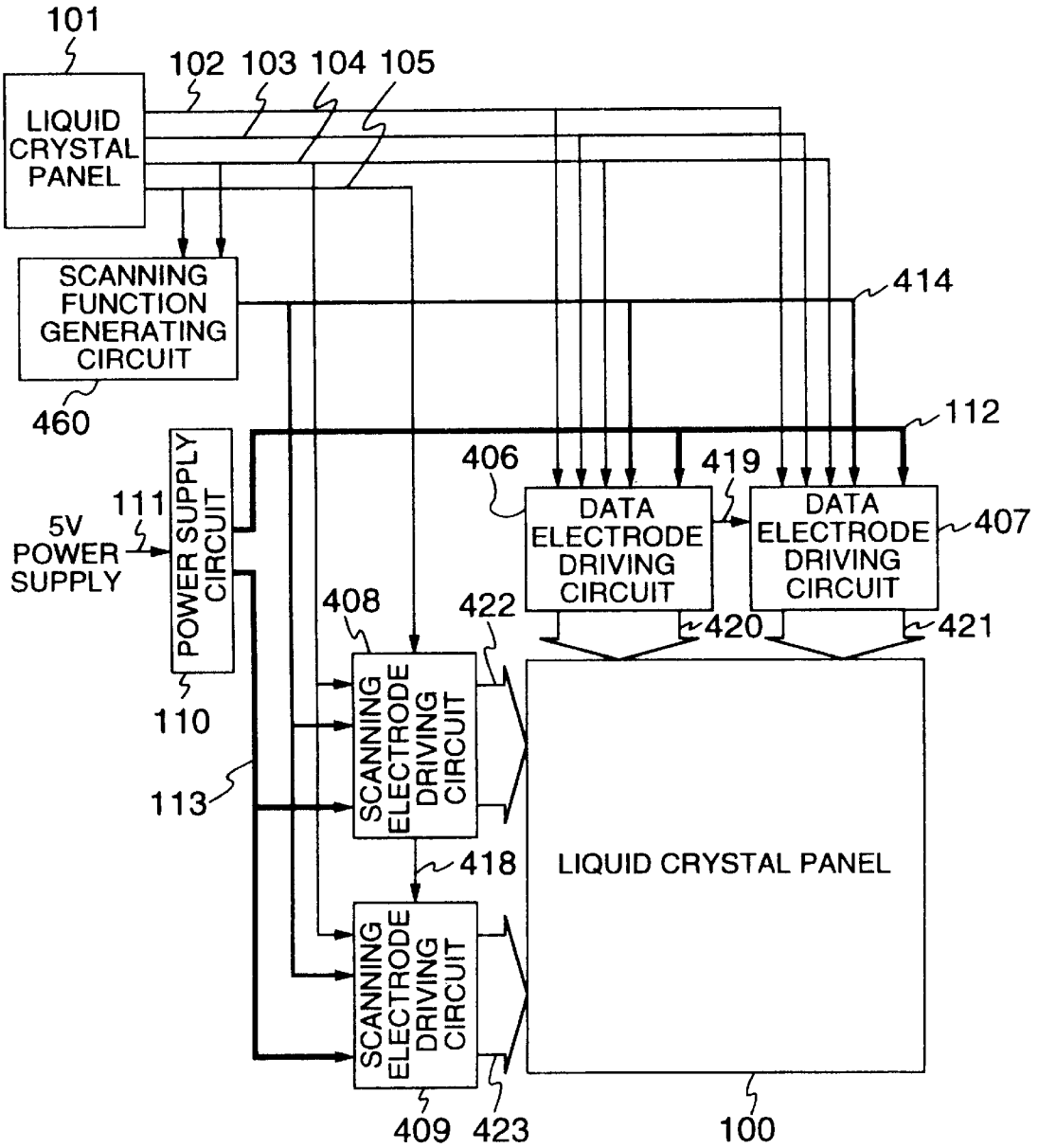
FIG. 51 is a schematic diagram illustrating a liquid crystal display system according to a fourth embodiment of the present invention.
Figure 52:
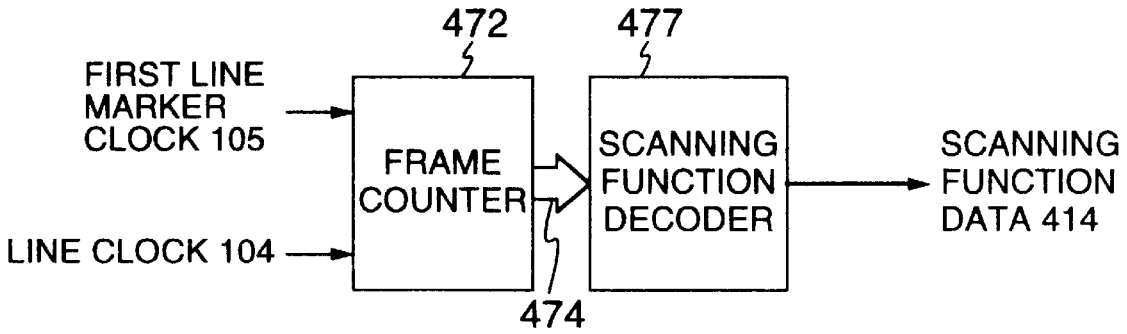
FIG. 52 is a block diagram schematically illustrating a scanning function generating circuit 460 in detail.
Figure 53:
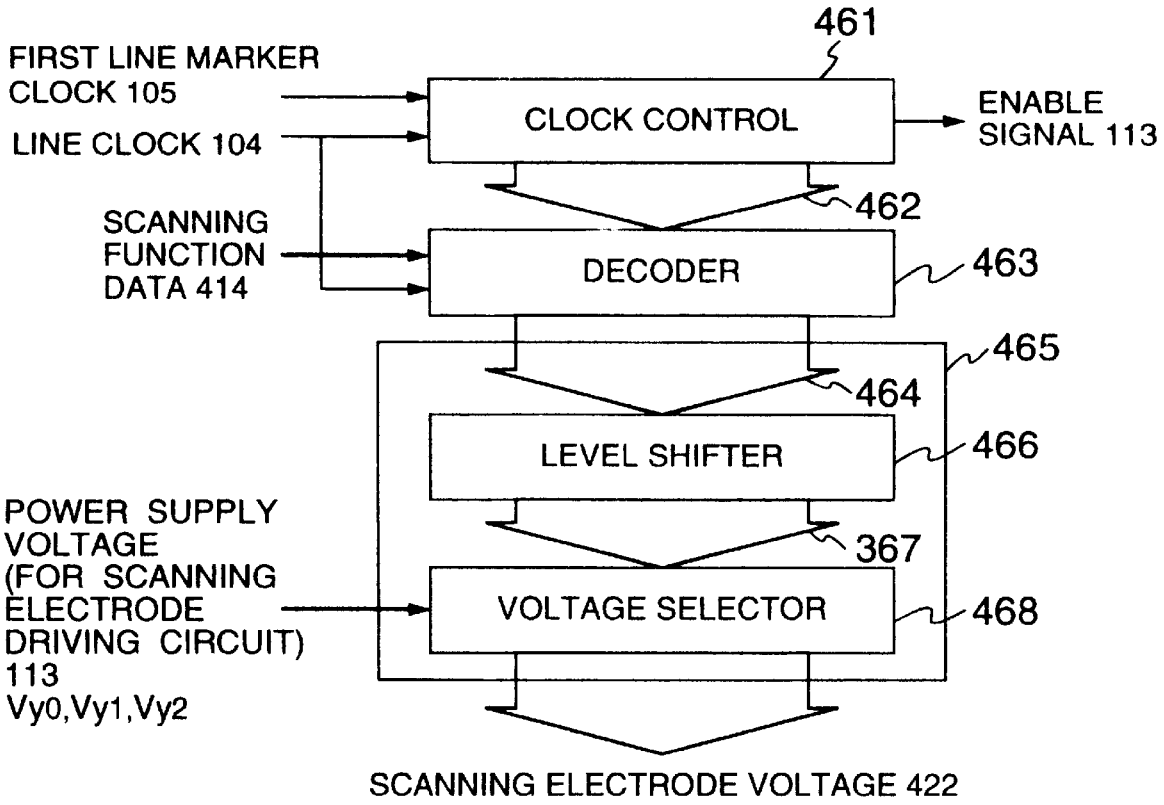
FIG. 53 is a block diagram schematically illustrating a scanning electrode driving circuit 408, 409.

A fourth embodiment is shown in FIGS. 51 to 53.

In the fourth embodiment, the scanning function generating circuit included in the scanning electrode driving circuits 208, 209 in the second embodiment is disposed outside of the scanning electrode driving circuit.

As shown in FIG. 51, a scanning function generating circuit 460 and scanning electrode driving circuits 408, 409 in the liquid crystal display unit are different from those of the embodiment 2. Other components are the same as those of the embodiment 2.

An example of the scanning function generating circuit 460 is shown in FIG. 52. The scanning function generating circuit 460 is the same as the scanning function generating circuit 260 shown in FIG. 33 except that the selector is not provided. The scanning function generating circuit 460 produces a scanning function data 414 to supply the data to the data electrode driving circuits 406 and 407 and the scanning electrode driving circuits 408 and 409.

An example of the scanning electrode driving circuits 408, 409 is shown in FIG. 53. The scanning electrode driving circuits 408, 409 are the same as the scanning electrode driving circuits 208, 209 shown in FIG. 32 except that the scanning function generating circuit 260 is not provided. The scanning electrode driving circuits 408, 409 are used instead of the scanning electrode driving circuits 208, 209 shown in FIG. 32 and can be operated in the slave driving state.

As described above, in the embodiment 2 the scanning function generating circuit is provided in the scanning electrode driving circuit 208, 209, while in the embodiment it is independently provided as the scanning function generating circuit 460. Accordingly, the scanning function data 414 (corresponding to the scanning function data 214 of the embodiment 2) is inputted from the scanning function generating circuit 460.

The data electrode driving circuits 406, 407 are the same as the data electrode driving circuits 206, 207 of the embodiment 2. However, the scanning function data (214) inputted from the scanning electrode driving circuit 208 in the embodiment 2 is inputted from the scanning function generating circuit 460.

As described above, in the present invention, the scanning function generating circuit includes the frame counter, the line counter and the decoder circuit for the counts, while its definite configuration is not limited thereto. For example, a data ROM may be used instead of the decoder circuit. In this case, any scanning function is set easily.

As described above, according to the first and second embodiments of the present invention, even when a plurality of simultaneous selection method is applied, the data electrode driving circuit, the scanning electrode driving circuit and the power supply circuit described in the embodiments can be used to implement the driving method of the liquid crystal display unit. Particularly, since the maximum permissible voltage or resistible voltage of the data electrode driving circuit can be reduced greatly, the power consumption of the liquid crystal display unit can be reduced.

Figure 28:
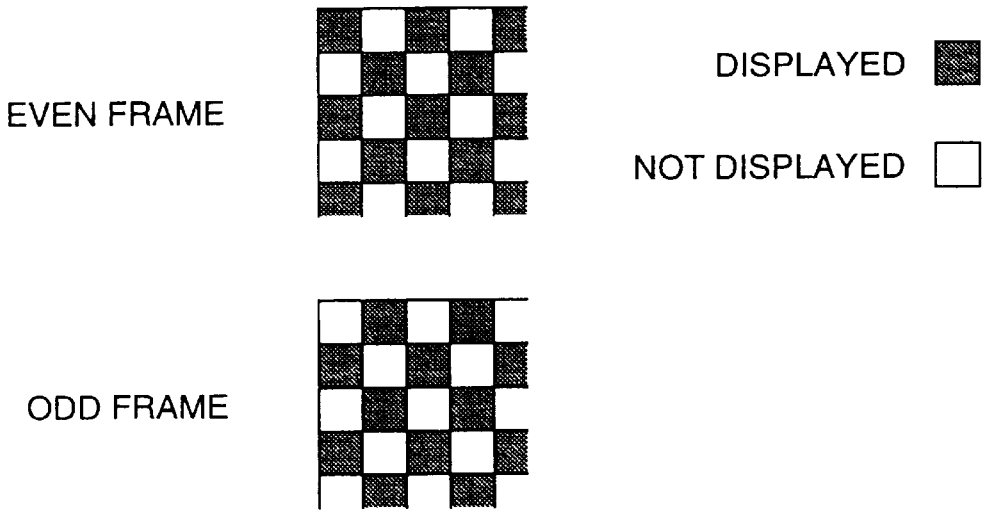
FIG. 28 is a schematic diagram illustrating a frame rate control gradation display method.
Figure 30:
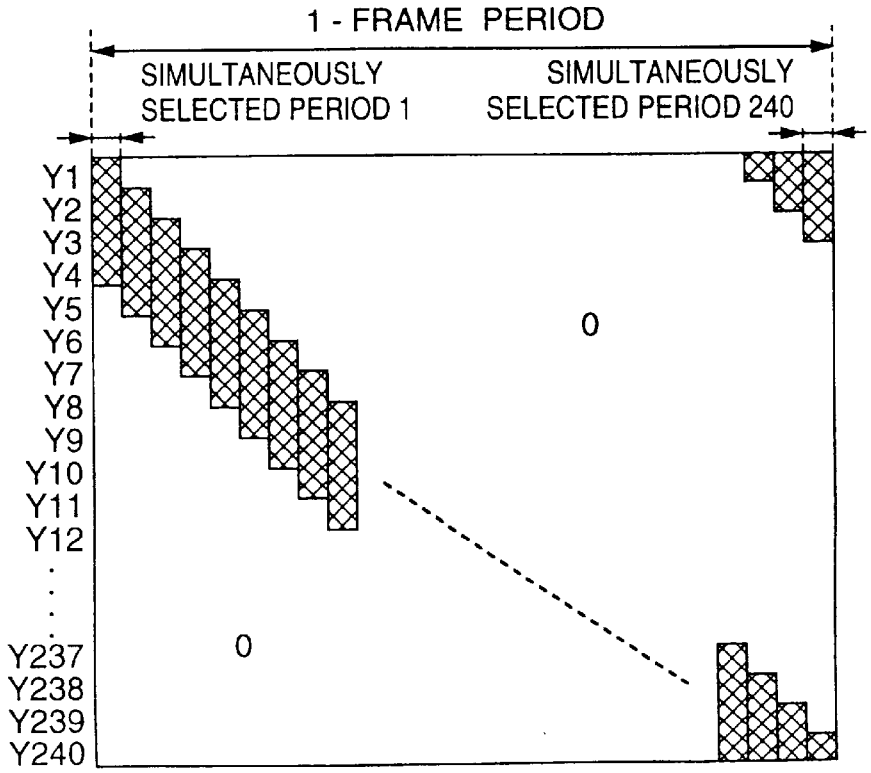
FIG. 30 is a schematic diagram illustrating the waveforms of FIG. 29.

Further, the liquid crystal controller generally adopts the frame rate control gradation display system (refer to "Liquid Crystal Device Handbook", the Japan Society for the Promotion of Science, No. 142 Committee) as a method of realizing the gradation display. An example of the frame rate control gradation display system is described with reference to FIG. 28. FIG. 28 shows the display data for performing a half gradation corresponding to the halftone of on and off in which one frame of two frames is displayed "ON" and the remaining one frame is displayed "OFF". The display data includes four dots consisting of two rows and two columns and which are controlled to be turned on and off into the lattice form. Accordingly, when the half gradation display is performed in the whole display screen of the liquid crystal panel, flickering of the display screen due to turning on and off is prevented. In the frame rate control gradation display system, the display data are necessarily determined to be on or off for one dot in each frame, there is no problem particularly even if it is applied to the liquid crystal display unit of the embodiment and a desired gradation display can be attained in the same manner as the gradation display of the conventional voltage averaging driving method. In this manner, since the input interface and the liquid crystal controller for the display data and various clocks to the data electrode driving circuit may be the same as those using the voltage averaging driving method in the prior art, the interchangeability with the interface of the conventional liquid crystal panel can be attained and handling is improved. Further, the present invention can be applied to liquid crystal display units already being on the sale to be graded up.

Generally, in the passive matrix type liquid crystal display unit, variation of the voltage applied to the data electrode appears on the scanning electrode as crosstalk. Particularly, in the unselected period, spike noise appears as crosstalk in a position where the voltage is to be constant in 0 volt originally. The spike noise is to be produced due to the output impedance of the scanning driver and the impedance of the power supply circuit connected to the scanning driver without absorption. In the embodiment, the voltage during the unselected period is set to 0 volt (ground) to thereby reduce the impedance of the power supply sufficiently. Accordingly, spike noise can be apt to be absorbed, so that nonuniformity of display due to crosstalk can be reduced. Further, components such as an operation amplifier for generating the voltage during the unselected period are not required to thereby attain compactness and low price of the power supply circuit. Since the power supply circuit described in the embodiment adopts the DC-to-DC converter driven by the 5V power supply, only the 5V power supply for driving the logic is required. The liquid crystal display unit of the embodiment is different from the conventional liquid crystal display unit and does not require the power supply for driving the liquid crystal panel.

The present invention can be easily applied to the liquid crystal panel using a middle-speed responsive liquid crystal and the liquid crystal panel using a high-speed responsive liquid crystal. That is, the middle-speed responsive liquid crystal panel can be driven by the frame frequency of about 70 Hz in the same manner as the CRT driving. On the contrary, when the high-speed responsive liquid crystal panel is driven by the frame frequency of about 70 Hz, there is a problem that the brightness reducing phenomenon named the frame response occurs and the display quality is deteriorated. As an example of a method of solving this problem, it is considered that the driving frequency is increased. Particularly, it is desirable to set the driving frequency to 150 Hz or more. In the present invention, the driving frequency is simply converted only by control by the liquid crystal controller and other circuits are not required to be modified particularly. Accordingly, the driving frequency can be increased easily.

In the present invention, since the display data are read in the row direction and are processed row by row, the frequency can be increased easily. In the present invention, the line shift registers 134, 234 and the four-line latches 136, 236 are adopted and the correlators 138 and the like are provided for each column so that such a processing system is attained. In such a system, a great number of correlators 138 and he like (the number of data electrodes at maximum) are required, while in the present invention the circuit for processing the display data is formed of one chip LSI to thereby attain such a system.

In the embodiments 3 and 4, since the scanning function generating circuit is independently provided separately from the scanning electrode driving circuit, the scanning function data can be easily modified to thereby strengthen the support for the user. For example, the grading up and correction of data error can be performed easily.

In the above embodiments, the four lines are selected at the same time by way of example. However, the number of lines selected at the same time is not limited to four lines. The number of lines selected at the same time may be increased or decreased in accordance with reduction of a cost, possibility of mass production and the like of the data electrode driving circuit and the scanning electrode driving circuit.

As described above, according to the present invention, the number of components used in the liquid crystal display unit can be reduced.

Further, since the data electrode driving circuit can be operated with a low voltage, the power consumption can be reduced. In addition, the maximum permissible voltage or resistible voltage required to the data electrode driving circuit can be reduced.

Furthermore, the scanning function generating circuit is included in the scanning electrode driving circuit and the shift registers of m rows are included in the data electrode driving circuit, so that the input interface (for example, display data, driving signal, various clock) and the liquid crystal controller may use the equivalent in the prior art. Accordingly, the interchangeability with the conventional liquid crystal panel (the liquid crystal panel using the voltage averaging method driving, for example) can be attained.

Since the display data can be processed at a high speed, the liquid crystal panel using the high-speed responsive liquid crystal can be treated easily.

Nonuniformity and flickering of display can be solved to thereby perform display with higher quality.

We claim:

1. A liquid crystal display unit comprising:

a liquid crystal panel including M (M is a natural number) data electrodes and N (N is a natural number) scanning electrodes for performing display in accordance with a RMS value of a difference of voltages applied to intersecting points of both of said electrodes;

a scanning electrode driving circuit for supplying a selection voltage or a non-selection voltage to each of said scanning electrodes; and a data electrode driving circuit for supplying to said data electrodes a display voltage corresponding to inputted display data;

said scanning electrode driving circuit comprising:

an orthogonal function generating circuit for generating m orthogonal functions; and a scanning circuit for successively selecting m (m is a natural number equal to or smaller than N) continuous scanning electrodes of said scanning electrodes and applying said selection voltage to said selected m scanning electrodes in accordance with said m orthogonal functions generated by said orthogonal function generating circuit and said non-selection voltage to N-m scanning electrodes not selected at this time;

said scanning circuit using the shifted p (p is a natural number equal to or smaller than m) scanning electrodes of m scanning electrodes selected at this time as the scanning electrodes at the next selection;

said data electrode driving circuit comprising:

a shift register for storing said inputted display data by p rows;

an m-stage latch circuit for reading said display data stored in said shift register and holding said read display data during a predetermined selected period;

a correlator for performing a predetermined operation by using said display data of m rows held in said latch circuit and said m orthogonal functions; and an output circuit for selecting any one of m+1 predetermined level voltages in accordance with an operation result of said correlator and supplying said selected level voltage to said data electrodes as said display voltage, wherein p is equal to m and said correlator performs operation defined by the following expression (11):

$$Sj = \frac{\sum_{i=l}^{N} Iij \cdot Wi + m}{2} \tag{11}$$

where

Iij is display data of an i-th row and a j-th column stored in said shift register (it is a value o~f −1 when it is displayed "ON" and +1 when it is displayed "OFF");

wi is an orthogonal function taking an i-th value of +1 and −1; and

Sj is an operation result of the j-th column;

said output circuit selecting one level of said predetermined m+1 level voltages in accordance with said operation result Sj of said correlator to supply said selected level voltage to the j-th column data electrode;

said data electrode driving circuit includes said correlators and said output circuits equal to M columns in number.

2. A liquid crystal display unit according to claim 1, wherein m is equal to 4.

3. A liquid crystal display unit according to claim 1, wherein m is equal to 4 and p is equal to 4.

4. A liquid crystal display unit according to claim 1, wherein m and p are both equal to 4 and said orthogonal function is a binary function of +1 and −1 and satisfies the following conditions (1), (2) and (3):

(1) a ratio of periods constituting each value of scanning function data for m=4 rows is 3 to 1 or 1 to 3 during said selected period;

(2) a ratio of numbers constituting each value of scanning function data of four rows is 3 to 1 or 1 to 3 every a half of said selected period and is reversed every a half of said selected period; and (3) contents of said orthogonal function are changed every one selected period while the contents thereof are changed every a plurality of selected periods and have periodicity over said plurality of selected periods.

5. A liquid crystal display unit according to claim 1, comprising a liquid crystal controller for converting frequencies of said inputted display data and a liquid crystal driving signal and supplying said display data and said liquid crystal driving signal having said converted frequencies to said scanning electrode driving circuit and said data electrode driving circuit.

6. A liquid crystal display unit according to claim 1, comprising a liquid crystal controller for converting frequencies of said inputted display data and a liquid crystal driving signal and supplying said display data and said liquid crystal driving signal having said converted frequencies to said scanning electrode driving circuit and said data electrode driving circuit;

said liquid crystal controller converting said frequencies of said display data and said liquid crystal driving signal to frequencies exceeding 150 Hz in a frame frequency.

7. A liquid crystal display unit according to claim 1, wherein said data electrode driving circuit includes output transistors having a resistible voltage equal to 5 volts.

8. A liquid crystal display unit according to claim 1, wherein there are provided a plurality of said scanning electrode driving circuits;

each of said scanning electrode driving circuits includes said orthogonal function generating circuit and said scanning circuit;

a master scanning electrode driving circuit which is a predetermined scanning electrode driving circuit of said scanning electrode driving circuits causing said scanning circuit to operate in accordance with said orthogonal function generated by said orthogonal function generating circuit provided in said master scanning electrode driving circuit itself and supplying said orthogonal function to other scanning electrode driving circuits;

said scanning circuits of said other scanning electrode driving circuits being operated in accordance with said orthogonal function produced by said master scanning electrode driving circuit.

9. A liquid crystal display unit according to claim 1, wherein each of said data electrode driving circuit and said scanning electrode driving circuit is formed into one chip LSI.

10. A liquid crystal display unit comprising:

a matrix liquid crystal panel including M (M is a natural number) column data electrodes and N (N is a natural number) row scanning electrodes;

a data electrode driving circuit for supplying a data voltage determined in accordance with a inputted display data to said data electrodes;

a scanning electrode driving circuit for selecting m (m is a natural number equal to or smaller than N) row scanning electrodes at a time and supplying a separately determined scanning voltage to said selected scanning electrodes; and a power supply circuit for receiving a single DC voltage as an input to produce a plurality of DC level voltages and supplying said plurality of voltages to said data electrode driving circuit and said scanning electrode driving circuit;

said power supply circuit supplying three DC level voltages of +Vsel, 0 and −Vsel to said scanning electrode driving circuit and supplying m+1 DC level voltages of Vx0, Vx1, . . . , Vxm to said data electrode driving circuit, wherein said voltage of Vsel in said power supply circuit is given by the following expression (12):

$$Vsel = \sqrt{\frac{N}{m}} \sqrt{\frac{\sqrt{N}}{2(\sqrt{N}-1)}}\ Vth \tag{12}$$

where

Vth is a threshold voltage of said liquid crystal panel.

11. A liquid crystal display unit comprising:

a matrix liquid crystal panel including M (M is a natural number) column data electrodes and N (N is a natural number) row scanning electrodes;

a data electrode driving circuit for supplying a data voltage determined in accordance with a inputted display data to said data electrodes;

a scanning electrode driving circuit for selecting m (m is a natural number equal to or smaller than N) row scanning electrodes at a time and supplying a separately determined scanning voltage to said selected scanning electrodes; and a power supply circuit for receiving a single DC voltage as an input to produce a plurality of DC level voltages and supplying said plurality of voltages to said data electrode driving circuit and said scanning electrode driving circuit;

said power supply circuit supplying three DC level voltages of +Vsel, 0 and −Vsel to said scanning electrode driving circuit and supplying m+1 DC level voltages of Vx0, Vx1, . . . , Vxm to said data electrode driving circuit, wherein said voltage of Vxk (k is an integer equal to 0 or m or larger than 0 and smaller than m) is given by the following expression (13):

$$Vxk = \frac{1}{\sqrt{N}} \sqrt{\frac{\sqrt{N}}{2(\sqrt{N}-1)}} (2k-m)Vth \quad (13)$$

where

Vth is a threshold voltage of said liquid crystal panel.

12. A data electrode driving circuit for driving data electrodes of a liquid crystal panel on the basis of a horizontal synchronous signal, a dot clock and display data inputted externally, comprising:

a shift register for storing said externally inputted display data by p (p is a natural number) rows;

an m-stage latch circuit for reading said display data stored in said shift register and holding said reading display data during a predetermined selected period;

a correlator for performing a predetermined operation by using said display data of m (m is a natural number equal to or larger than p) rows held in said latch circuit and m orthogonal functions inputted externally; and an output circuit for selecting any one of predetermined m+1 level voltages in accordance with an operation result of said correlator to supply said selected level voltage to said data electrodes as a display voltage, wherein said correlator performs the operation defined by the following expression (11):

$$Sj = \frac{\sum_{i=l}^{N} Iij \cdot Wi + m}{2} \quad (11)$$

where

Iij is display data of an i-th row and a j-th column stored in said shift register (it is a value of −1 when it is displayed "ON" and +1 when it is displayed "OFF");

wi is an orthogonal function taking an i-th value of +1 and −1; and

Sj is an operation result of the j-th column;

said output circuit selecting one level of said predetermined m+1 level voltages in accordance with said operation result Sj of said correlator to supply said selected level voltage to the j-th column data electrode;

said correlator and said output circuit equal to M columns in number being both provided.

13. A data electrode driving circuit according to claim 12, wherein said latch circuit read said display data from said shift register by one row together.

14. A liquid crystal display unit comprising:

a liquid crystal panel including M (M is a natural number) data electrodes and N (N is a natural number) scanning electrodes for performing display in accordance with a RMS value of a difference of voltages applied to intersecting points of both of said electrodes;

a scanning electrode driving circuit for supplying a selection voltage or a non-selection voltage to each of said scanning electrodes; and a data electrode driving circuit for supplying to said data electrodes a display voltage corresponding to inputted display data;

said scanning electrode driving circuit comprising:

an orthogonal function generating circuit for generating m orthogonal functions; and a scanning circuit for successively selecting m (m is a natural number equal to or smaller than N) continuous scanning electrodes of said scanning electrodes and applying said selection voltage to said selected m scanning electrodes in accordance with said m orthogonal functions generated by said orthogonal function generating circuit and said non-selection voltage to N-m scanning electrodes not selected at this time;

said scanning circuit using the shifted p (p is a natural number equal to or smaller than m) scanning electrodes of m scanning electrodes selected at this time as the scanning electrodes at the next selection;

said data electrode driving circuit comprising:

a shift register for storing said inputted display data by p rows;

an m-stage latch circuit for reading said display data stored in said shift register and holding said read display data during a predetermined selected period;

a correlator for performing a predetermined operation by using said display data of m rows held in said latch circuit and said m orthogonal functions; and an output circuit for selecting any one of m+1 predetermined level voltages in accordance with an operation result of said correlator and supplying said selected level voltage to said data electrodes as said display voltage, wherein p is equal to m and said correlator performs operation defined by the following expression (11):

$$Sj = \frac{\sum_{i=l}^{N} Iij \cdot Wi + m}{2} \quad (11)$$

where

Iij is display data of an i-th row and a j-th column stored in said shift register (it is a value of −1 when it is displayed "ON" and +1 when it is displayed "OFF");

wi is an orthogonal function taking an i-th value of +1 and −1; and

Sj is an operation result of the j-th column;

said output circuit selecting one level of said predetermined m+1 level voltages in accordance with said operation result Sj of said correlator to supply said selected level voltage to the j-th row data electrode:

said data electrode driving circuit includes said correlators and said output circuits equal to M columns in number;

said latch circuit reading said display data from said shift register by one row together.

15. A liquid crystal display unit according to claim 14, wherein p is equal to 1.

16. A liquid crystal display unit according to claim 14, wherein m is equal to 4.

17. A liquid crystal display unit according to claim 14, wherein m is equal to 4 and p is equal to 4.

18. A liquid crystal display unit according to claim 14, wherein m and p are both equal to 4 and said orthogonal function is a binary function of +1 and −1 and satisfies the following conditions (1), (2) and (3):

(1) a ratio of periods constituting each value of scanning function data for m=4 rows is 3 to 1 or 1 to 3 during said selected period;

(2) a ratio of numbers constituting each value of scanning function data of four rows is 3 to 1 or 1 to 3 every a half of said selected period and is reversed every a half of said selected period; and (3) contents of said orthogonal function are changed every one selected period while the contents thereof are changed every a plurality of selected periods and have periodicity over said plurality of selected periods.

19. A liquid crystal display unit according to claim 14, comprising a liquid crystal controller for converting frequencies of said inputted display data and a liquid crystal driving signal and supplying said display data and said liquid crystal driving signal having said converted frequencies to said scanning electrode driving circuit and said data electrode driving circuit.

20. A liquid crystal display unit according to claim 14, comprising a liquid crystal controller for converting frequencies of said inputted display data and a liquid crystal driving signal and supplying said display data and said liquid crystal driving signal having said converted frequencies to said scanning electrode driving circuit and said data electrode driving circuit;

said liquid crystal controller converting said frequencies of said display data and said liquid crystal driving signal to frequencies exceeding 150 Hz in a frame frequency.

21. A liquid crystal display unit according to claim 14, wherein said data electrode driving circuit includes output transistors having a resistible voltage equal to 5 volts.

22. A liquid crystal display unit according to claim 7, wherein there are provided a plurality of said scanning electrode driving circuits;

each of said scanning electrode driving circuits includes said orthogonal function generating circuit and said scanning circuit;

a master scanning electrode driving circuit which is a predetermined scanning electrode driving circuit of said scanning electrode driving circuits causing said scanning circuit to operate in accordance with said orthogonal function generated by said orthogonal function generating circuit provided in said master scanning electrode driving circuit itself and supplying said orthogonal function to other scanning electrode driving circuits;

said scanning circuits of said other scanning electrode driving circuits being operated in accordance with said orthogonal function produced by said master scanning electrode driving circuit.

23. A liquid crystal display unit according to claim 14, wherein each of said data electrode driving circuit and said scanning electrode driving circuit is formed into one chip LSI.

* * * * *